US008899680B2

(12) United States Patent
Meier et al.

(10) Patent No.: US 8,899,680 B2
(45) Date of Patent: Dec. 2, 2014

(54) MECHANISM FOR A CHAIR

(75) Inventors: Manfred Meier, Neuenburg (DE); Hermann Bock, Pyrbaum (DE)

(73) Assignee: Vitra Patente AG, Muttenz (CH)

( * ) Notice: Subject to any disclaimer, the term of this patent is extended or adjusted under 35 U.S.C. 154(b) by 347 days.

(21) Appl. No.: 13/390,560

(22) PCT Filed: Aug. 26, 2010

(86) PCT No.: PCT/CH2010/000210
§ 371 (c)(1),
(2), (4) Date: Feb. 15, 2012

(87) PCT Pub. No.: WO2011/022856
PCT Pub. Date: Mar. 3, 2011

(65) Prior Publication Data

US 2012/0181831 A1 Jul. 19, 2012

(30) Foreign Application Priority Data

Aug. 26, 2009 (CH) ..... 1334/09

(51) Int. Cl.
*A47C 1/024* (2006.01)
*A47C 1/032* (2006.01)

(52) U.S. Cl.
CPC ..... *A47C 1/03255* (2013.01); *A47C 1/03272* (2013.01); *A47C 1/03266* (2013.01)
USPC ..... 297/300.5; 297/300.8; 297/303.4

(58) Field of Classification Search
CPC ..... A47C 1/03255
USPC ..... 297/300.2, 300.7, 300.8, 300.5
See application file for complete search history.

(56) References Cited

U.S. PATENT DOCUMENTS

| | | | | |
|---|---|---|---|---|
| 4,537,445 | A * | 8/1985 | Neuhoff | 297/300.3 |
| 4,966,411 | A * | 10/1990 | Katagiri et al. | 297/300.7 |
| 7,080,884 | B2 * | 7/2006 | Daeschle et al. | 297/303.4 |
| 7,429,081 | B2 * | 9/2008 | Roslund et al. | 297/300.2 |
| 7,467,826 | B1 * | 12/2008 | Wen | 297/303.4 |
| 7,513,570 | B2 * | 4/2009 | Roslund et al. | 297/300.2 |
| 7,568,763 | B2 * | 8/2009 | Bedford et al. | 297/300.1 |
| 7,866,749 | B2 * | 1/2011 | Costaglia et al. | 297/300.5 |
| 8,100,477 | B2 * | 1/2012 | Fich | 297/303.5 |
| 2005/0236878 | A1 * | 10/2005 | Rossetto et al. | 297/300.8 |
| 2010/0289309 | A1 * | 11/2010 | Fich | 297/300.2 |

FOREIGN PATENT DOCUMENTS

| | | | |
|---|---|---|---|
| EP | 0 592 369 | B1 | 4/1994 |
| EP | 0 839 478 | B1 | 5/1998 |
| EP | 1 039 816 | B1 | 10/2000 |
| EP | 1 358 821 | A1 | 11/2003 |
| WO | WO 04/000075 | A2 | 12/2003 |
| WO | WO 2005/120291 | A1 | 12/2005 |
| WO | WO 2006/108536 | A1 | 10/2006 |
| WO | WO 2007/124609 | A2 | 11/2007 |
| WO | WO 2009/103389 | A1 | 8/2009 |

OTHER PUBLICATIONS

International Search Report, mailed on Nov. 25, 2010, in connection with International Application No. PCT/CH2010/000210 (3 pages).
International Preliminary Report on Patentability, issued on Mar. 6, 2012, in connection with International Application No. PCT/CH2010/000210 (6 pages).

* cited by examiner

*Primary Examiner* — David R Dunn
*Assistant Examiner* — Alexander Harrison
(74) *Attorney, Agent, or Firm* — McCarter & English, LLP

(57) ABSTRACT

The invention relates to a mechanism (2) designed for a chair, in particular for a rotatable office chair having a gas spring (12) vertically arranged in the underframe (1), the gas spring having a telescopically extendible piston rod so that the height of the seat (9) can be adjusted. The tilting adjustment of the seat (9) between the rest position ($S_0$) and the relaxation position ($S_{max}$) occurs in synchronization with the adjustment of the backrest (96) between a rest position ($R_0$) and a relaxation position ($R_{max}$) inclined backward. The mechanism (2) has a shell (30), through which a stationary first rotational axis (D1) extends and on which a seat carrier (80) capable of being inclined is mounted. A front-side connection means (33) is arranged between the seat carrier (80) and the shell (30), the front-side connection means being connected to the shell (30) in an articulated manner in a second rotational axis (D2) and being connected to the seat carrier (80) in an articulated manner in a third rotational axis (D3). A rear-side connection means (60) is provided, which is connected in an articulated manner in the first rotational axis (D1) and in a fourth rotational axis (D4), which extends through the seat carrier (80). A spring system (46) acting between the shell (30) and the seat carrier (80) is provided. The mechanism (2) has a force adjuster (39), which can be actuated from the outside and which is designed to change the preloading of the spring system (46) by means of a transmission arrangement (390,51,52,53). The transmission arrangement (390,51,52,53) comprises movable means (52,53) having inclined surfaces provided thereon, wherein a rear-side bearing (462,464,465) of the spring system (46) is supported on said inclined surfaces.

11 Claims, 64 Drawing Sheets

Figure 1B:
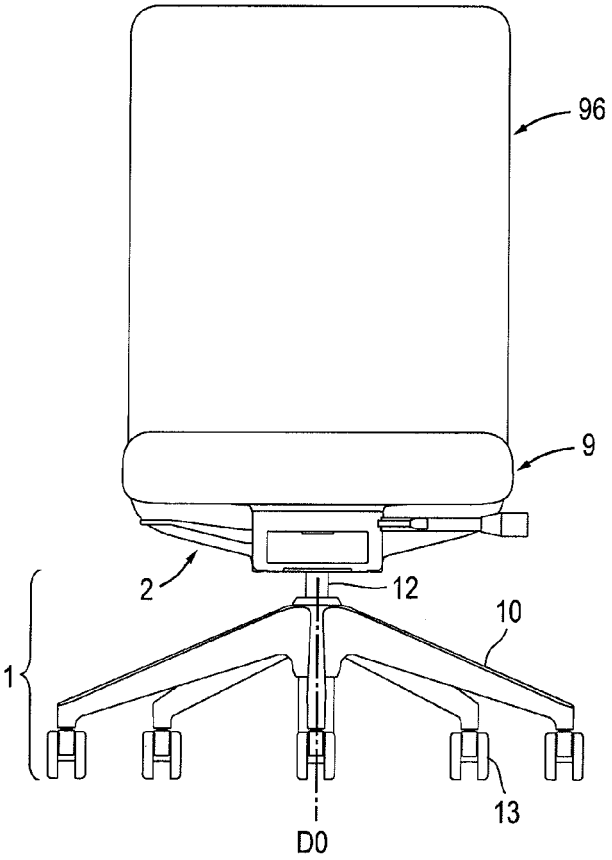

Fig. 1C
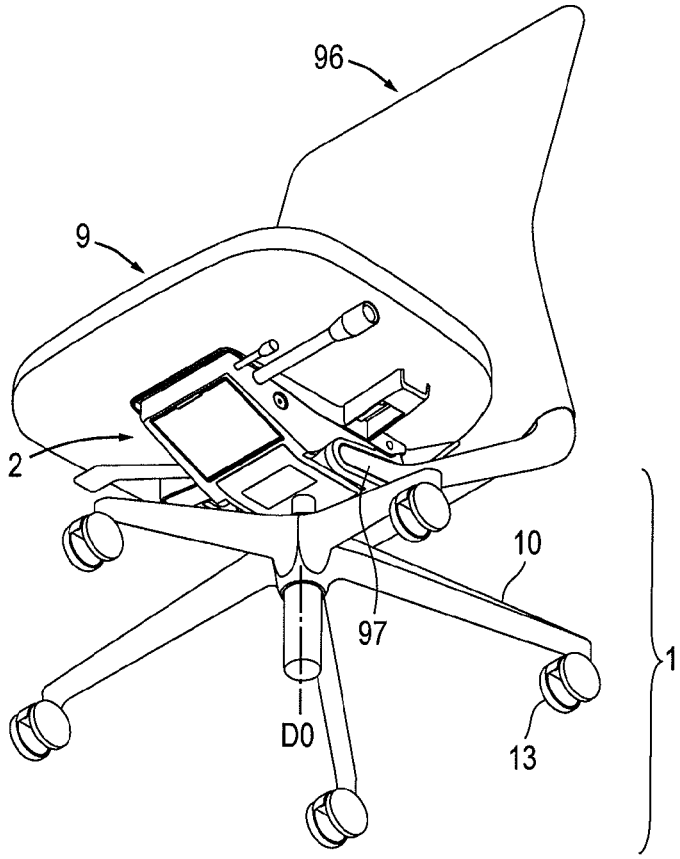
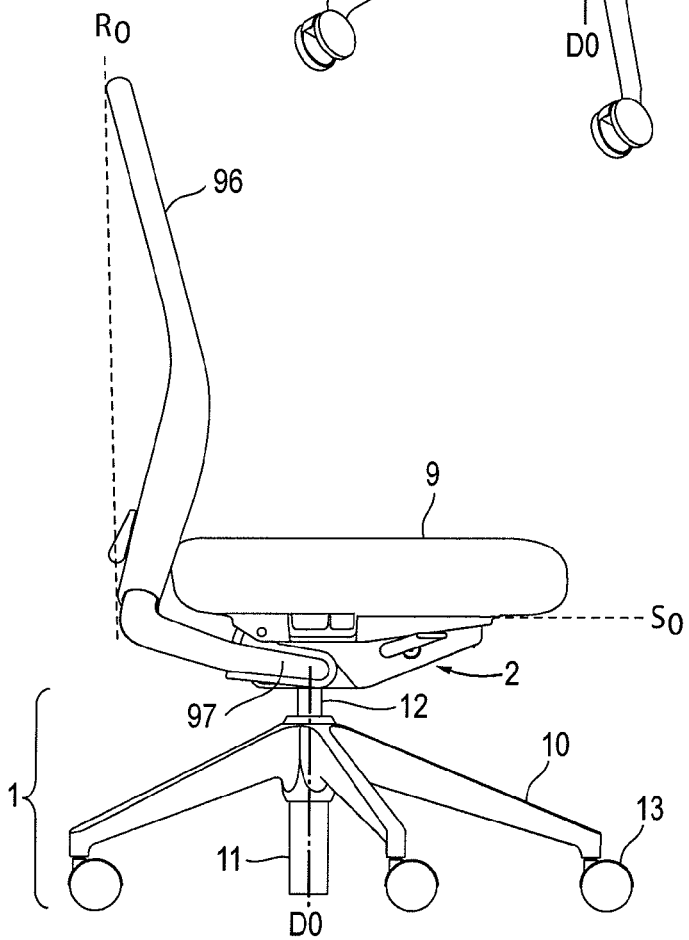
Fig. 1D

Fig. 3A
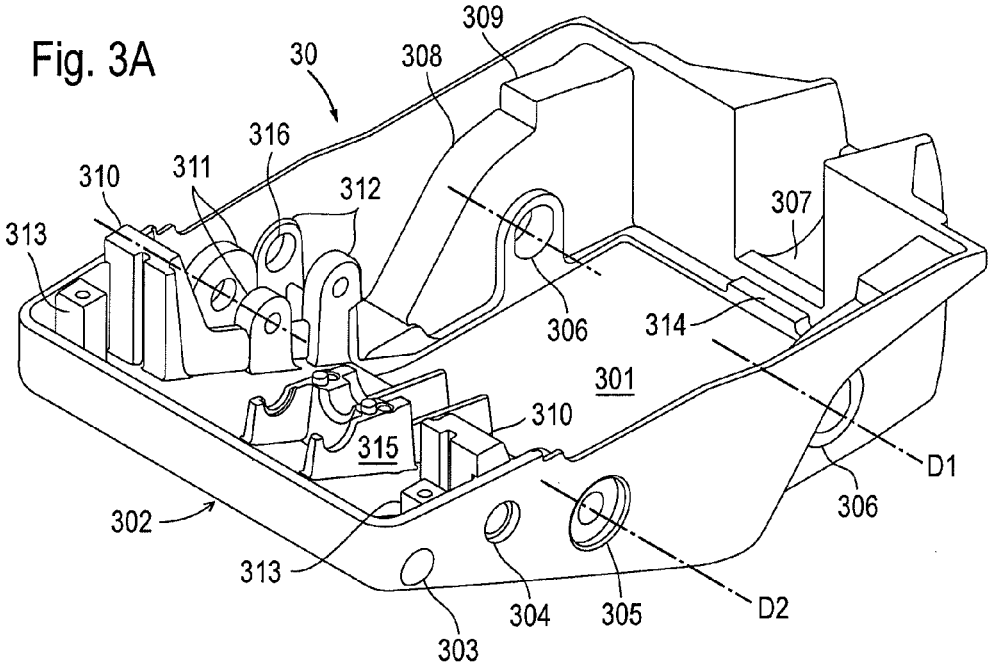
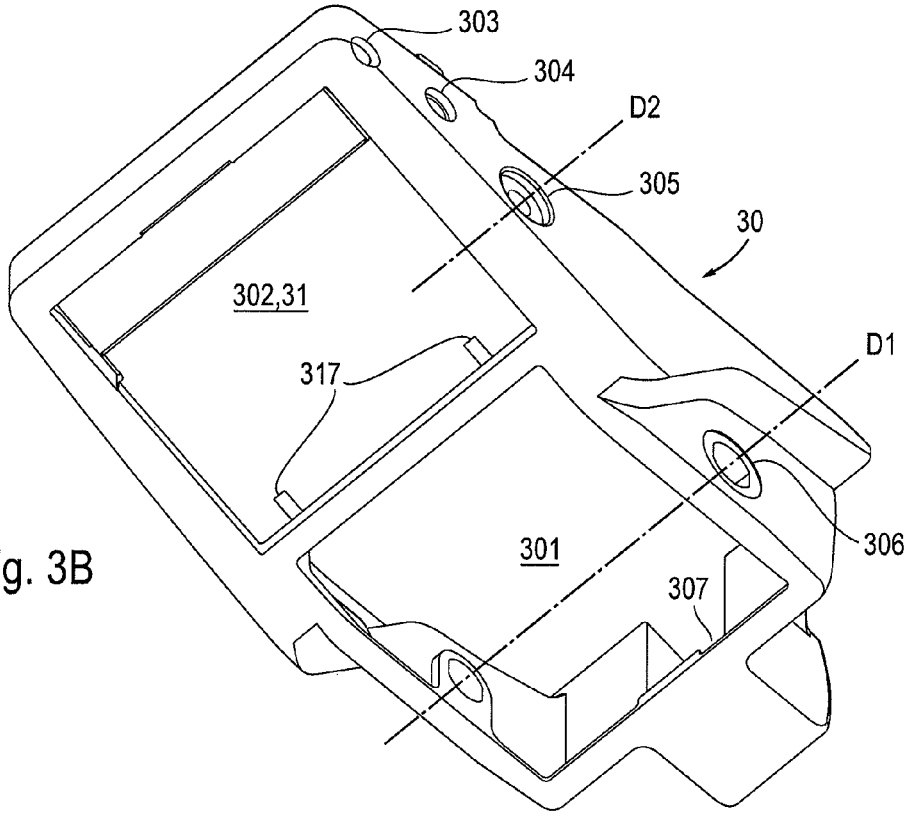
Fig. 3B

Fig. 3C
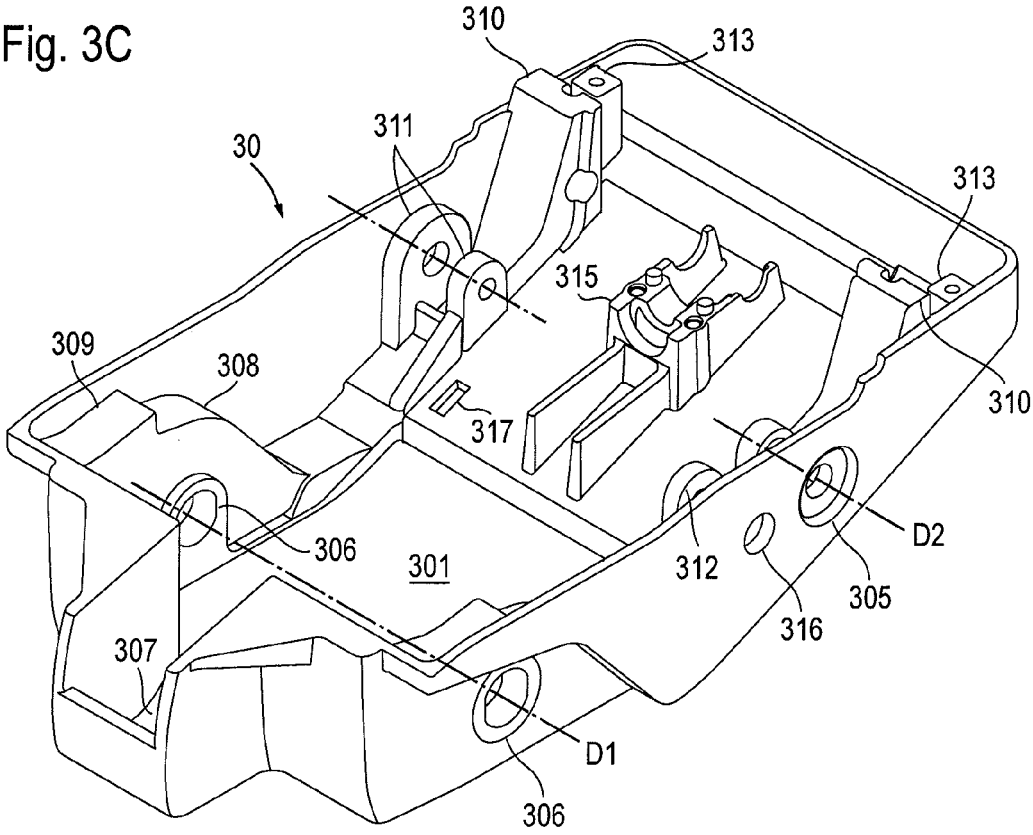
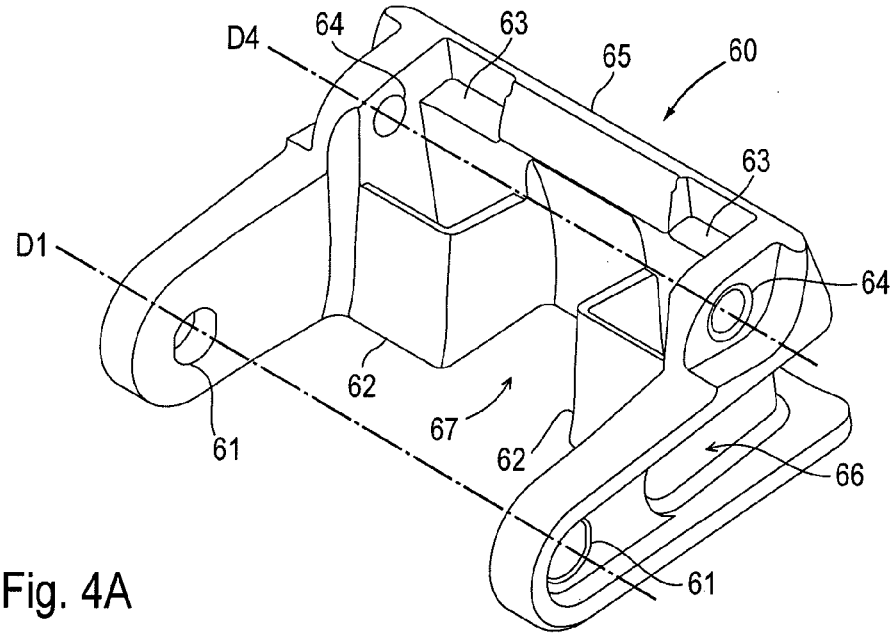
Fig. 4A

Fig. 4B
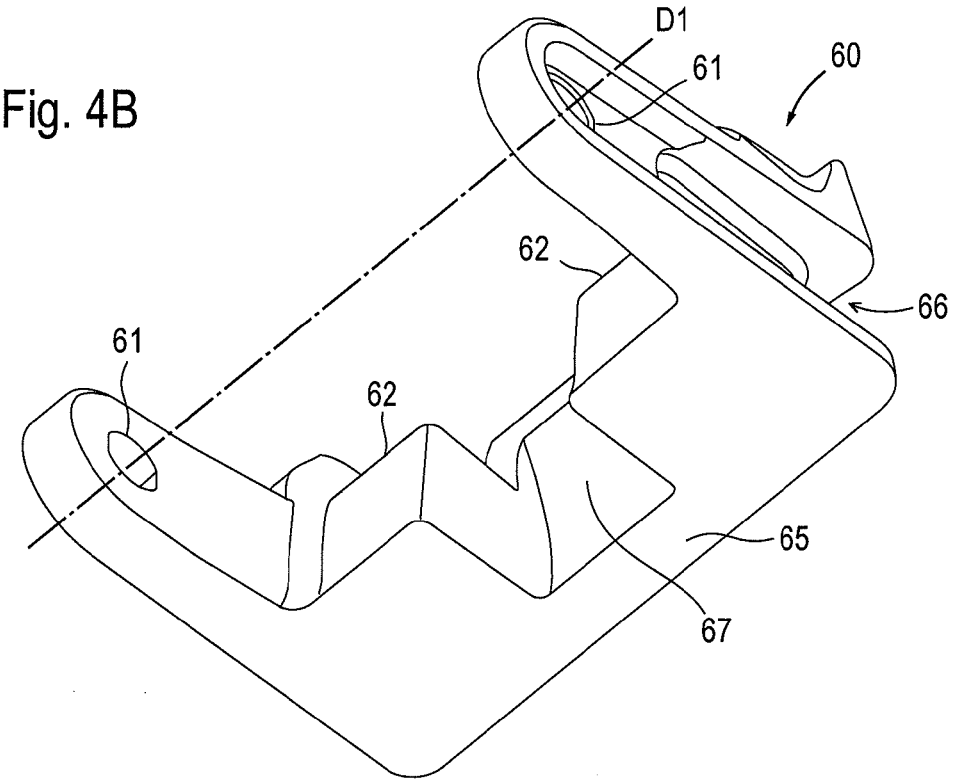
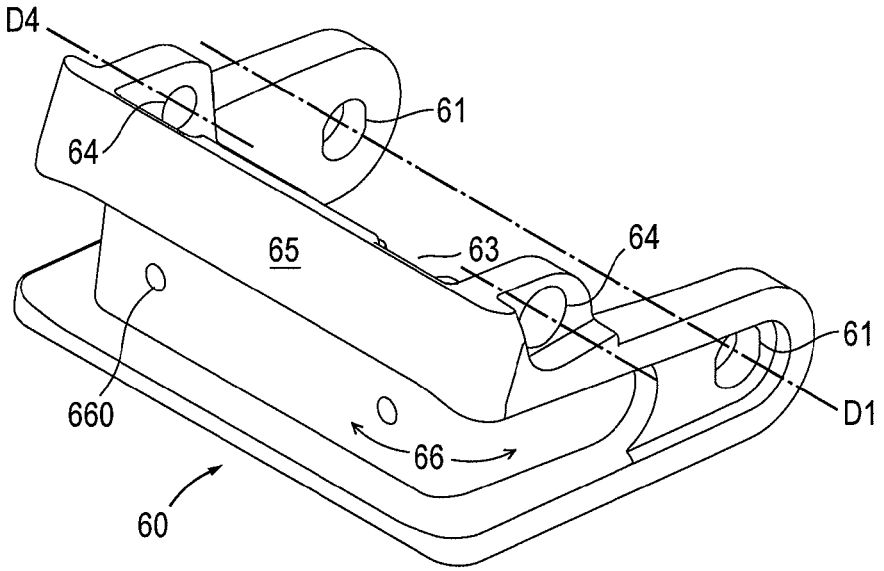
Fig. 4C

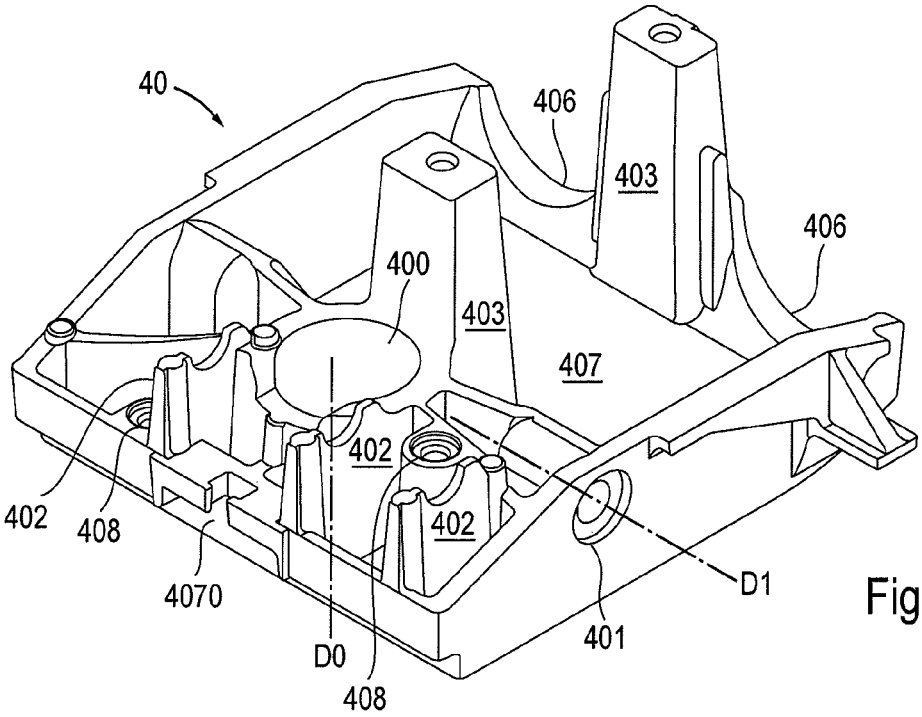
Fig. 5C
Fig. 6A
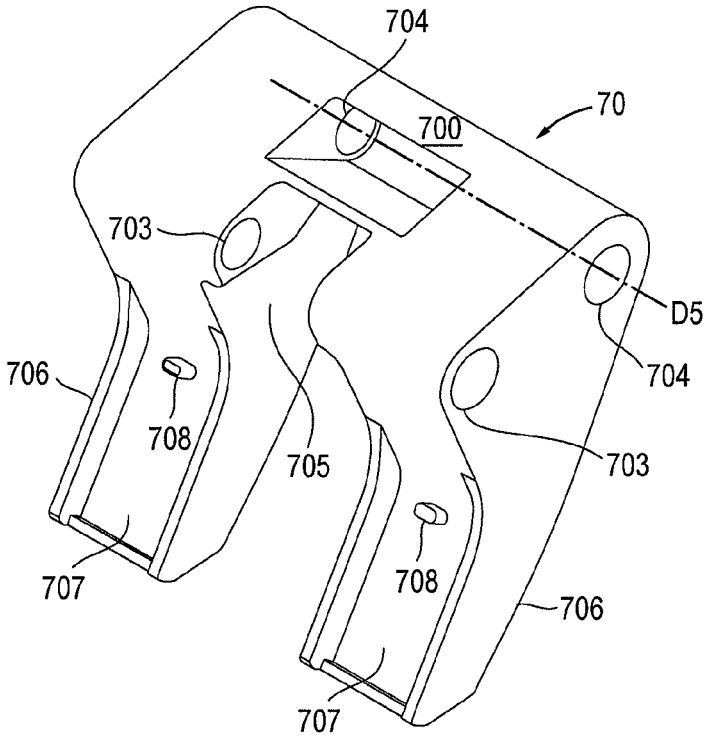

Fig. 6B
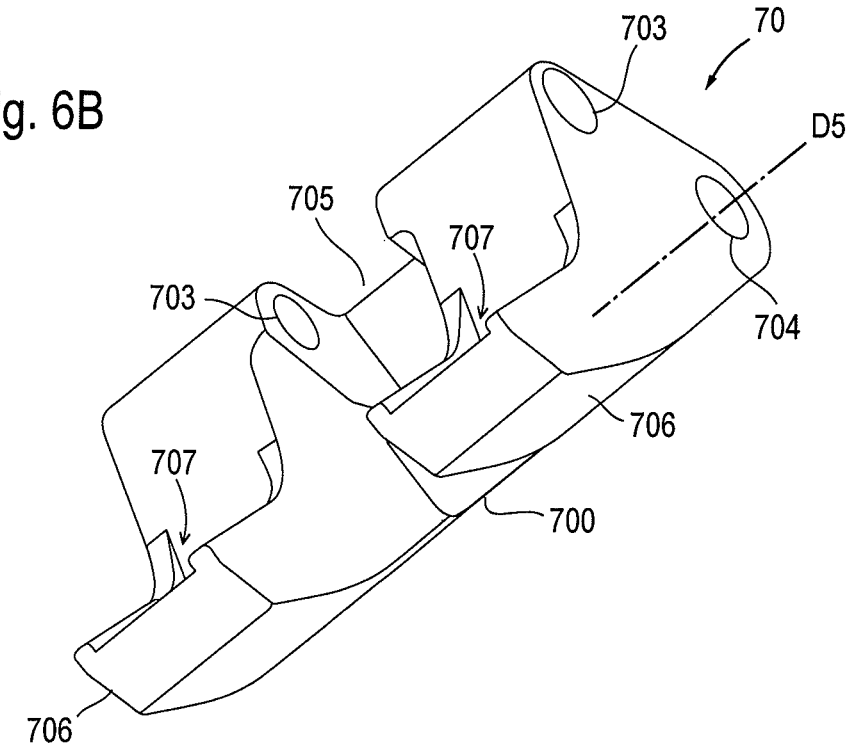
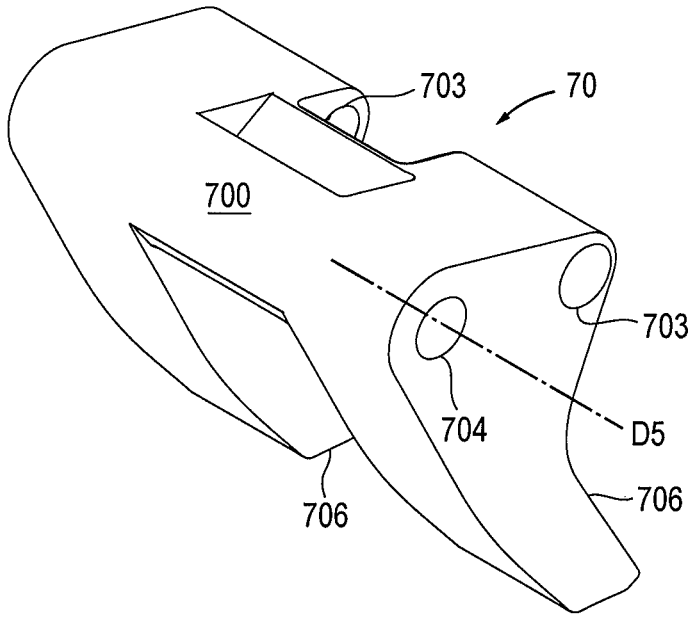
Fig. 6C

Fig. 9E
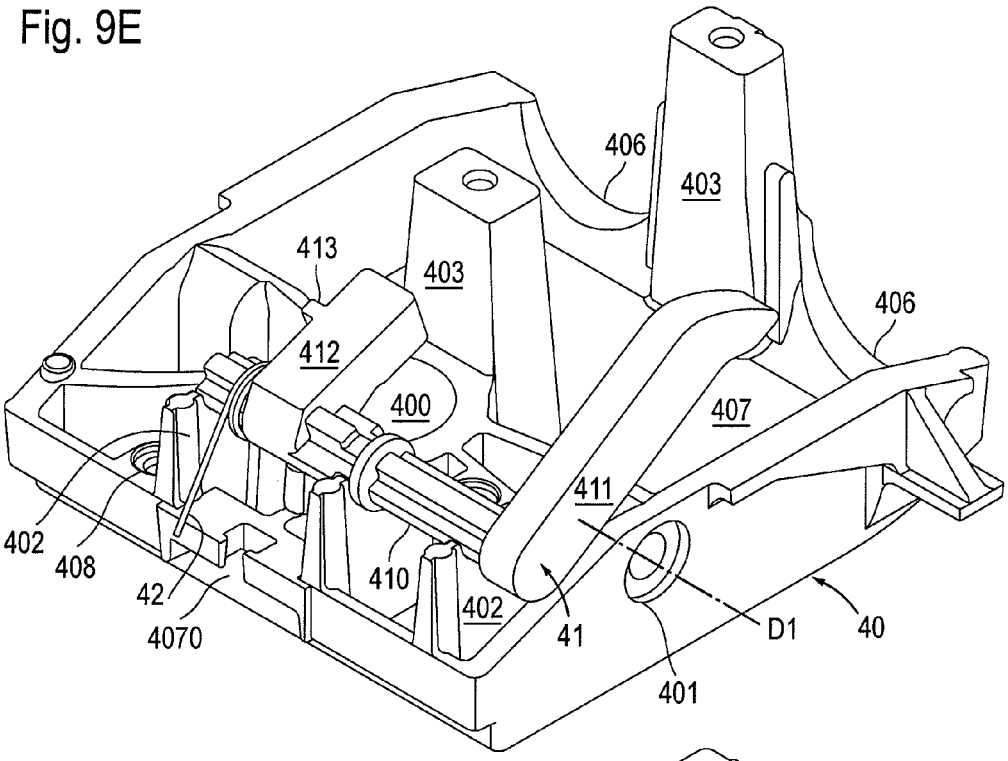
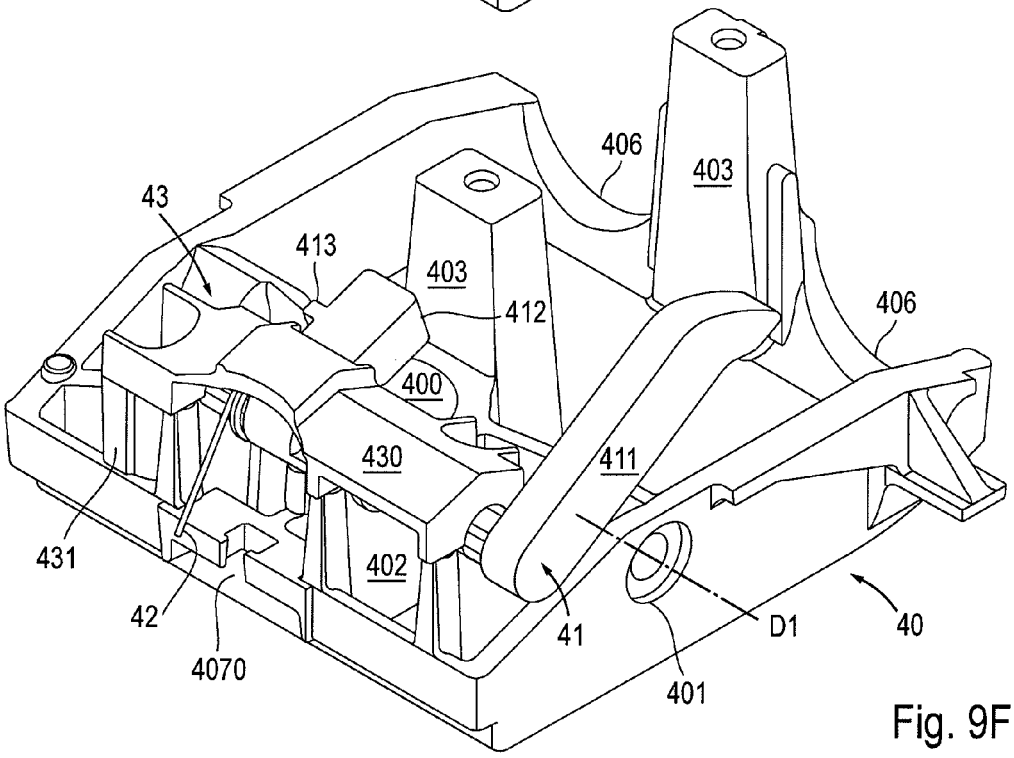
Fig. 9F

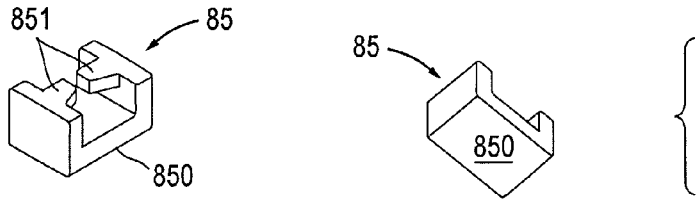
Fig. 14A
Fig. 14B
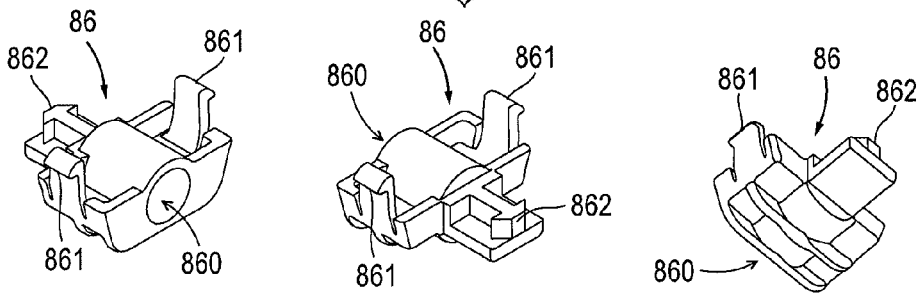
Fig. 14C
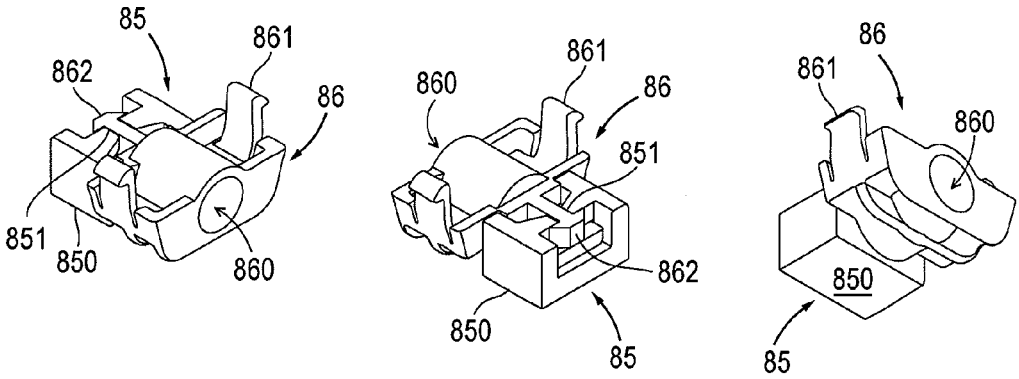

Fig. 15A
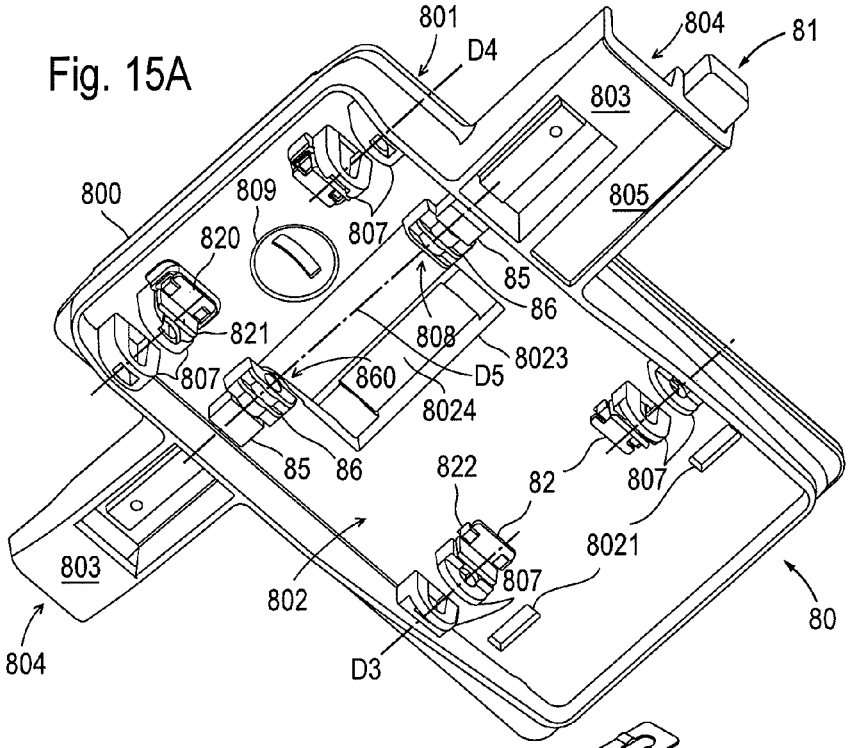
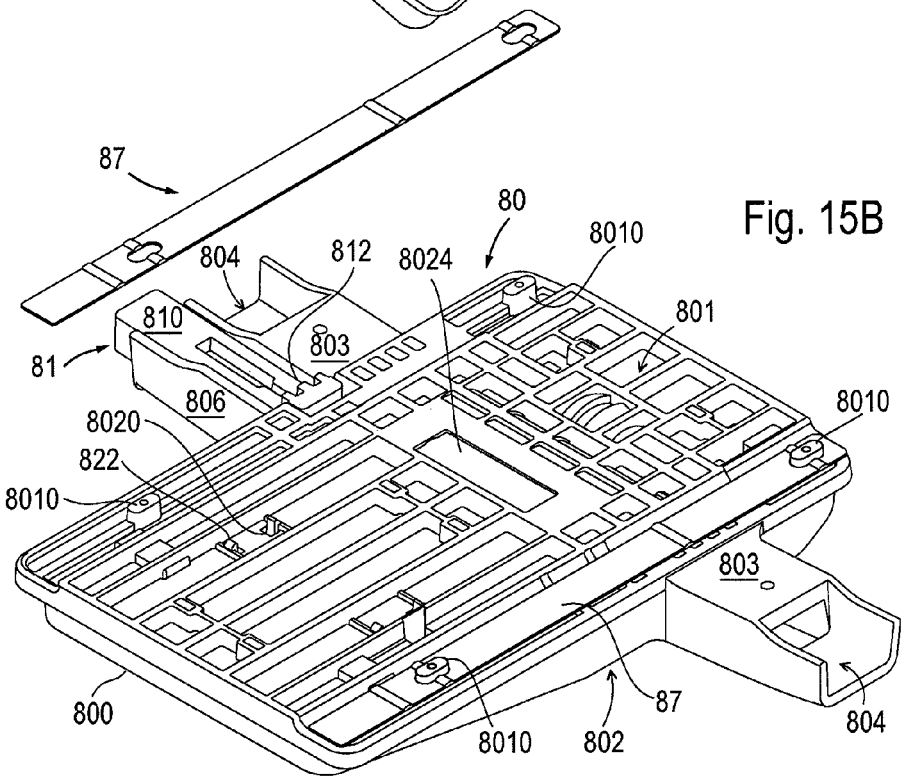
Fig. 15B

Fig. 16A
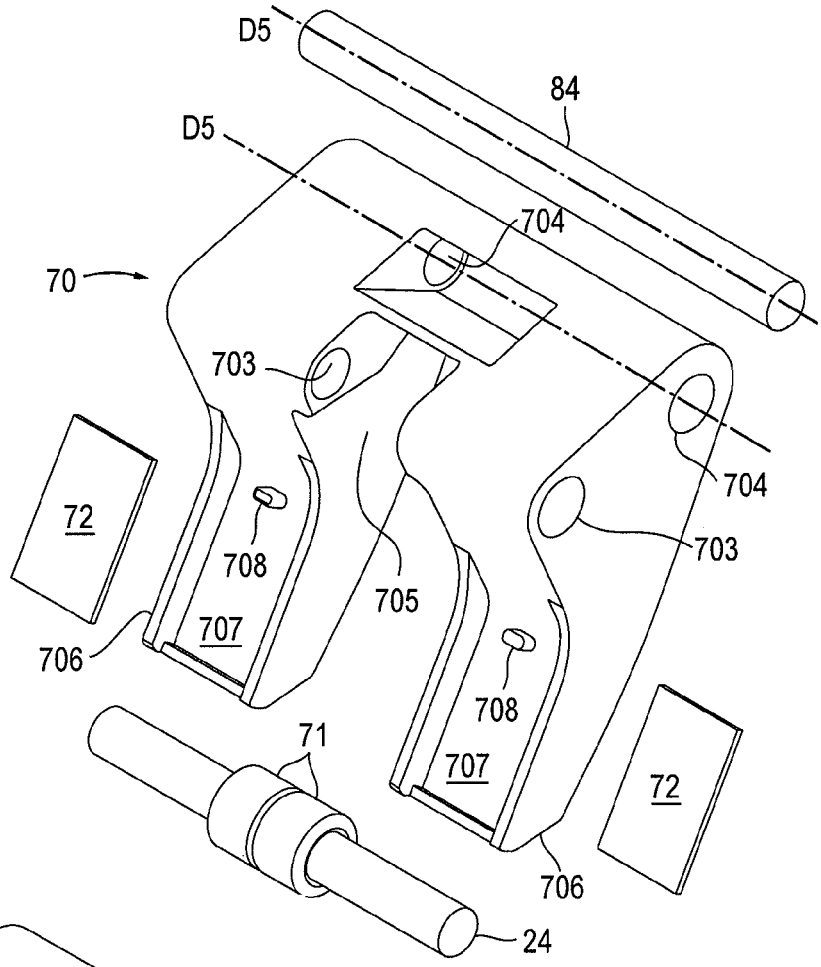
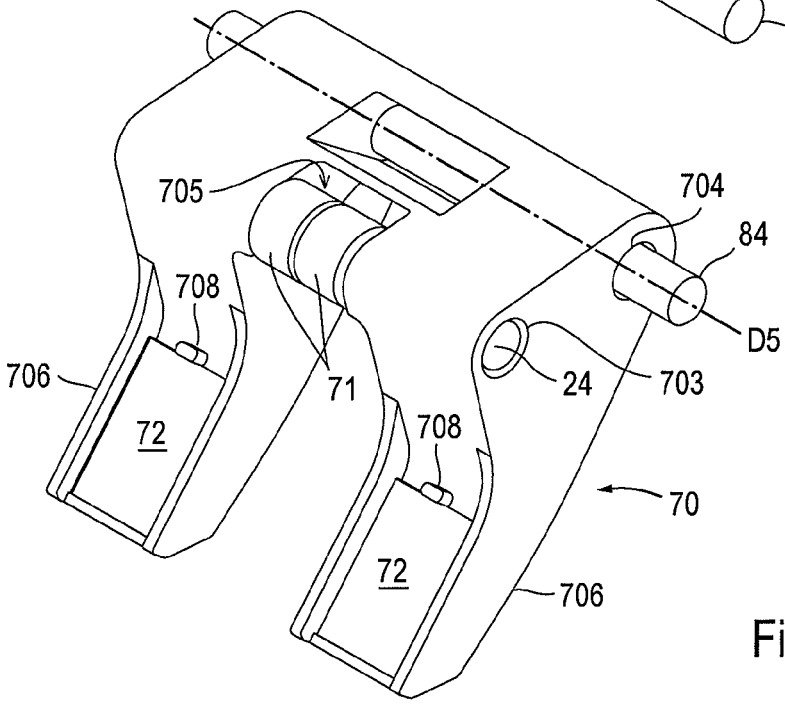
Fig. 16B

Fig. 17A
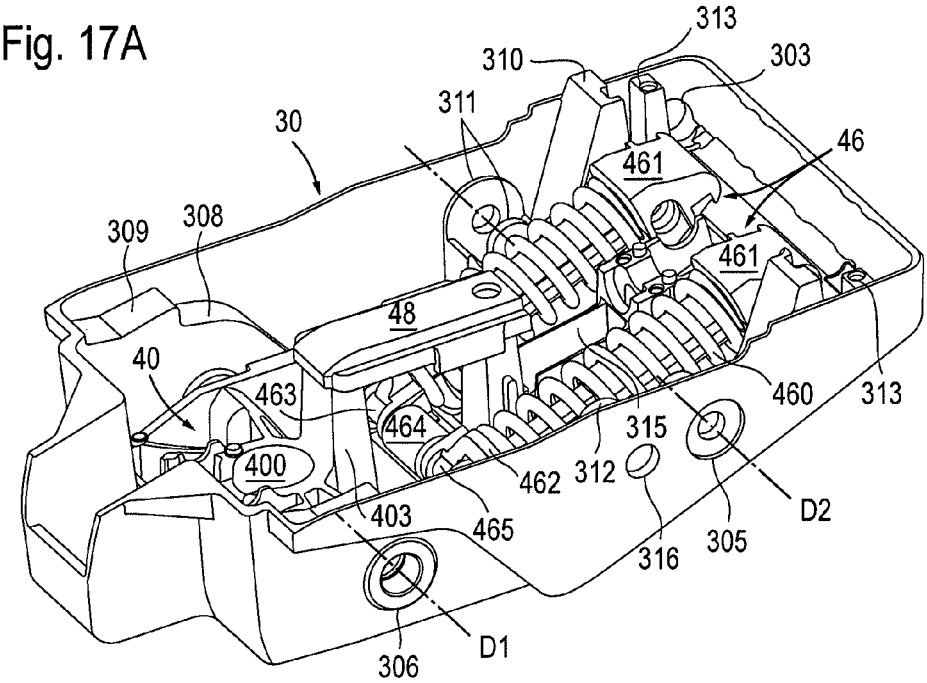
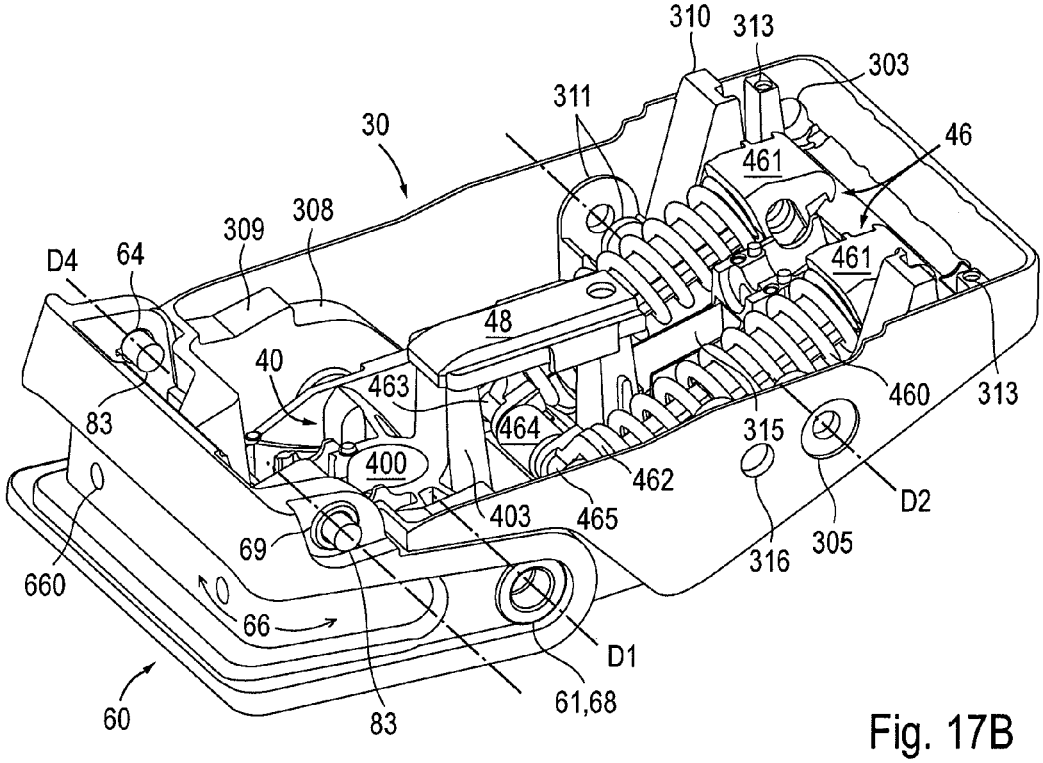
Fig. 17B

Fig. 17C
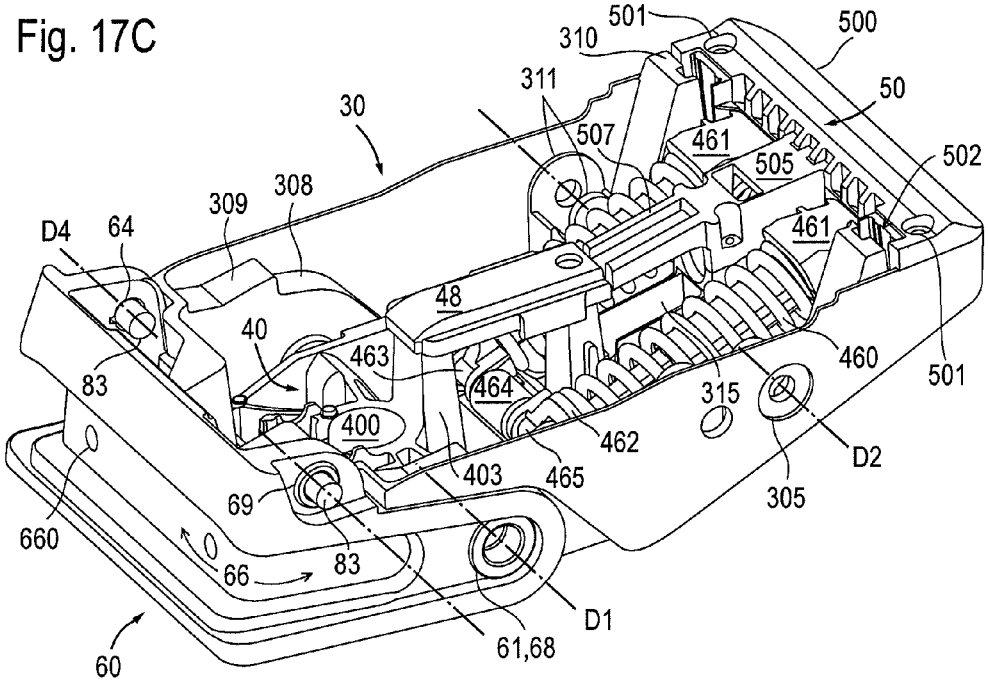
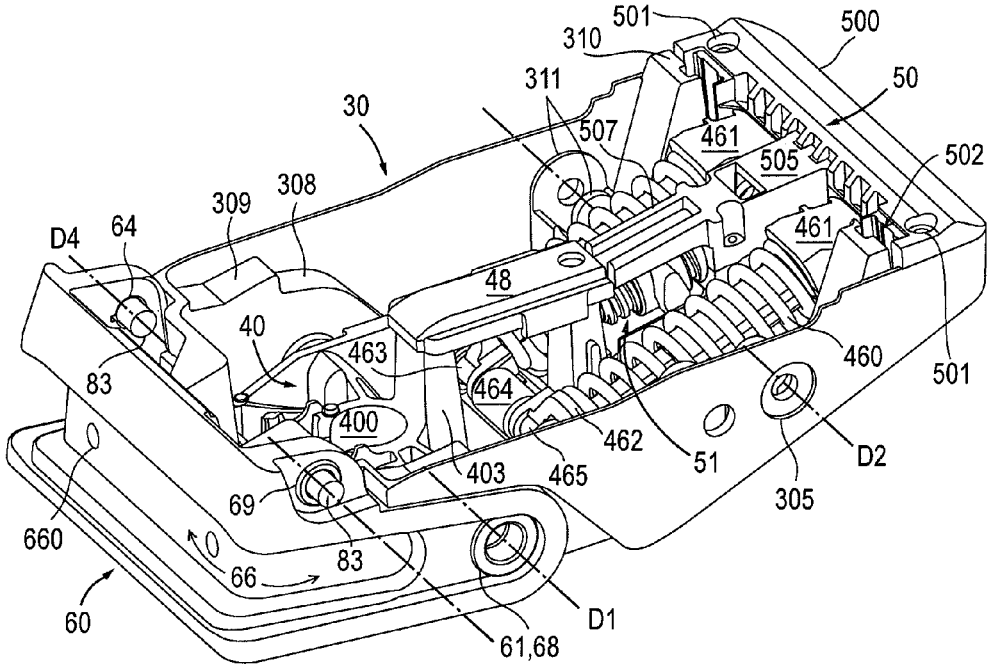
Fig. 17D

Fig. 20A
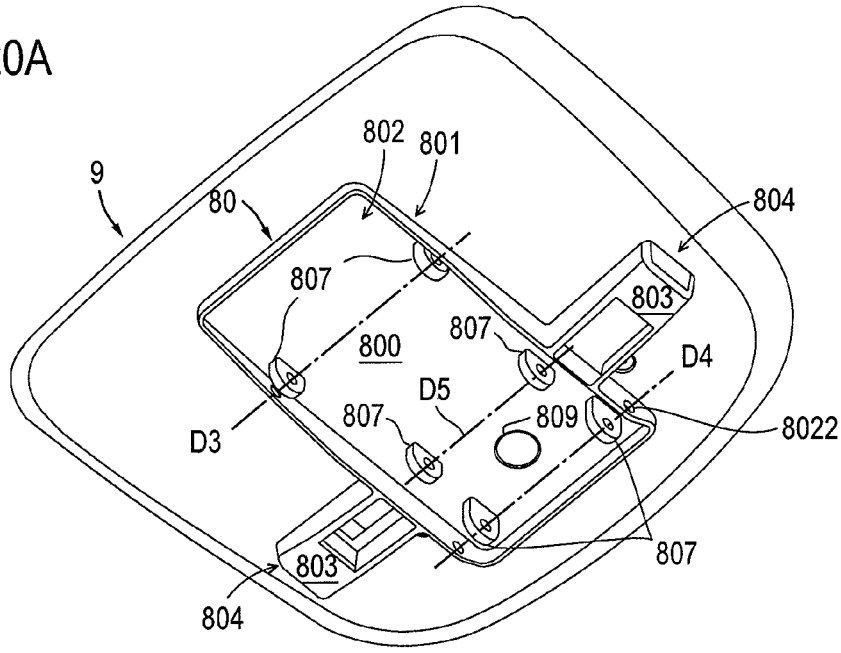
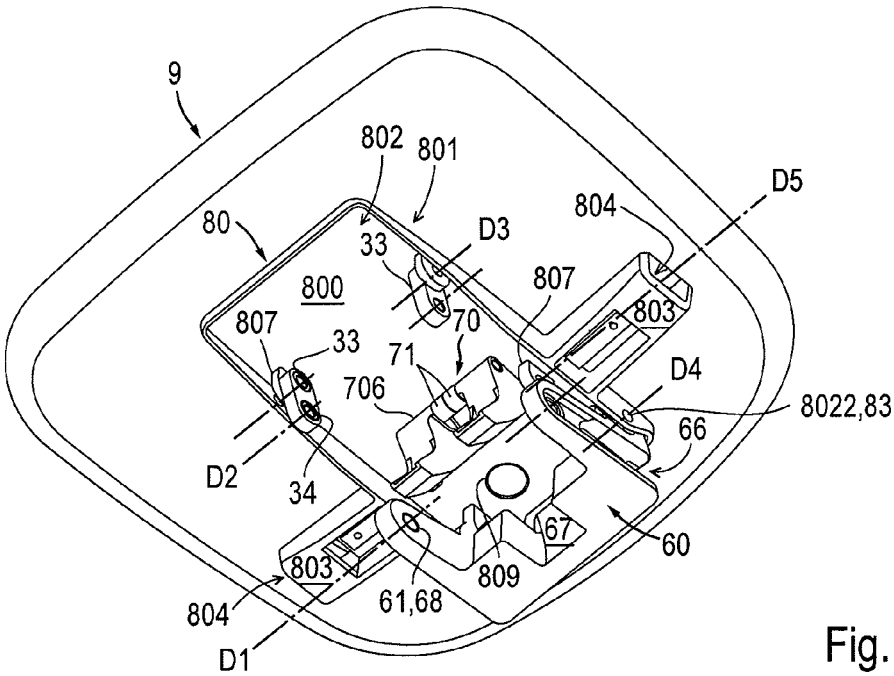
Fig. 20B

Fig. 24
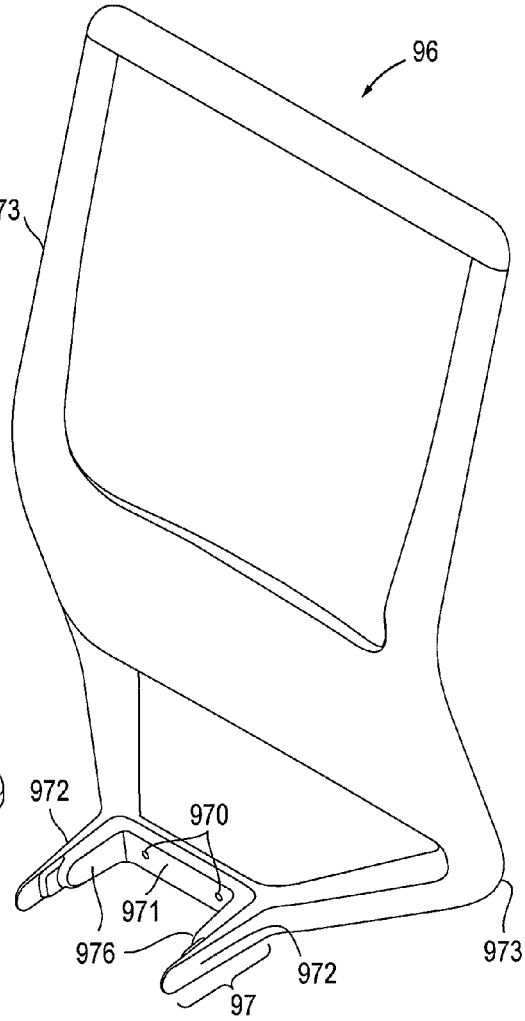
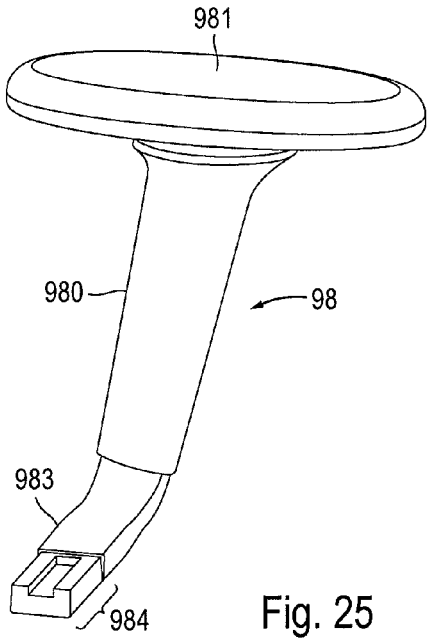
Fig. 25

MECHANISM FOR A CHAIR

FIELD OF THE INVENTION

The invention relates to a chair mechanism, in particular for a rotatable office chair having a pneumatic spring which is arranged vertically in the underframe for the adjustability of the height of the seat. As the backrest is inclined rearward, which the user initiates by means of shifting his weight, the chair mechanism causes the seat to be lowered synchronously in a rearward direction. In a convenient variant, the chair mechanism enables the seat surface to be lowered forward—so-called negative inclination—when the user shifts his weight forward, e.g. towards a desk.

PRIOR ART

Many synchronizing mechanisms for chairs are known, e.g. from patent publications EP 0 839 478 B1, EP 1 039 816 B1, EP 1 358 821 A1, WO 2005/120291 A1 and WO 2007/124609 A2, and are established in the market.

EP 0 592 369 B1 discloses a synchronizing mechanism for a work chair with a seat carrier and a backrest carrier which are arranged so as to be pivotable in the same direction and independently from each other. The seat carrier is connected in an articulated manner at the back on the backrest carrier along a seat-backrest carrier axis of rotation and at the front along a front seat axis of rotation. The front seat axis of rotation is connected to the synchronizing movement main axis of rotation—this is provided by the longitudinal axis of a torsion spring—by means of entrainment plates, which are fixedly attached on the front seat axis of rotation as well as on the torsion spring. The entrainment plates have a plate recess in which a stop is provided for defining the pivoting region. A negative inclination region, as inclination of the chair mechanism forward, is connected upstream of the pivoting region of the synchronizing movement between seat carrier and backrest carrier about a negative inclination axis of rotation. Consequently, depending on his/her posture and body weight distribution, a pivoting region of the chair with stepless transitions from a position inclined forward as far as a position inclined backward is made available to the user. The connected operating elements of the synchronizing mechanism, seat carrier, entrainment plates, torsion spring and backrest carrier are placed as a system on the negative inclination axis of rotation, situated in the extension of the upright tube, and as such are pivotable about said axis of rotation on a flexible seat support.

The object of WO 2007/124 609 A2 is a mechanism with a base which is fixed per se, through which a fixed first axis of rotation extends and on which an inclinable seat carrier is mounted. A front connecting means, which is connected in an articulated manner on the base in a fixed third axis of rotation and in a mobile fourth axis of rotation, is arranged between the base and the seat carrier. In addition, the mechanism has a rear connecting means which is connected at the one end in an articulated manner in a mobile sixth axis of rotation and at the other end in a further mobile axis of rotation. In the mechanism there is at least one first spring element, which acts between the base and the seat carrier and is connected in an articulated manner in the fourth axis of rotation. At the other end, said first spring element is connected in an articulated manner in a movable eighth axis of rotation, the position of which can be modified by means of a gearing which is actuatable from the outside by the user. The first spring element is advantageously a pneumatic spring which can be blocked by means of an arresting element which is actuatable by the user, as a result of which seat and backrest are locked in the rest position.

The present application builds further on WO 2009/103 389 A1, which relates to a mechanism for an office chair. The mechanism has a movable actuating element, the position of which is modified during a movement of the mechanism and through the change in position of which the movement characteristic of the mechanism is modified. In this case, the actuating element is in operative connection with an operating element, the position of which is modified during a movement of the mechanism when the position of the actuating element is changed, at least one characteristic of the change in position of the actuating element being modified when there is a change in the position of the operating element.

OBJECT OF THE INVENTION

In relation to the previously known prior art, the object underlying the invention is to propose a further improved synchronizing mechanism which responds in a sensitive manner to shifts in weight. The object, in particular, is to develop the adjustability of the prestressing of the mechanism in a more user-friendly manner for less heavy or heavier persons. Another object is to be able to alter the movement characteristic of the mechanism in a simple manner, e.g. for users of taller than average height and/or heavier than average weight. A further object is to develop the mechanism in a more universal manner in order to be able to use different seat structures. In addition, the mechanism is to enable the chair to be provided with armrests and a backrest to be attached in a flexibly designed manner. Finally, it is to be possible to have the mechanism series-produced with expenditure that is cost-efficient.

OVERVIEW OF THE INVENTION

The mechanism is designed for a chair, in particular for a rotatable office chair having a pneumatic spring which is arranged vertically in the underframe and has a telescopically extensible piston rod for the adjustability of the height of a seat. The inclining adjustment of the seat between the rest position and the relaxation position is synchronous with an adjustment of a backrest between a rest position and a rearwardly inclined relaxation position. The mechanism has a shell, through which a fixed first axis of rotation extends and on which an inclinable seat carrier is mounted. A front connecting means is arranged between the seat carrier and the shell, said front connecting means being connected in an articulated manner on the shell in a second axis of rotation and on the seat carrier in a third axis of rotation. There is provided a rear connecting means which is connected in an articulated manner in the first axis of rotation and in a fourth axis of rotation which extends through the seat carrier. There is present a spring system which acts between the shell and the seat carrier. The mechanism has a force adjuster which is actuatable from the outside and is intended for modifying the prestressing of the spring system by means of a gearing arrangement. The gearing arrangement includes movably positionable means with inclined surfaces present thereon, on which a rear bearing arrangement of the spring system is supported.

The following features relate to special designs of the invention: By combining the shell with a base, which is arranged in said shell and is realized as a separate part, the seat, when loaded at the front, is able to be adjusted between the rest position and a negative position with a front edge of the seat lowered.

The gearing arrangement includes:

aa) a toothed wheel which can be rotated by means of a rotational movement at the force adjuster;

ab) a longitudinally movable transfer part with a toothing which engages with the toothed wheel;

ac) a primary wedge which is longitudinally displaceable by the transfer part; and ad) an intermediate wedge attached to the primary wedge, wherein primary wedge and intermediate wedge are displaceable towards each other;

b) the spring system includes two arrangements which are parallel to each other, each consisting of one upper part which is telescopically connected to a lower part, wherein a helical spring is accommodated between upper part and lower part; and c) the rear bearing arrangement of the spring system includes the two lower parts, a shaft which projects through both lower parts and a center roller which is placed on the shaft between the lower parts.

The transfer part has a rod section with an external thread arranged thereon, on which an entrainment means, which strikes against the primary wedge, is displaceably guided.

The intermediate wedge is arranged below the primary wedge, is supported from below by the center roller and at the front-end leans against a post which rises out of the base. The upper parts are associated with a front bearing arrangement of the spring system.

There is provided a guide means which is connected in an articulated manner on the seat carrier in a fifth axis of rotation. The fifth axis of rotation on the guide means runs through a cross portion. Two arms which are parallel to each other extend from the cross portion. An outside roller which is placed on the shaft is arranged in each of the lower parts. In each case one of the outside rollers is guided on one of the arms of the guide means.

A roller, which is supported on a control cam, which is positioned on the base, is arranged on the guide means.

At a spacing from the one post, against which the intermediate wedge leans and which is adjacent to a cone opening for the reception of a vertical pneumatic spring, a further post rises out of the base. The control cam is arranged so as to bridge the two posts.

The control cam is provided with a curved contour which has an influence on the movement characteristic of the mechanism. The curved contour of the control cam is selectable according to whether the mechanism is provided for a chair for users of taller than average height and/or heavier than average weight or users of smaller than average height and/or lighter than average weight or to the development of the backrest to be attached.

The front bearing arrangement of the spring system is formed by its upper parts and a bearing block in which the upper parts are supported. The bearing block is mounted in the front region of the shell and has a housing in which the toothed wheel of the force adjuster is mounted. A stop adjuster, which is actuatable from the outside and blocks the mobility of the seat carrier out of the rest position into the relaxation position and consequently also the backrest, is arranged below the bearing block.

The rear connecting means has a reception for the docking of a connection of the backrest. The reception circles the connecting means in a U-shaped manner such that the connection with its cross strut and the two flank struts projecting therefrom are able to be pushed onto the reception from the back.

One connecting piece with a guide extends from the seat carrier on each of the two sides in order to accommodate a complementary molded part of an armrest therein. The seat carrier is a separate component or an integral component part of the base plate of the seat.

There is provided an additional spring system which is supported from above in the rear region of the shell by way of a lower part and from below in the rear region of the seat carrier by way of an upper part.

BRIEF DESCRIPTION OF THE ACCOMPANYING DRAWINGS

Figure 1A:
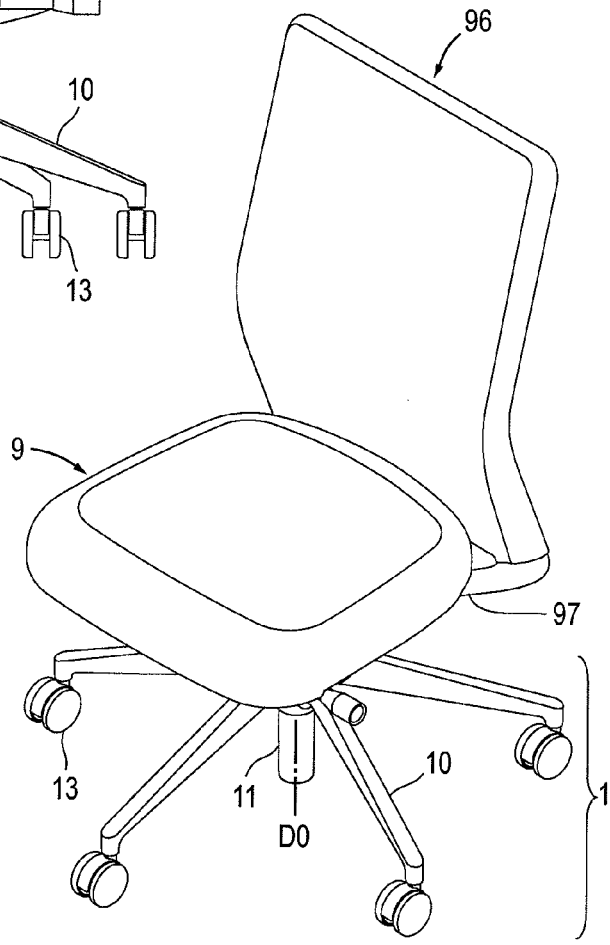
Figure 1E:
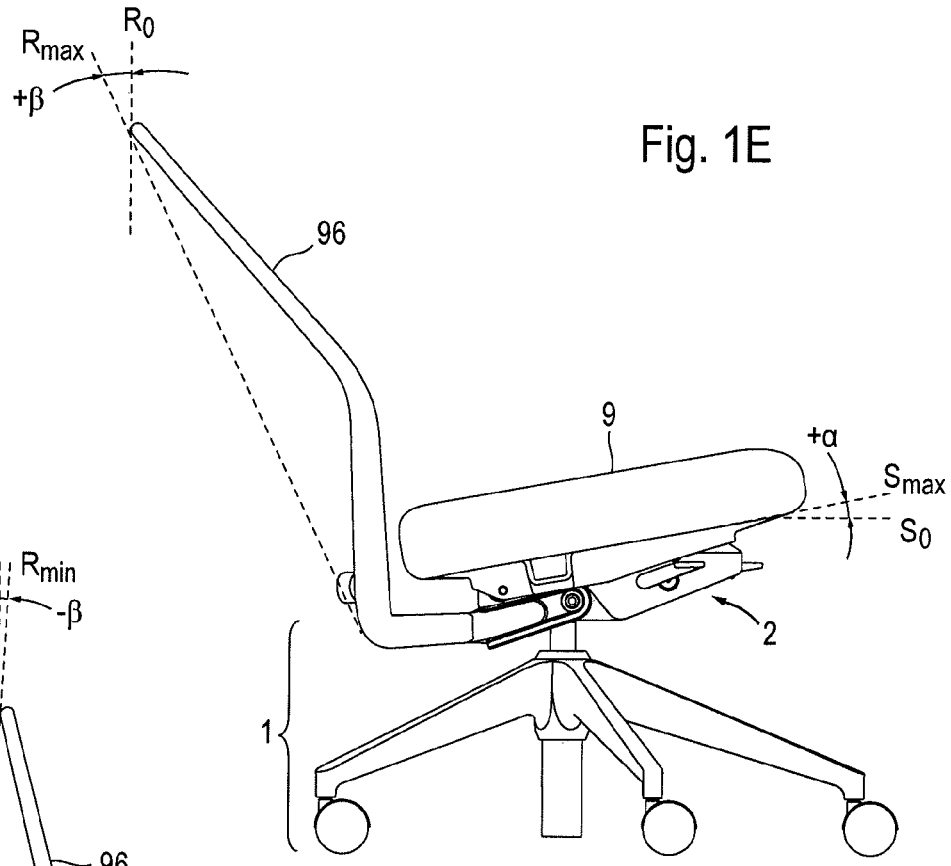
Figure 1F:
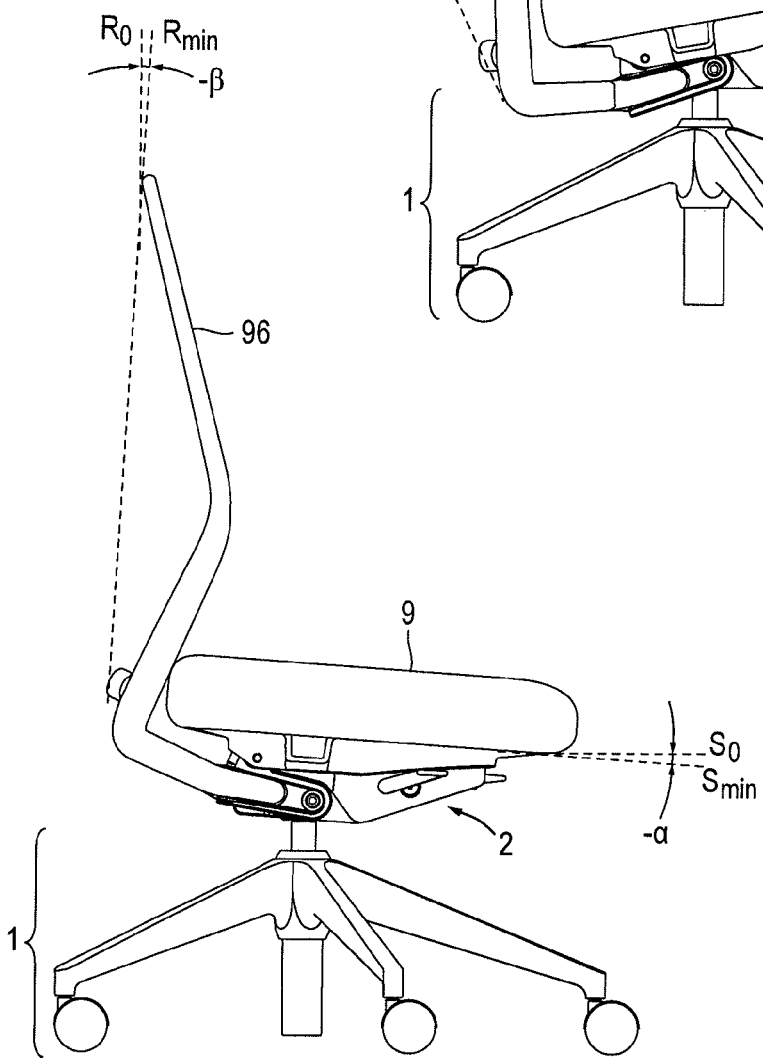
Figure 2A:
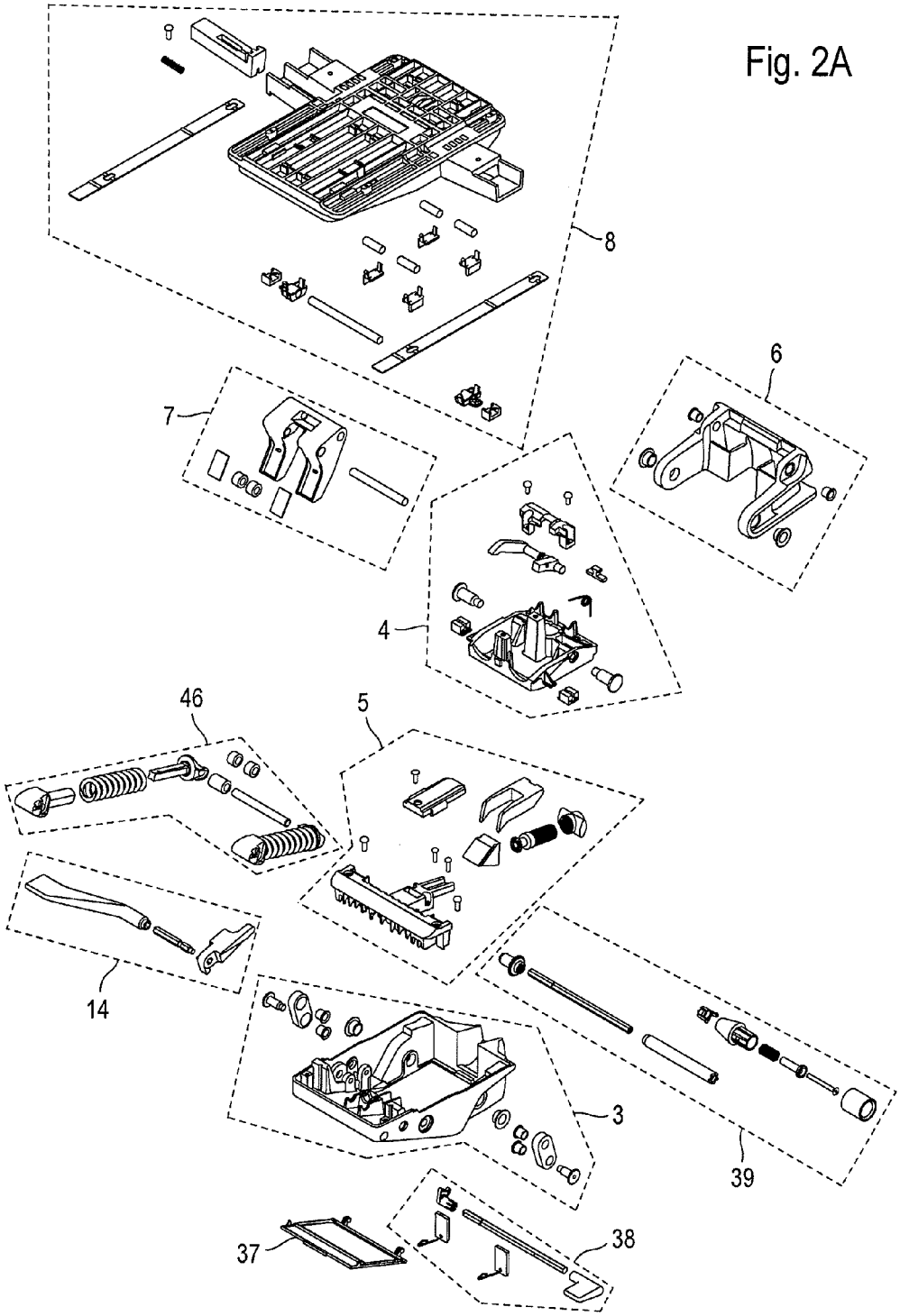
Figure 2B:
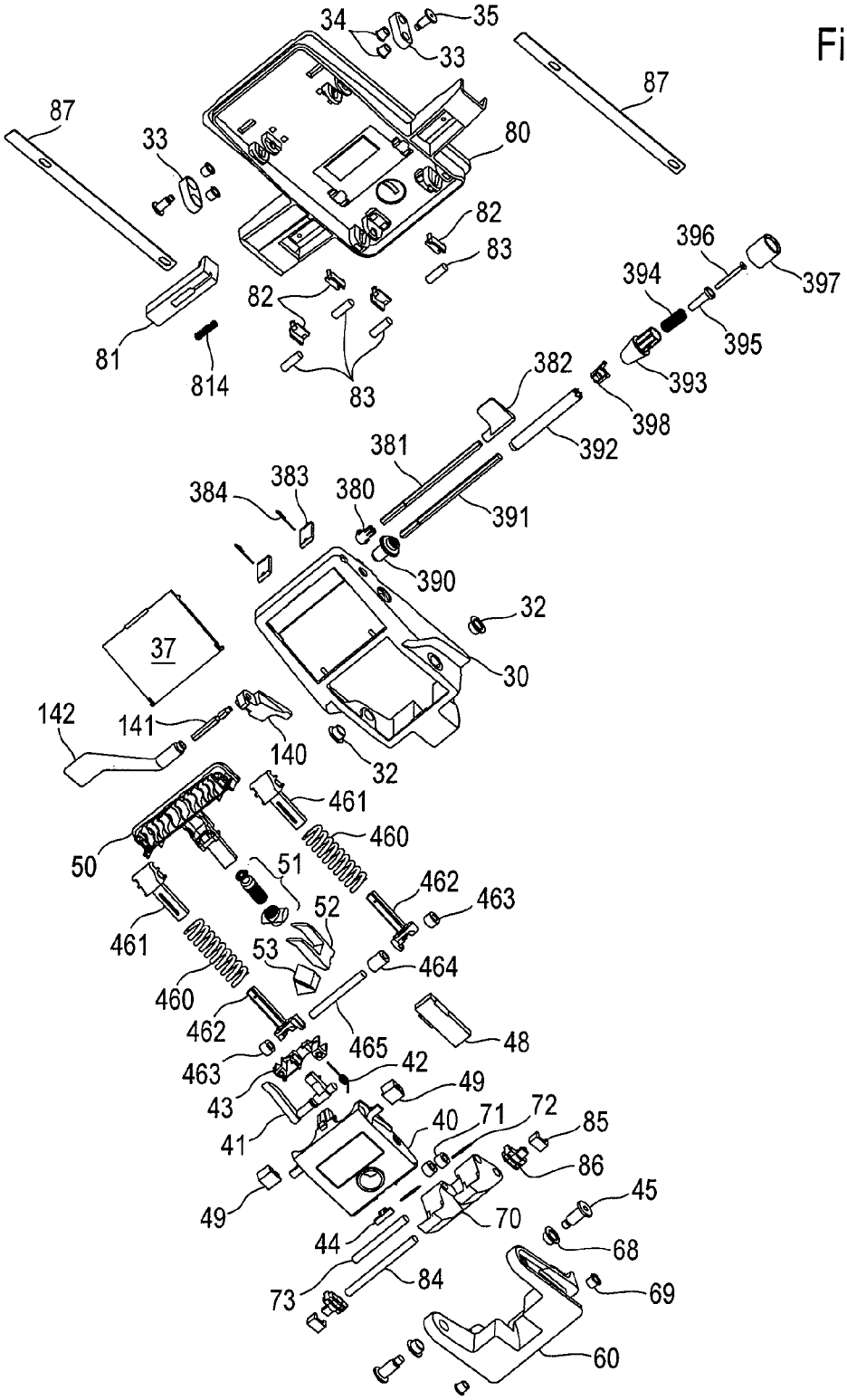
Figure 5A:
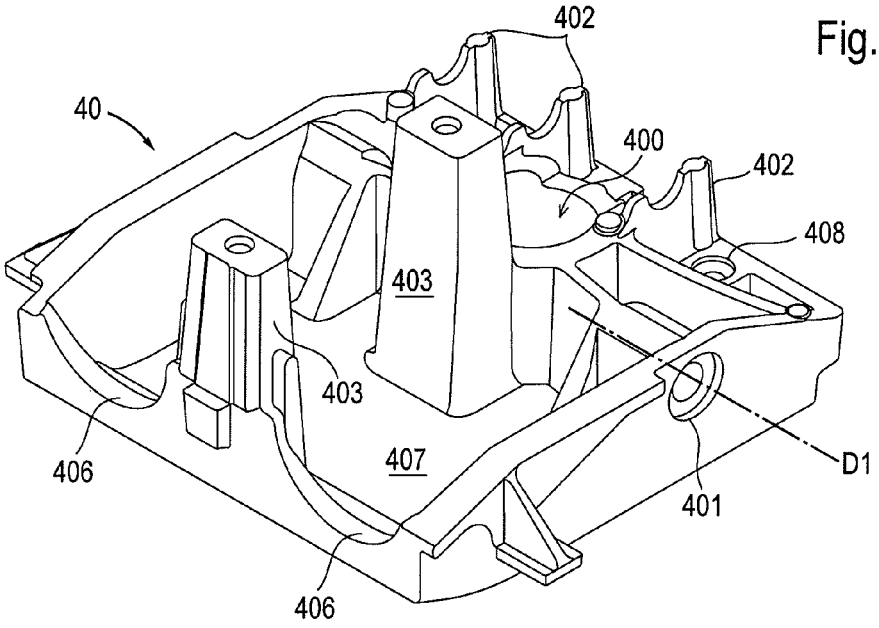
Figure 5B:
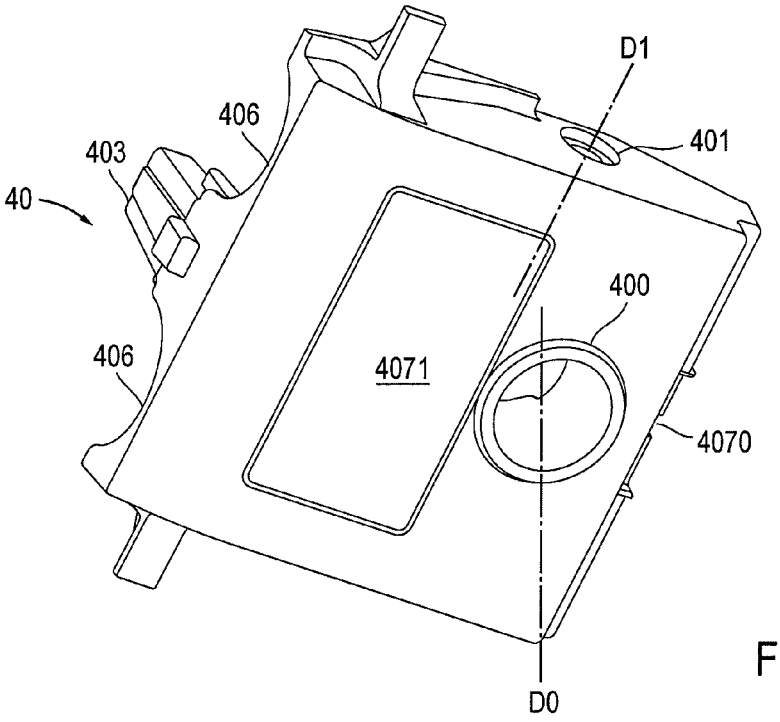
Figure 7A:
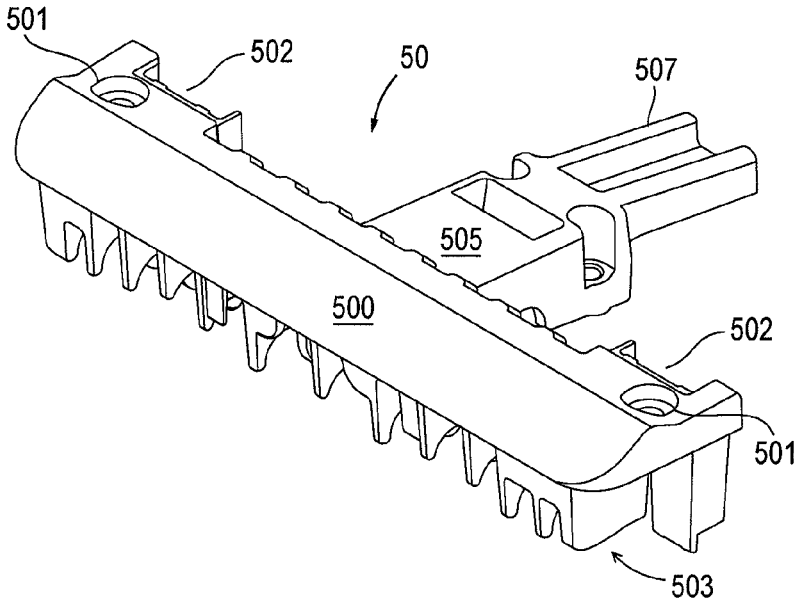
Figure 7B:
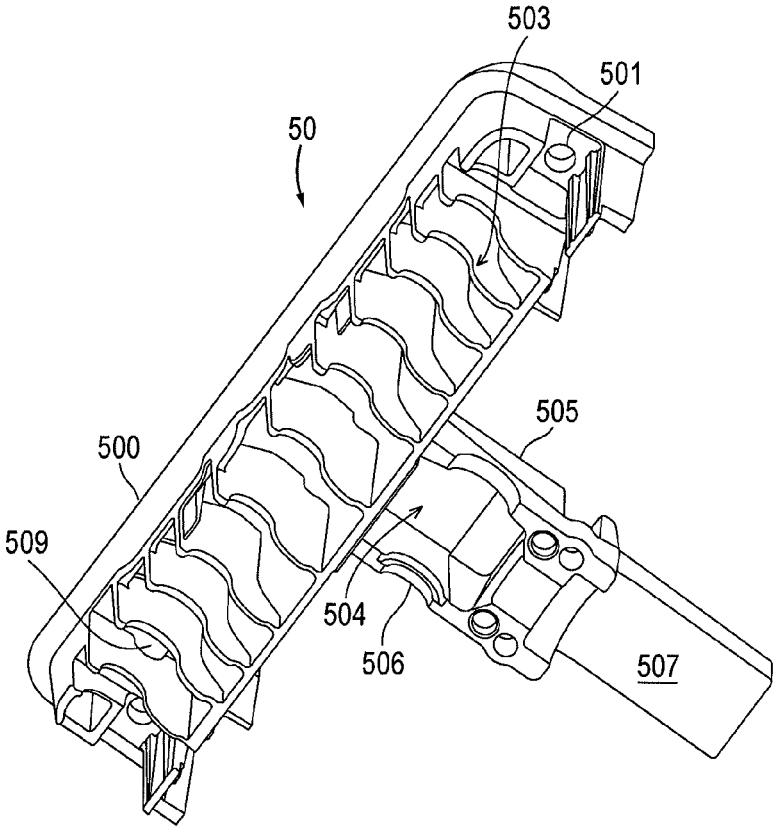
Figure 7C:
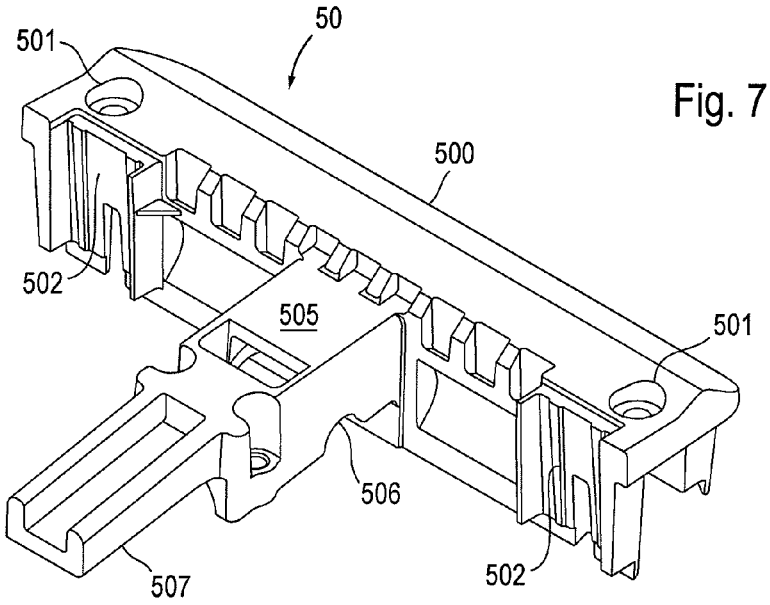
Figure 8A:
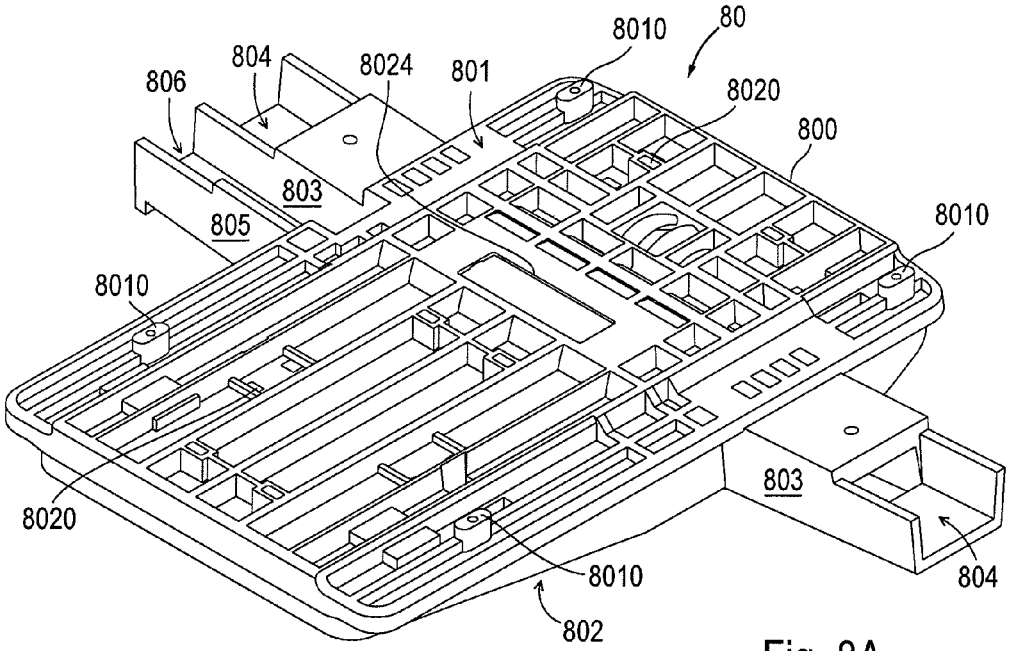
Figure 8C:
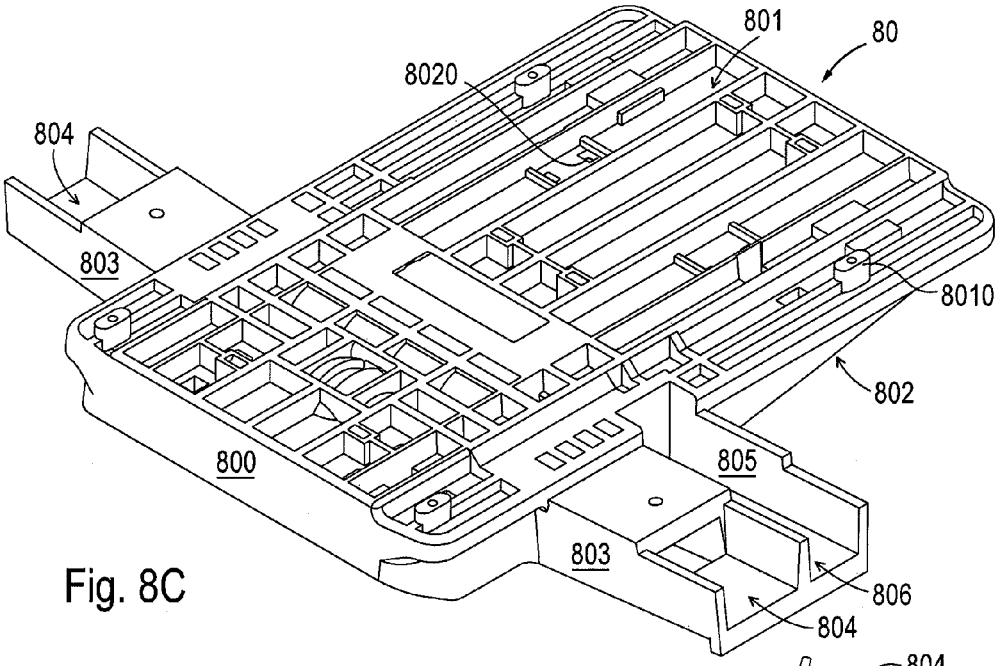
Figure 8B:
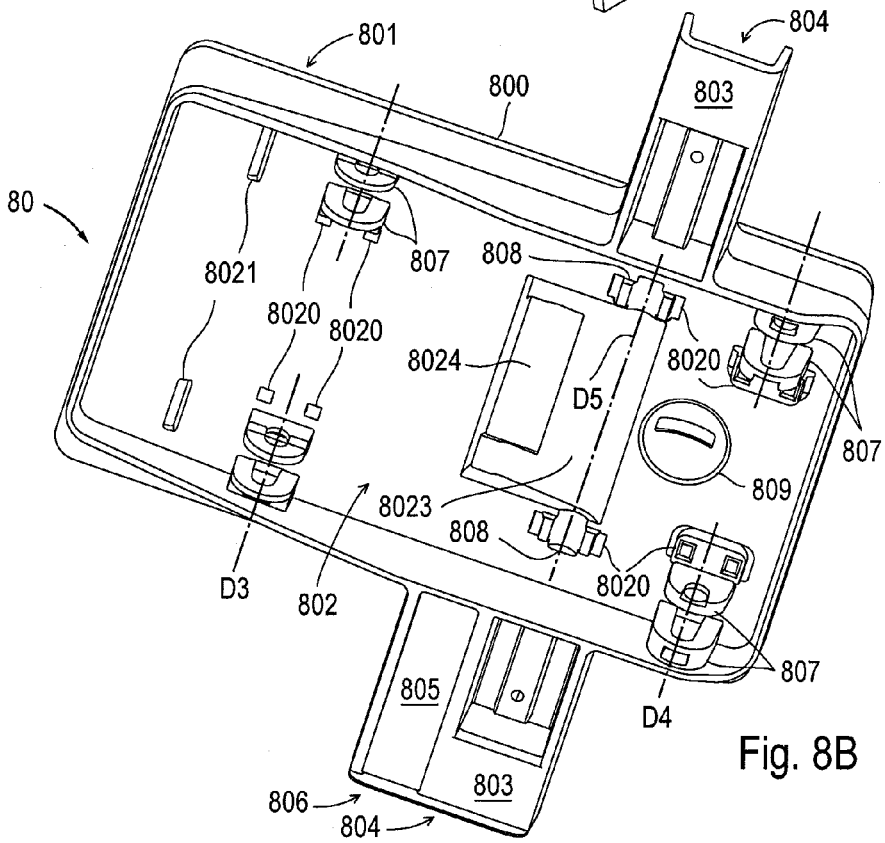
Figure 9A:
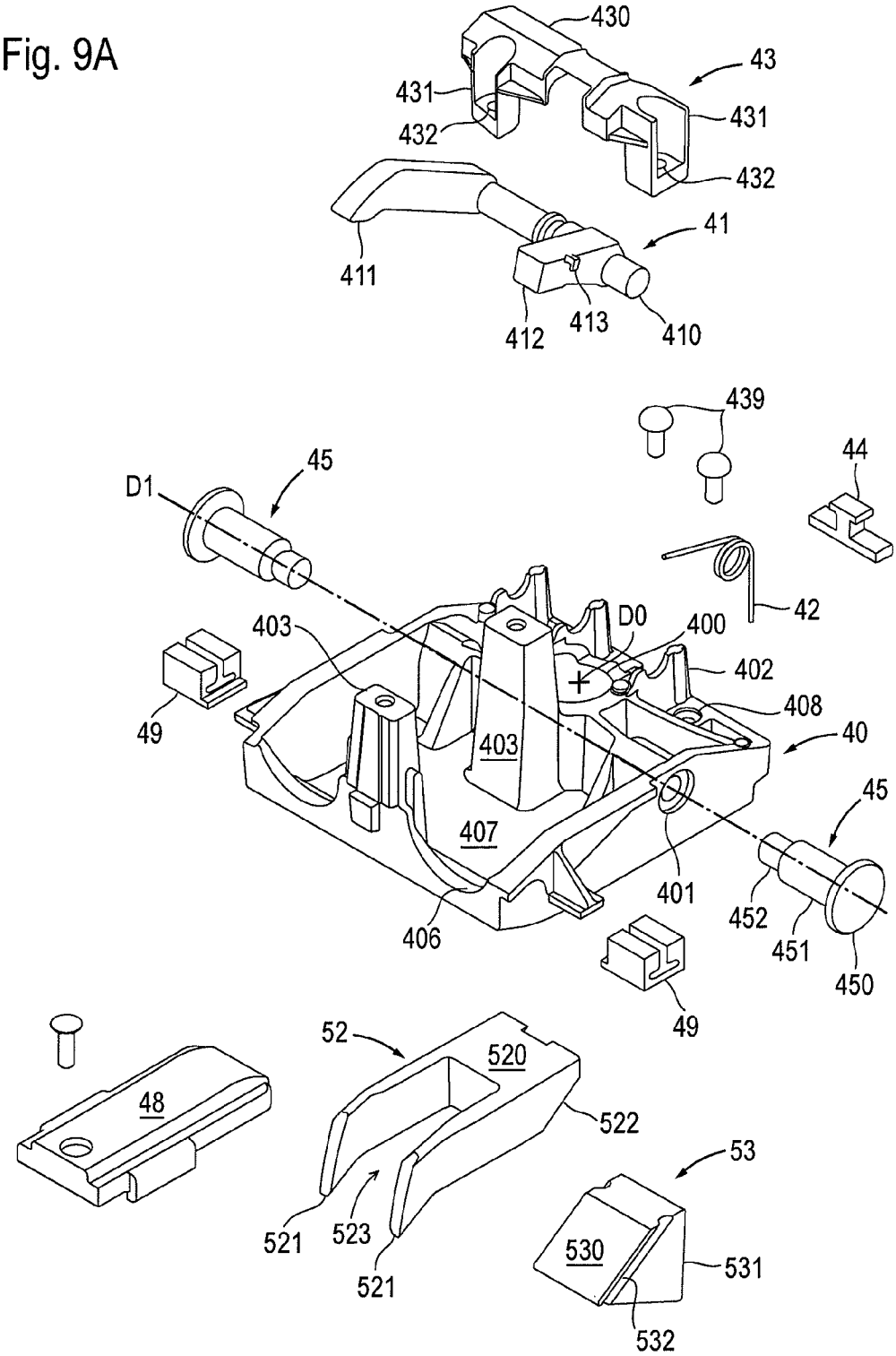
Figure 9B:
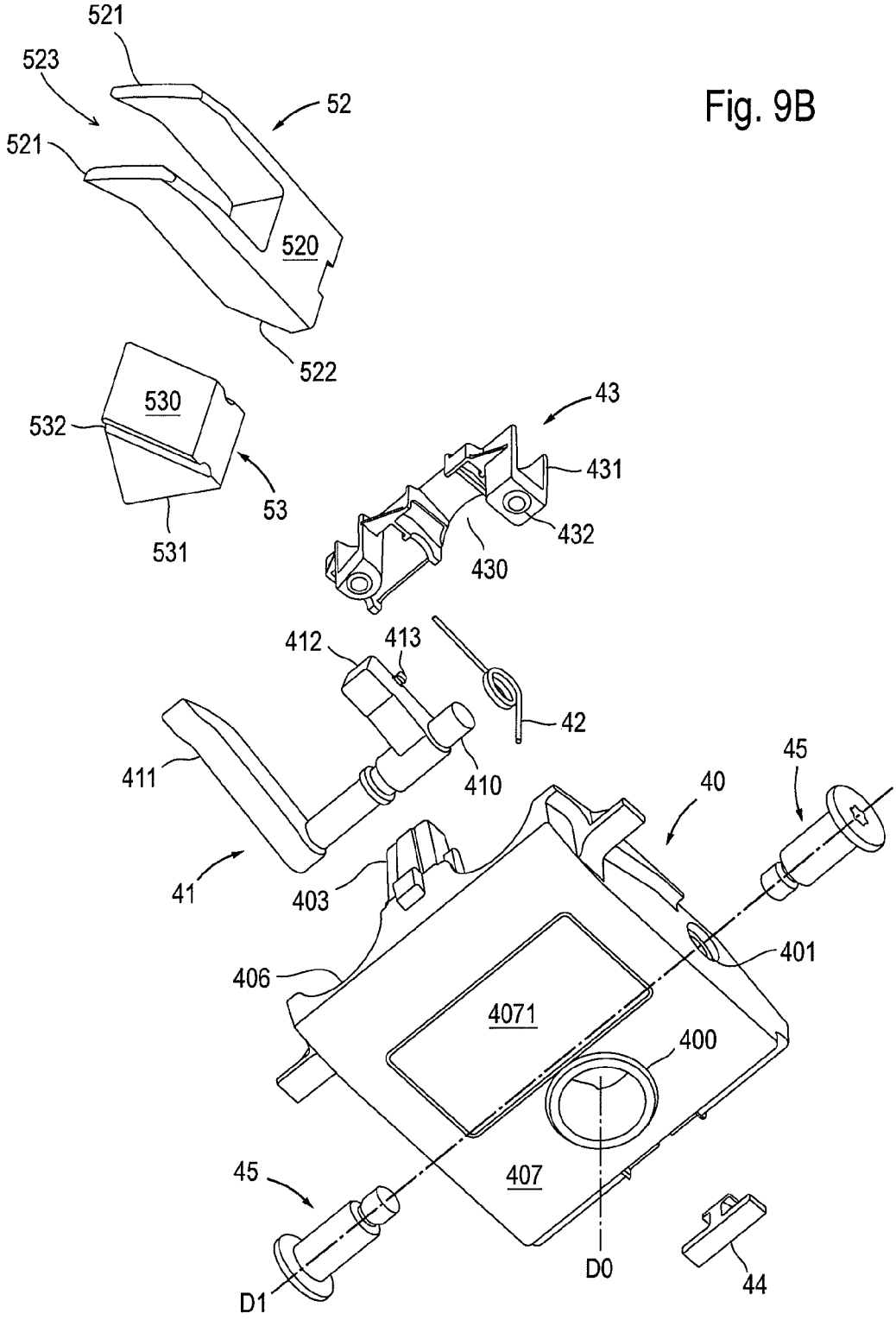
Figure 9C:
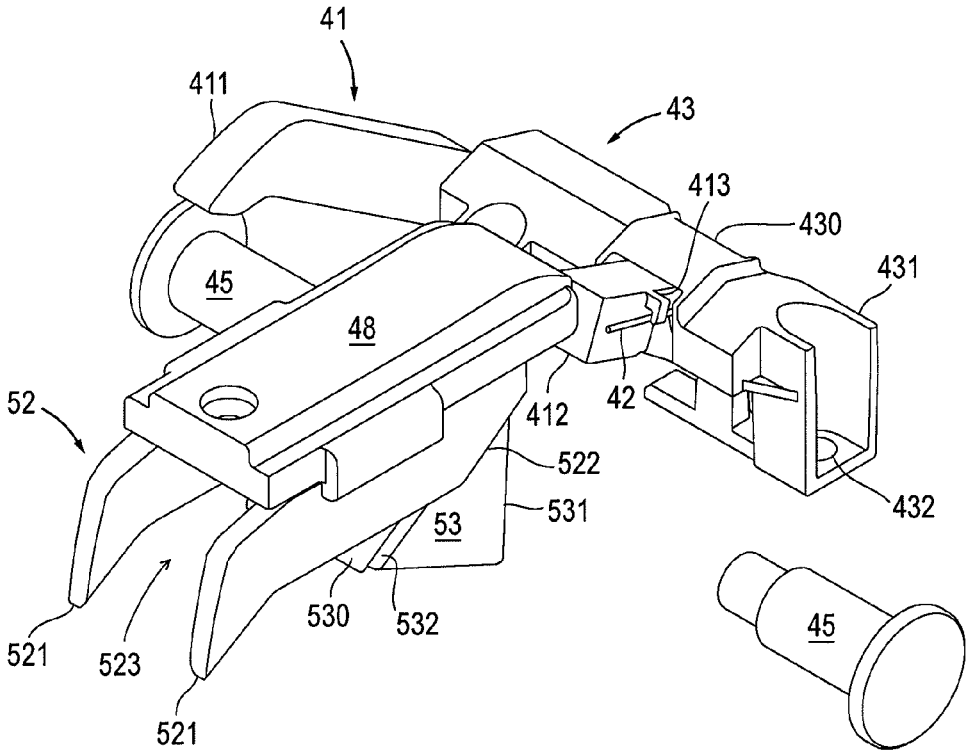
Figure 9D:
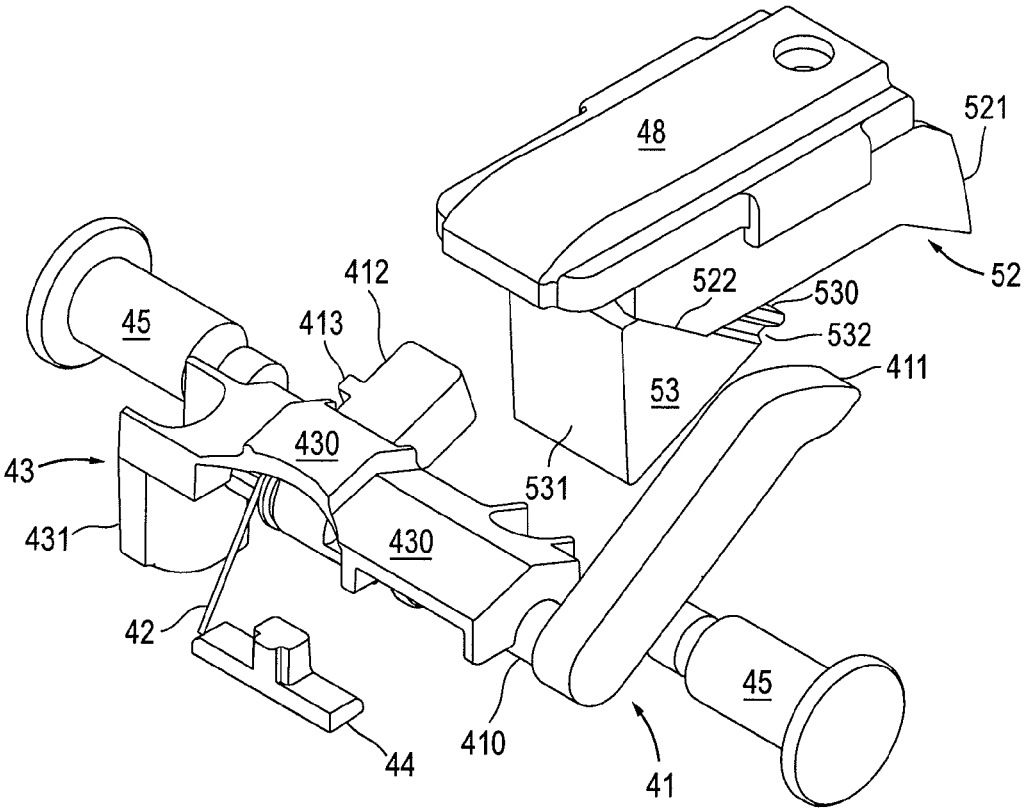
Figure 9G:
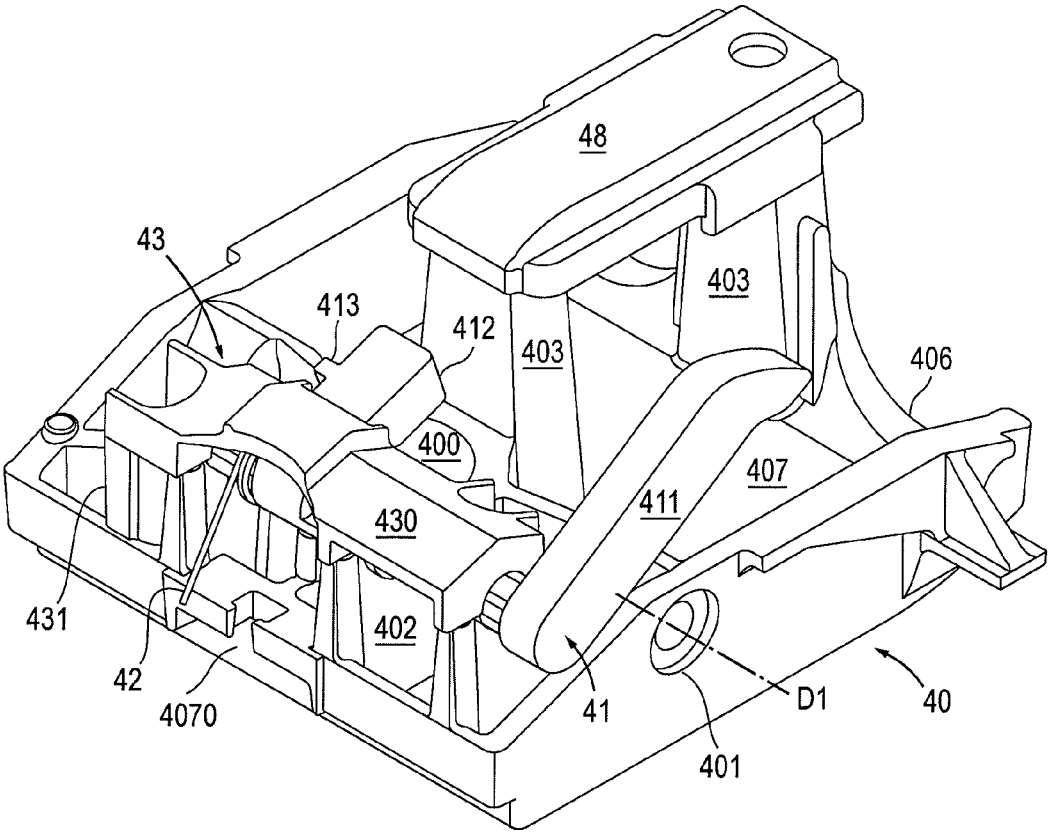
Figure 9H:
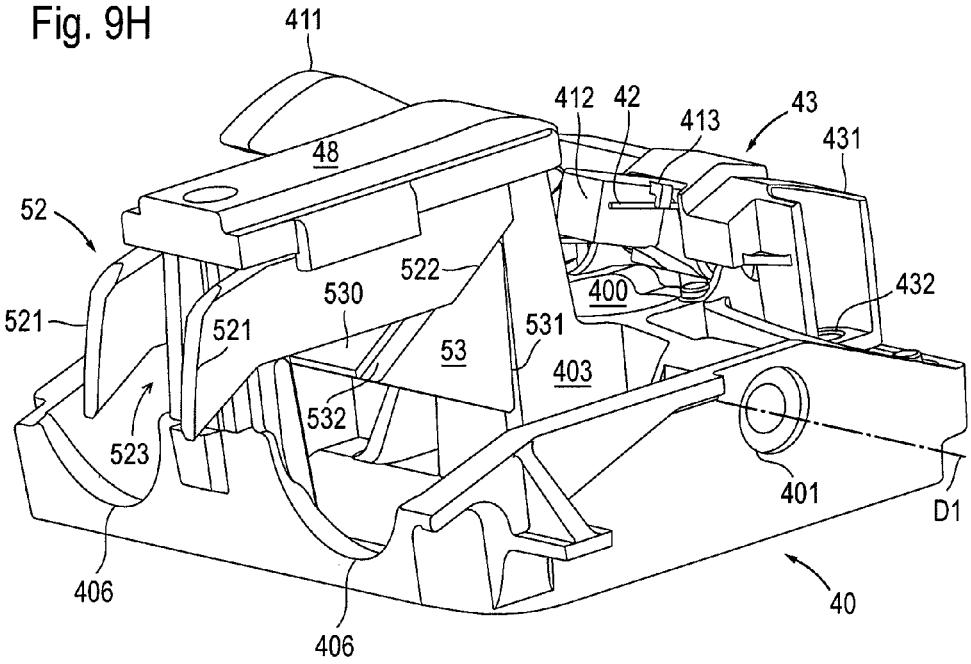
Figure 9J:
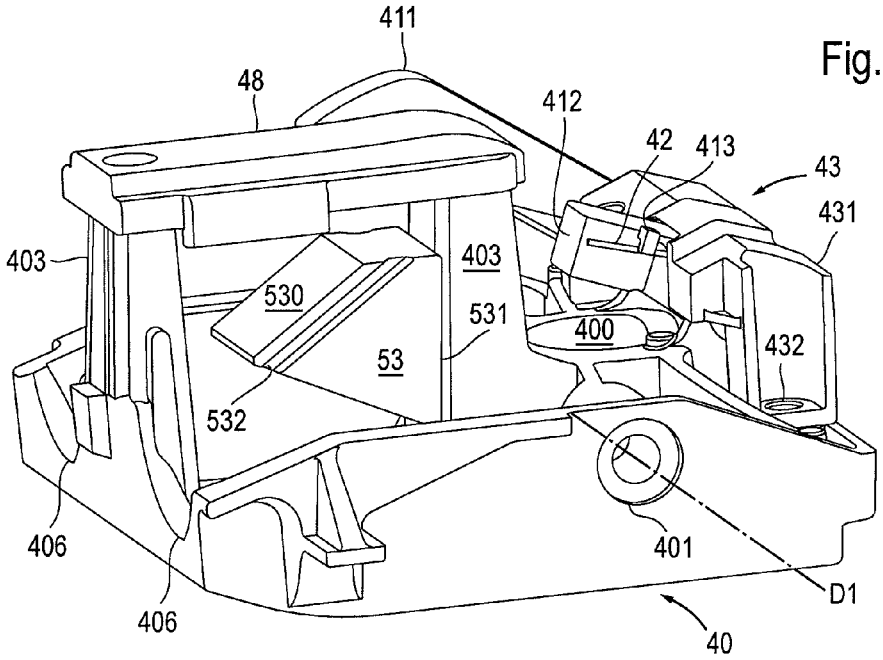
Figure 9K:
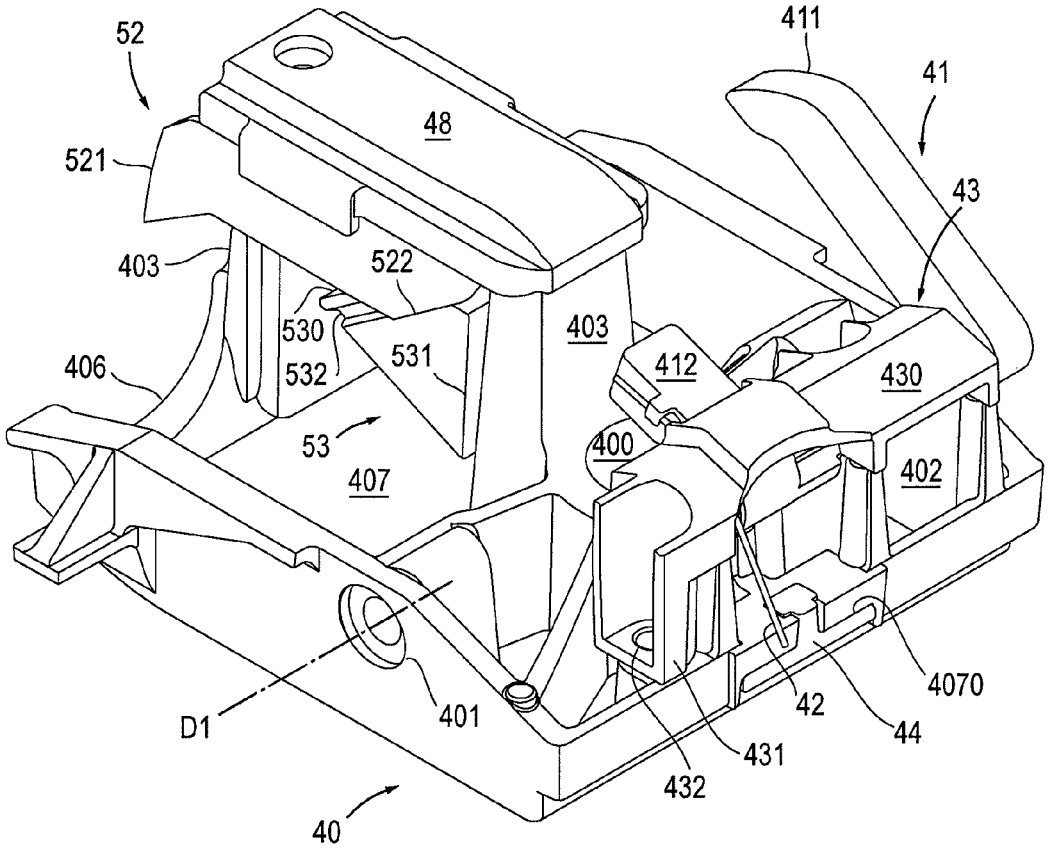
Figure 9L:
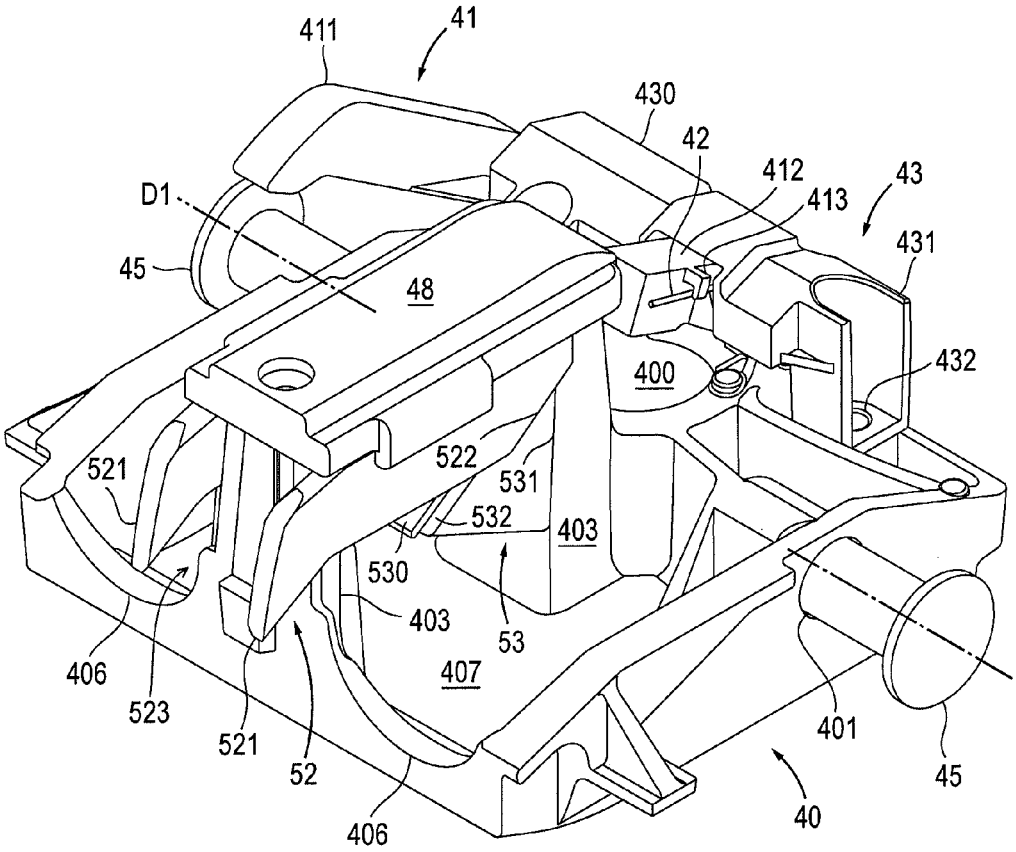
Figure 9M:
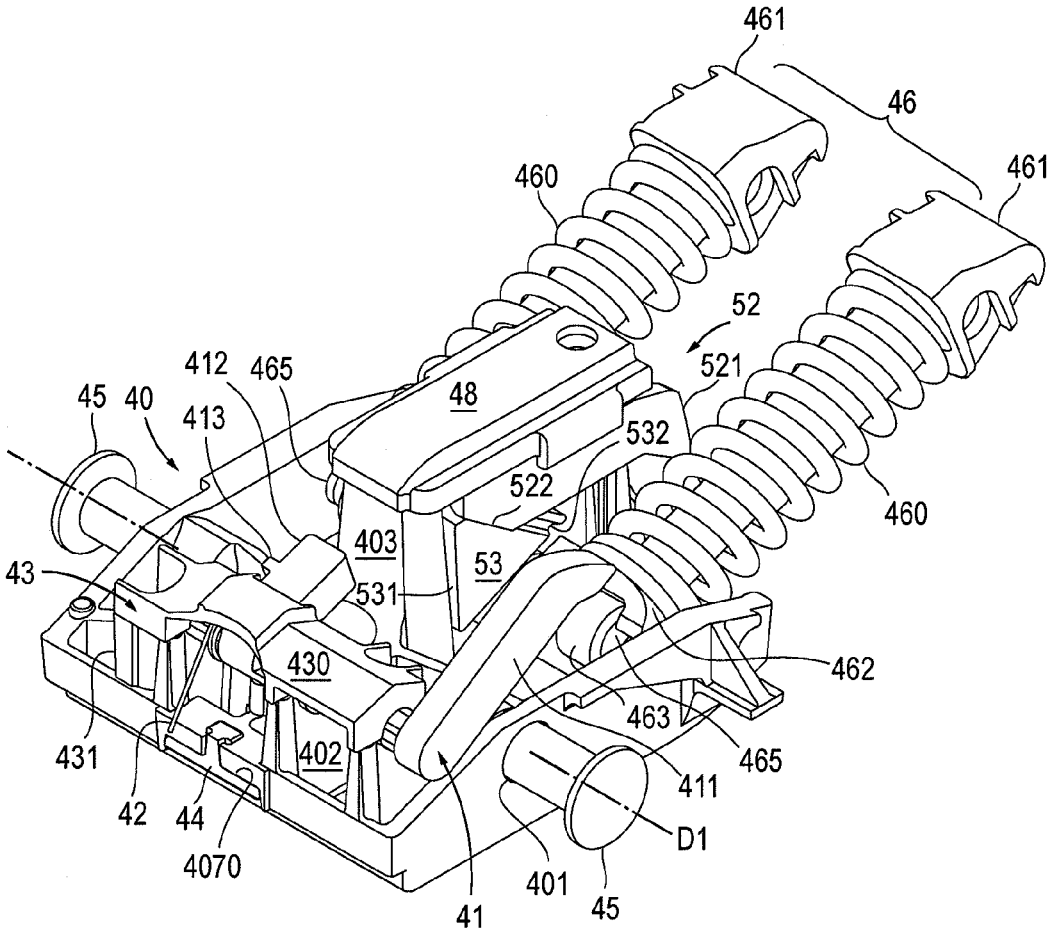
Figure 10A:
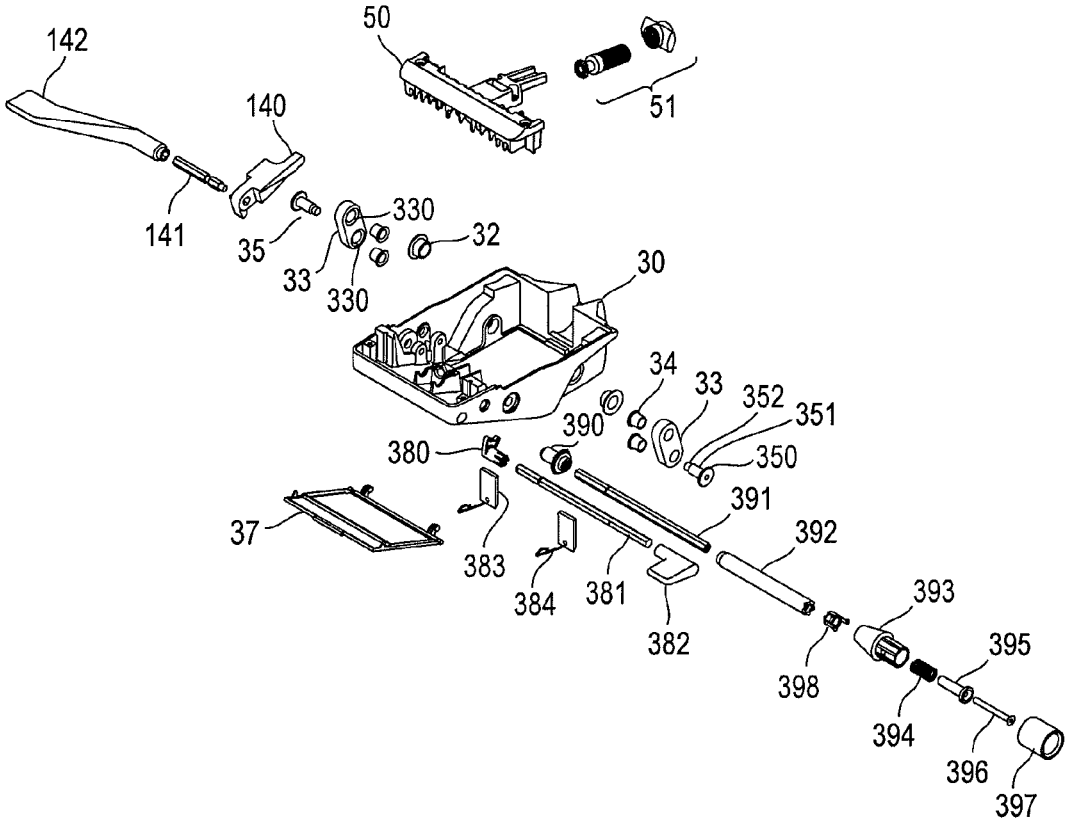
Figure 10B:
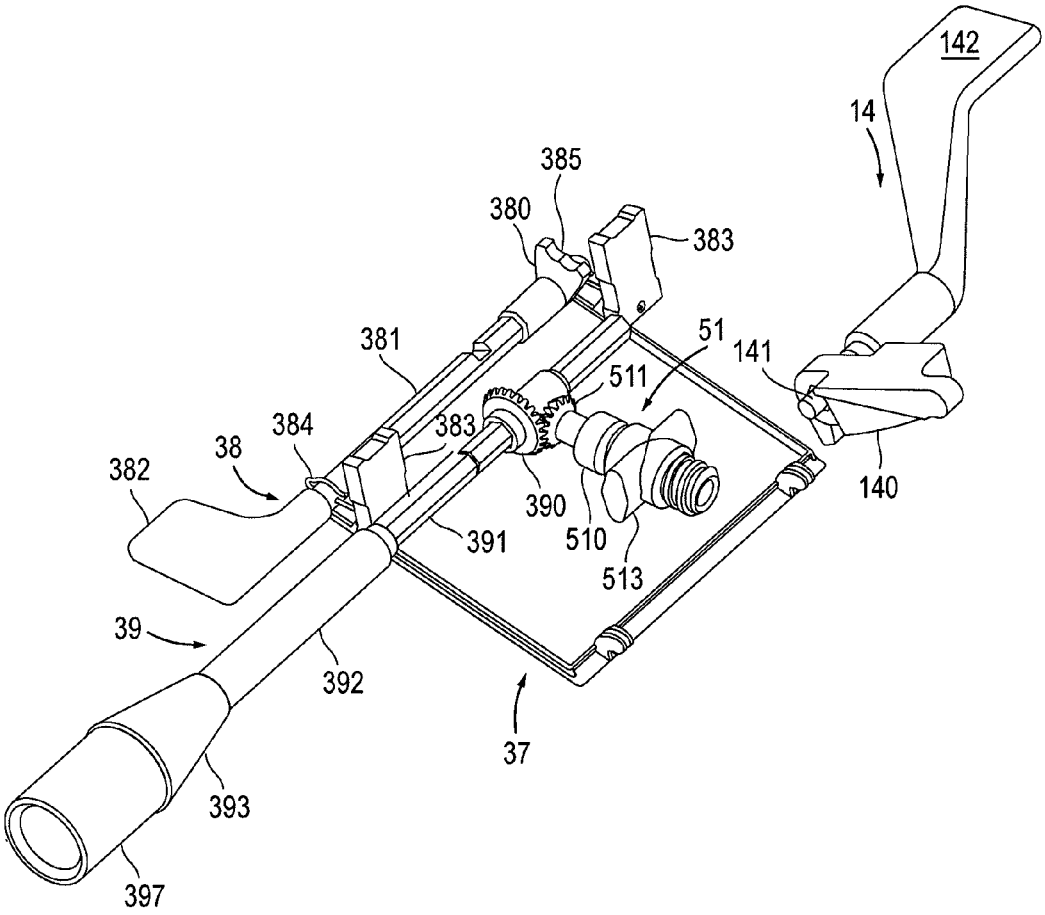
Figure 10C:
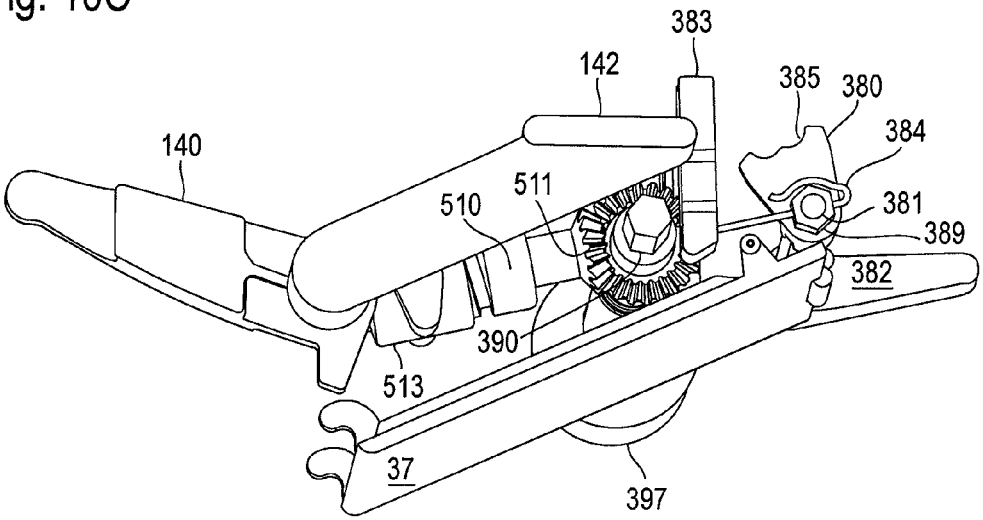
Figure 10D:
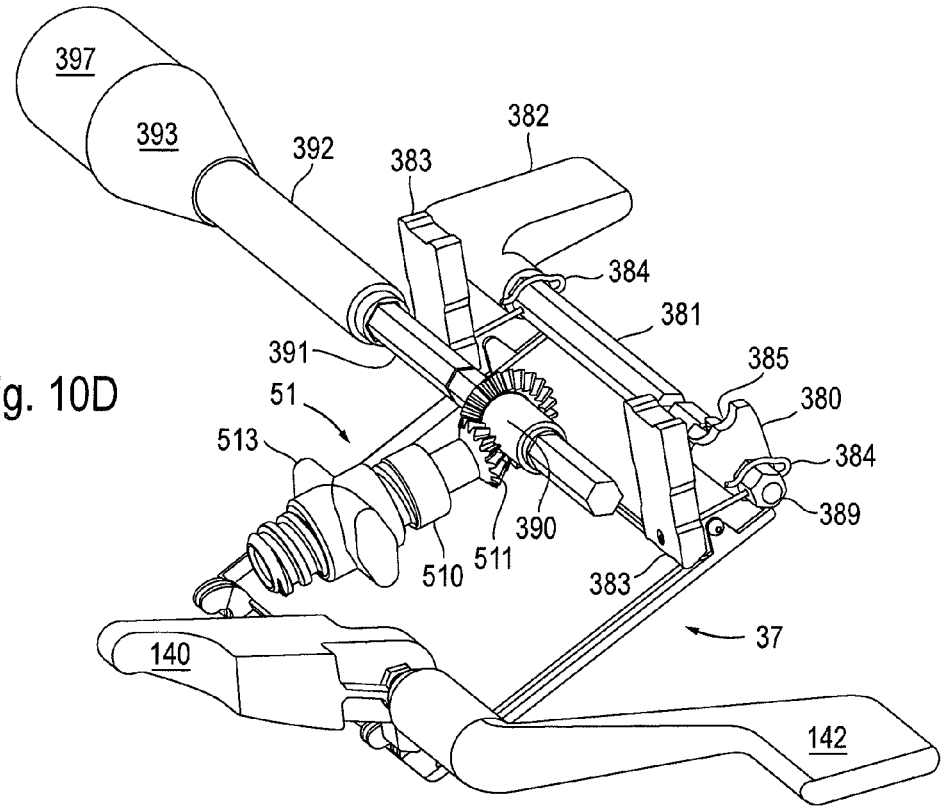
Figure 10E:
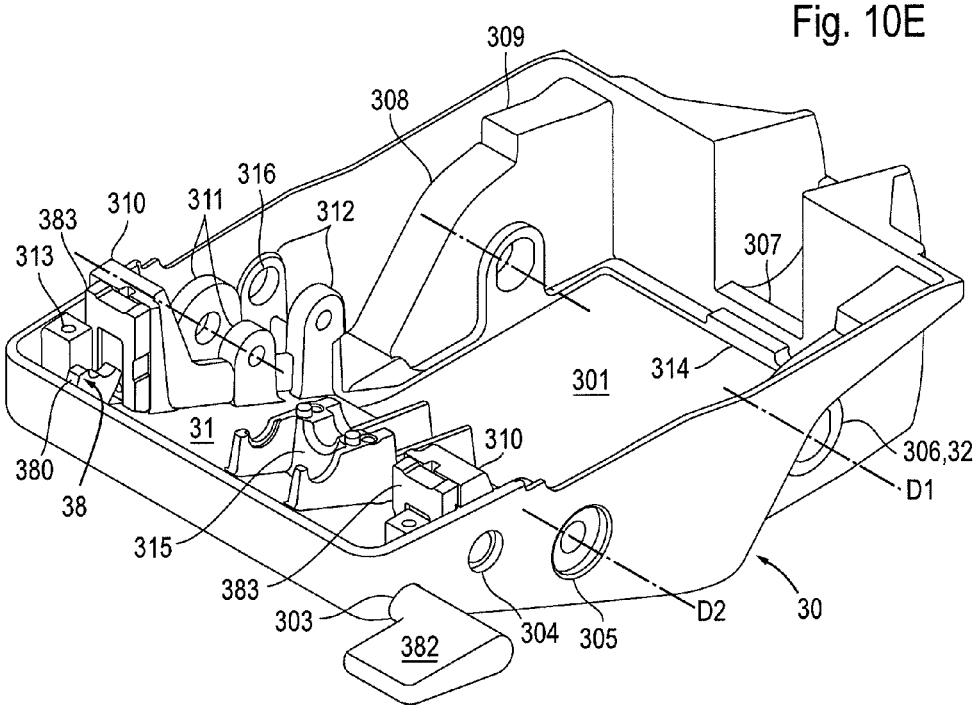
Figure 10F:
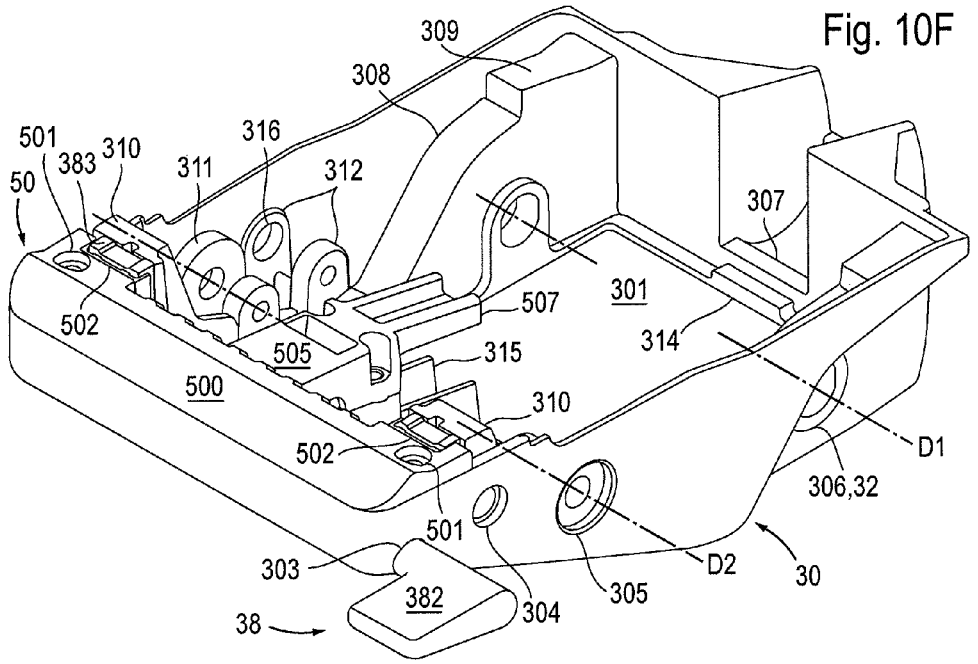
Figure 10G:
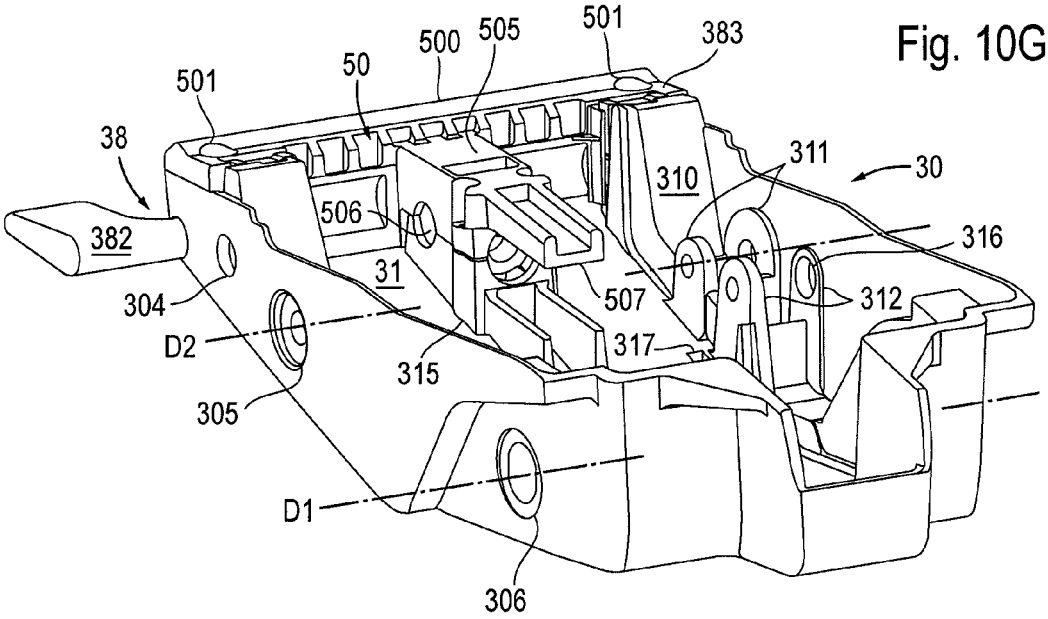
Figure 10J:
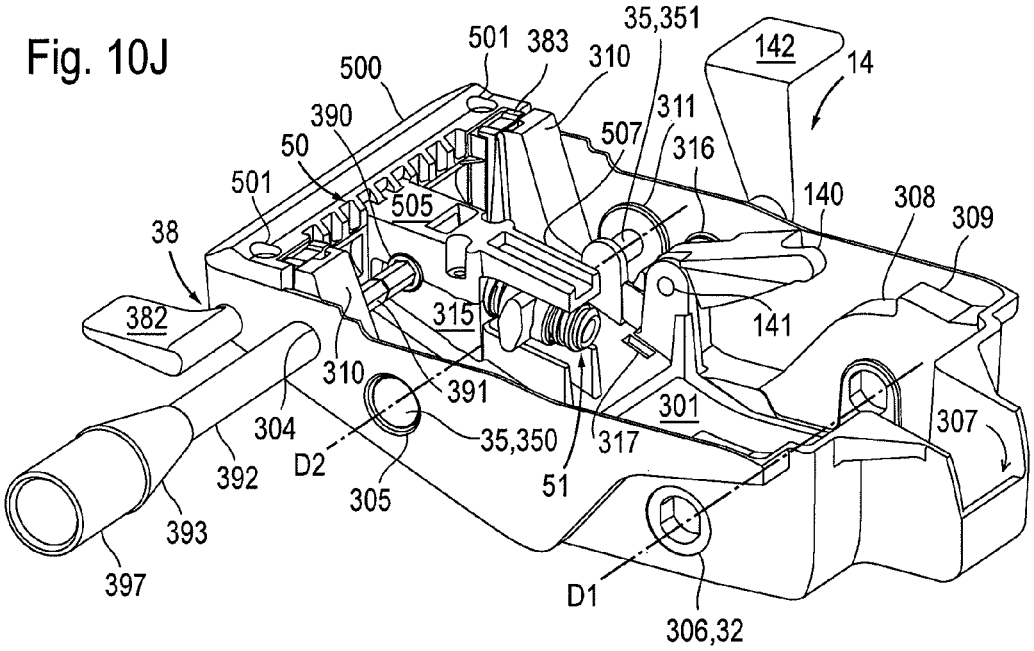
Figure 10H:
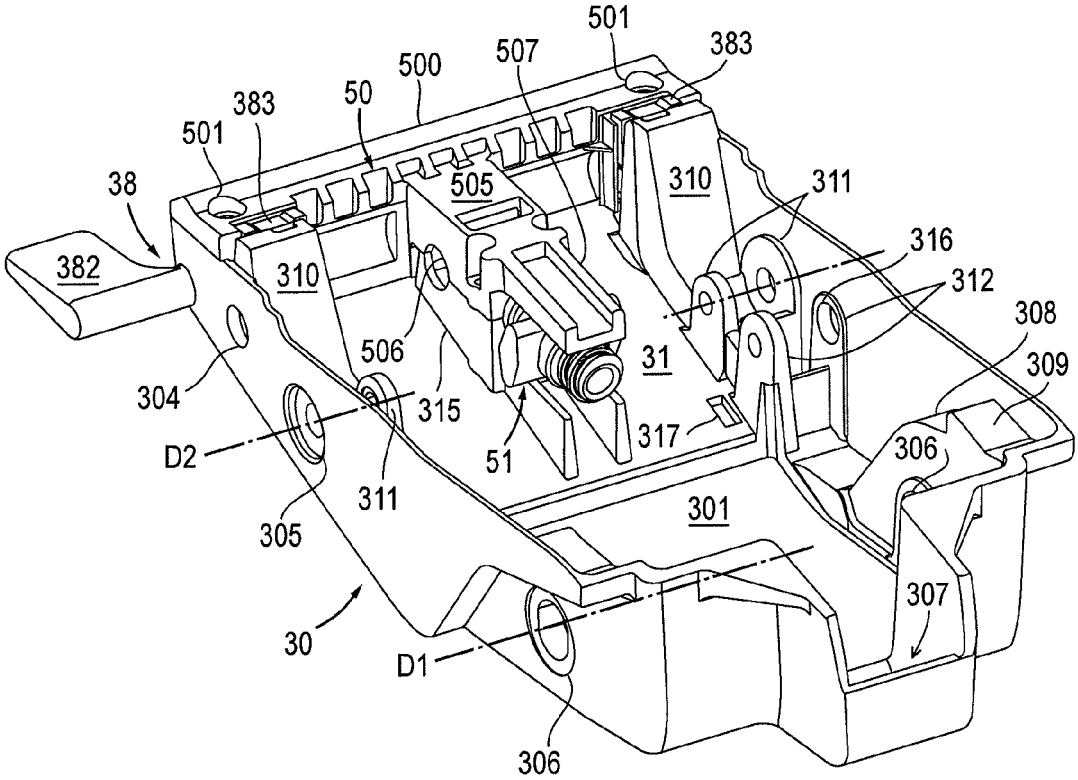
Figure 10K:
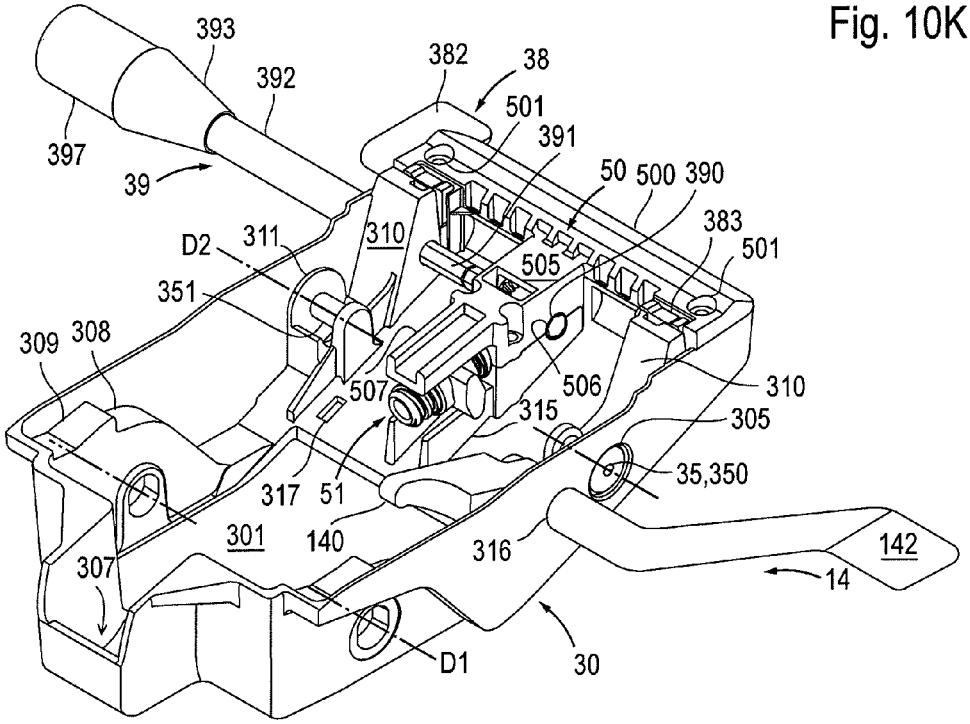
Figure 10L:
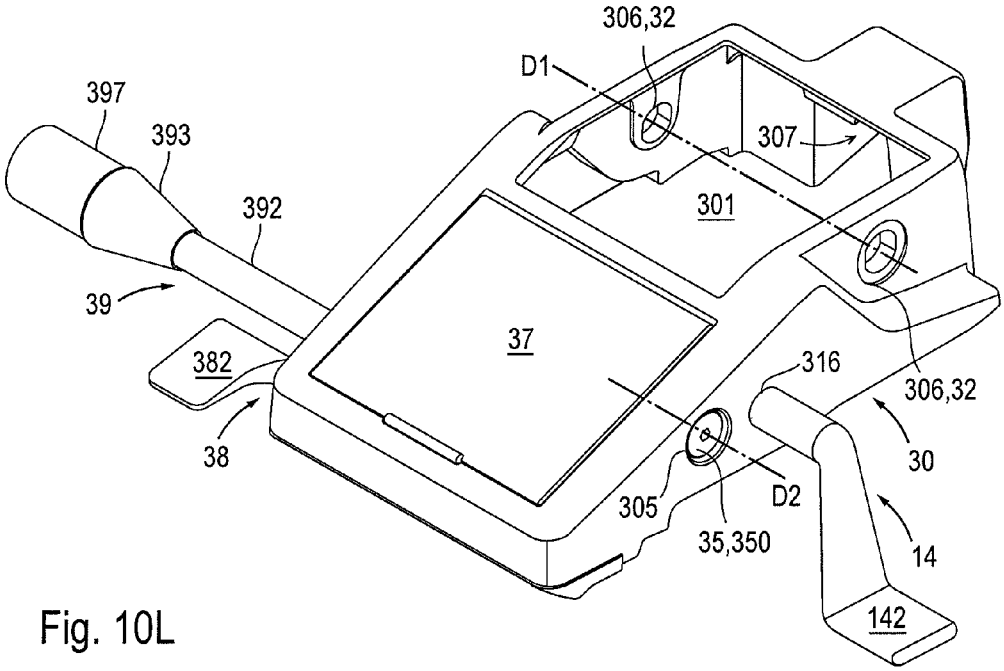
Figure 11A:
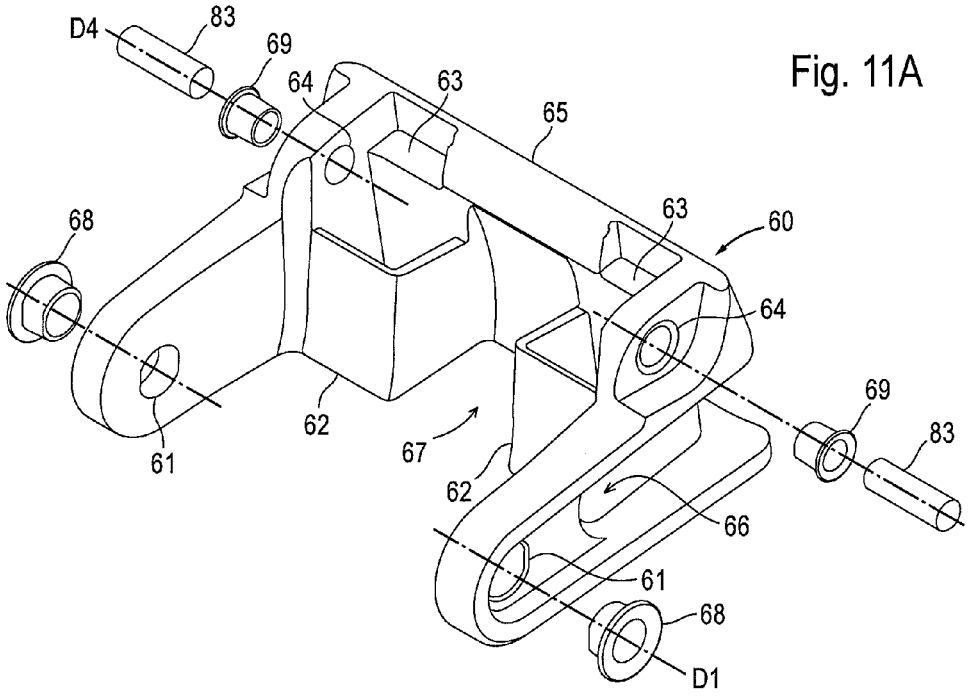
Figure 11B:
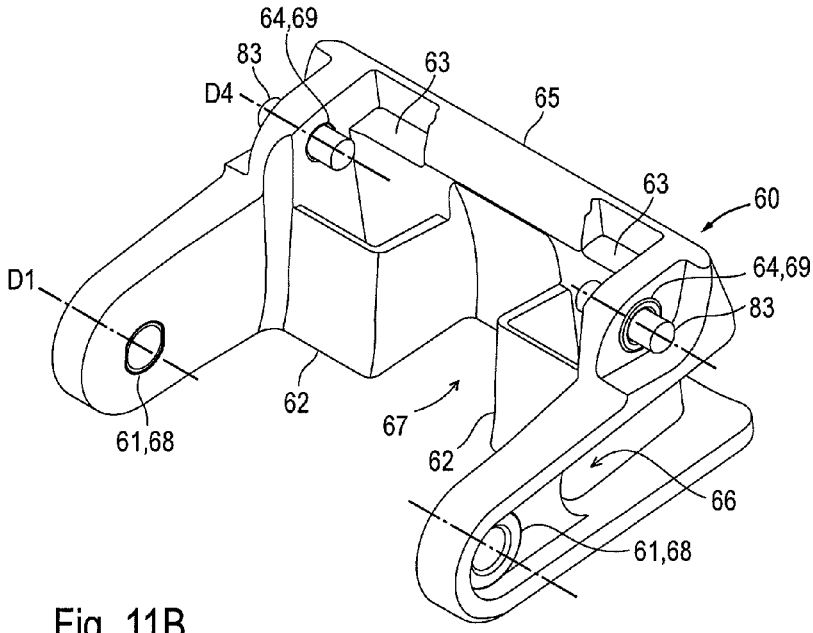
Figure 12:
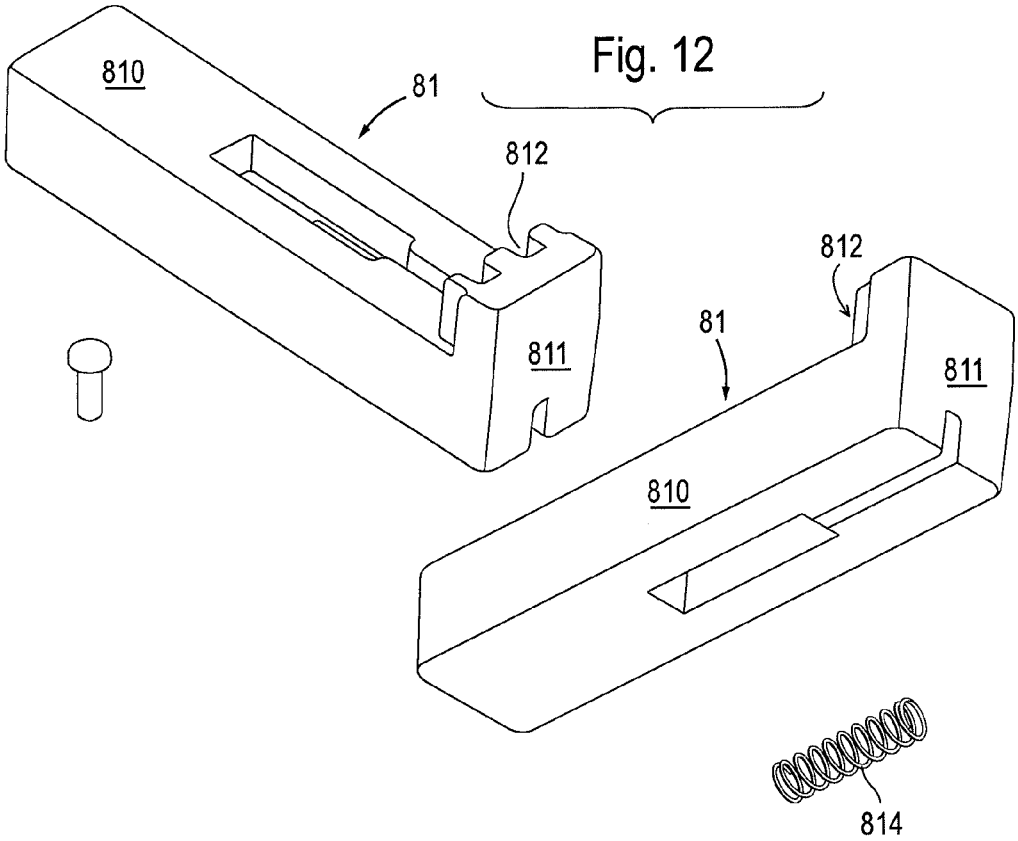
Figure 13:
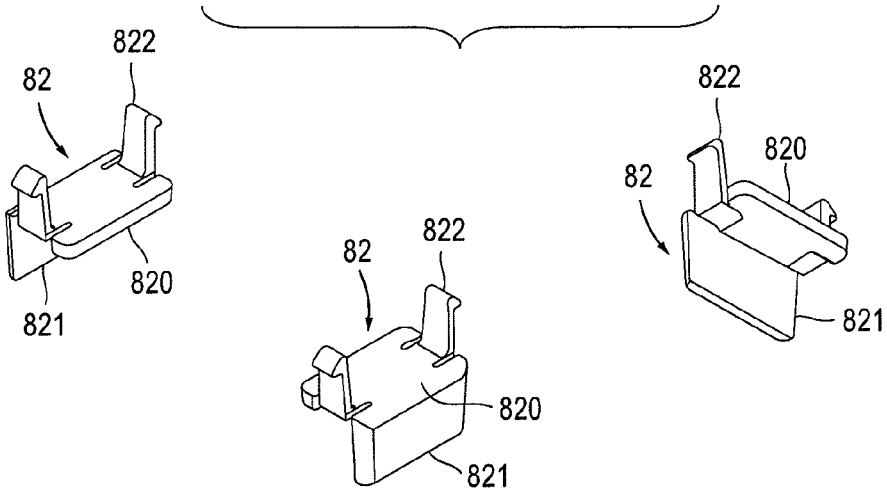
Figure 17E:
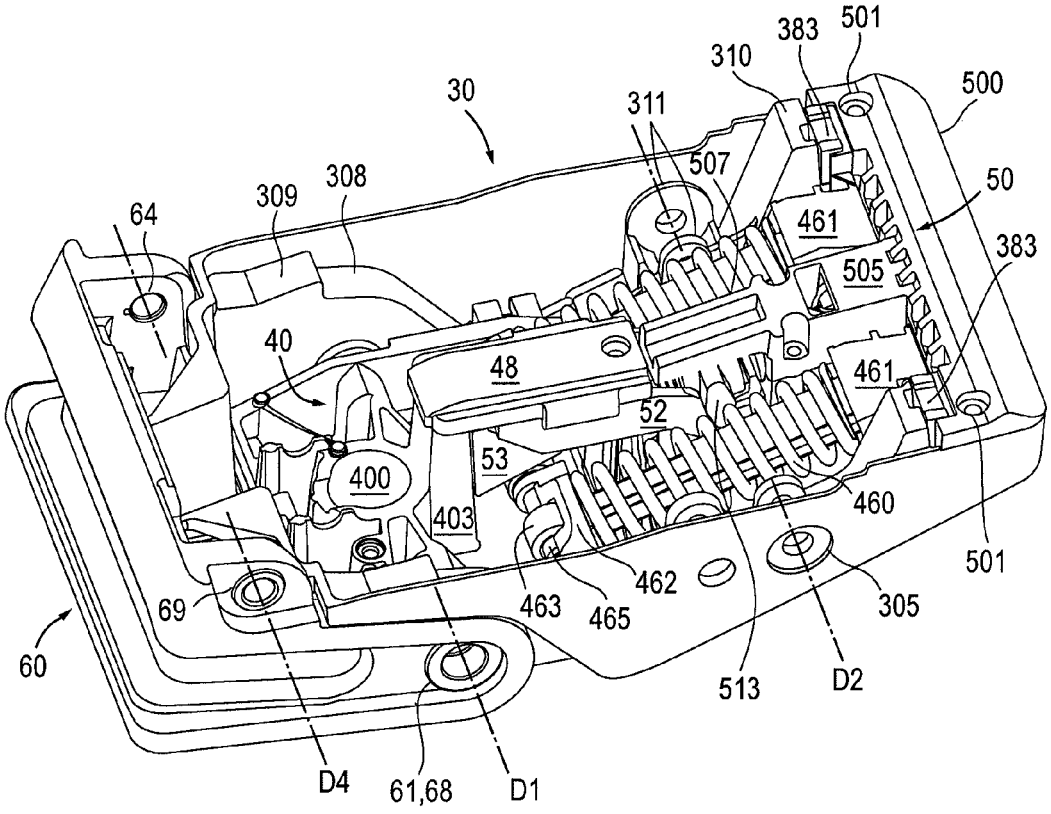
Figure 17F:
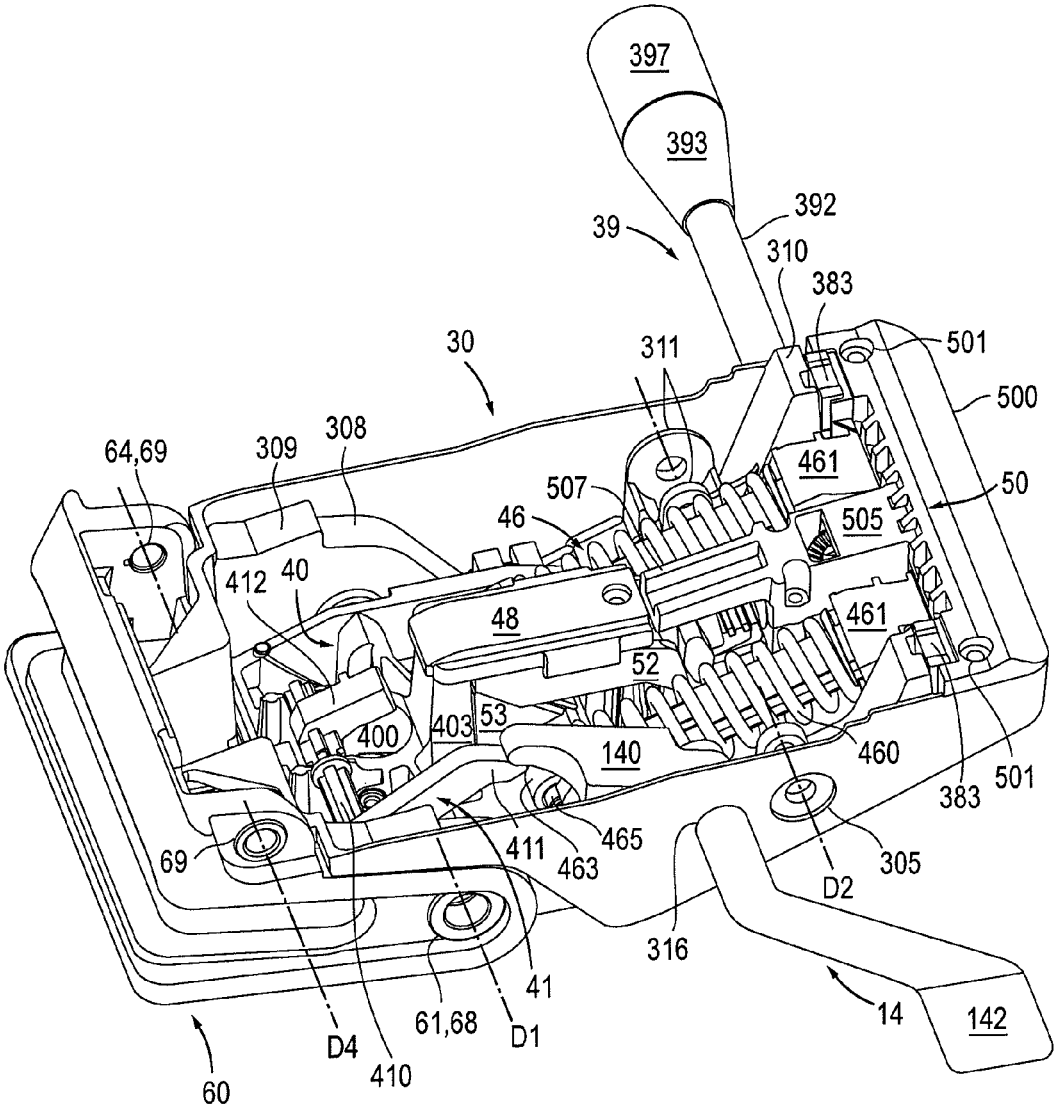
Figure 17G:
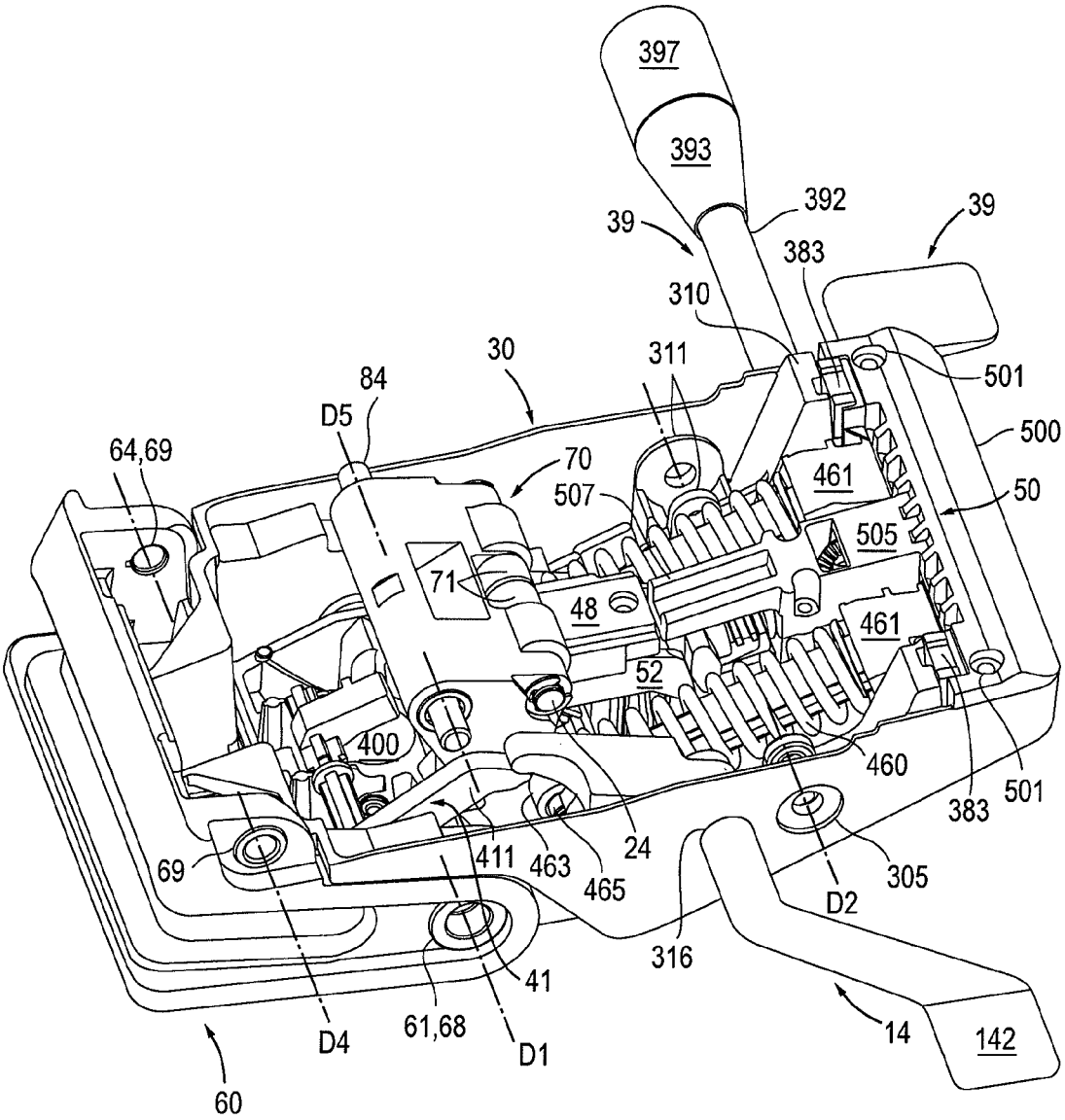
Figure 18A:
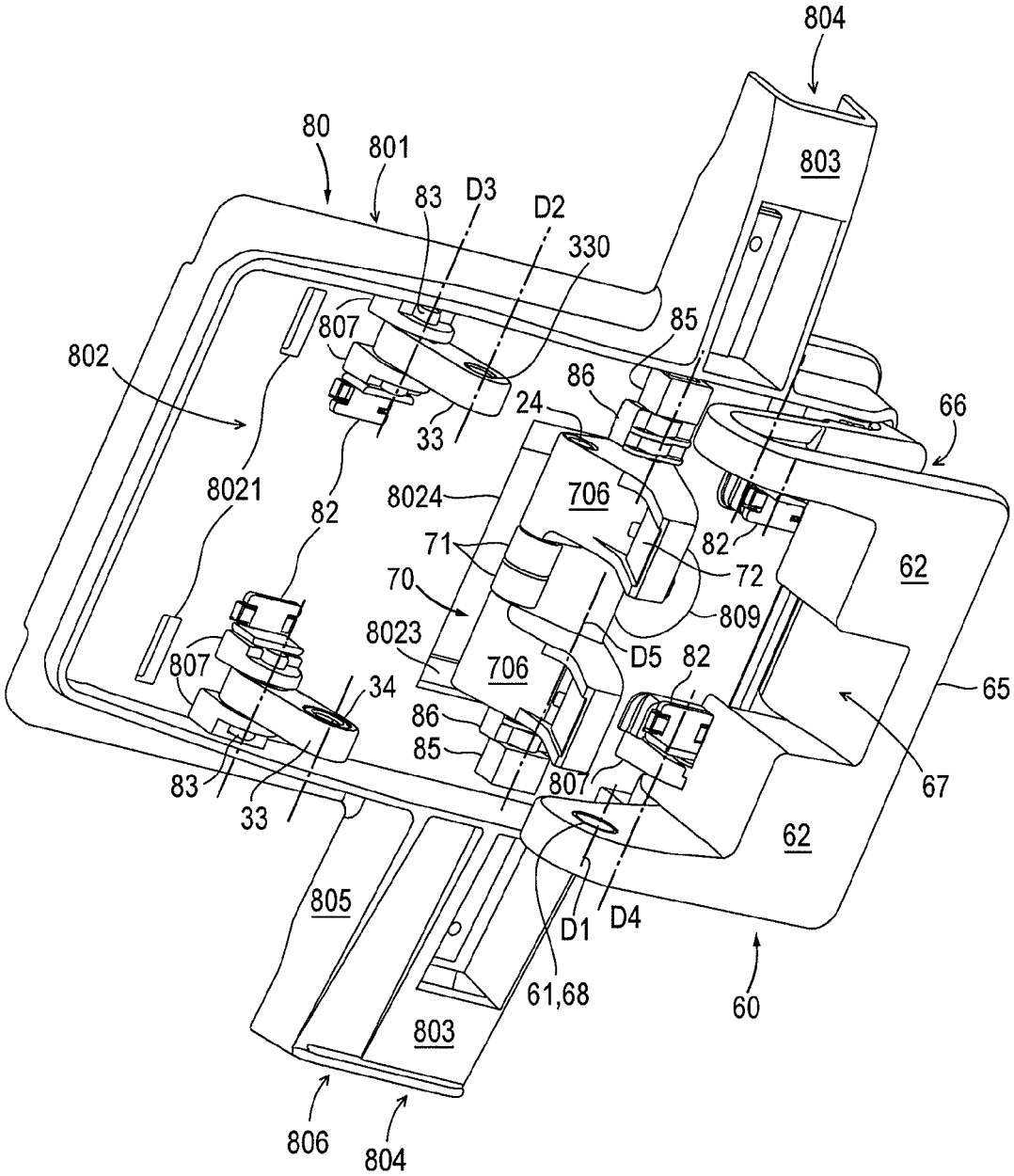
Figure 18B:
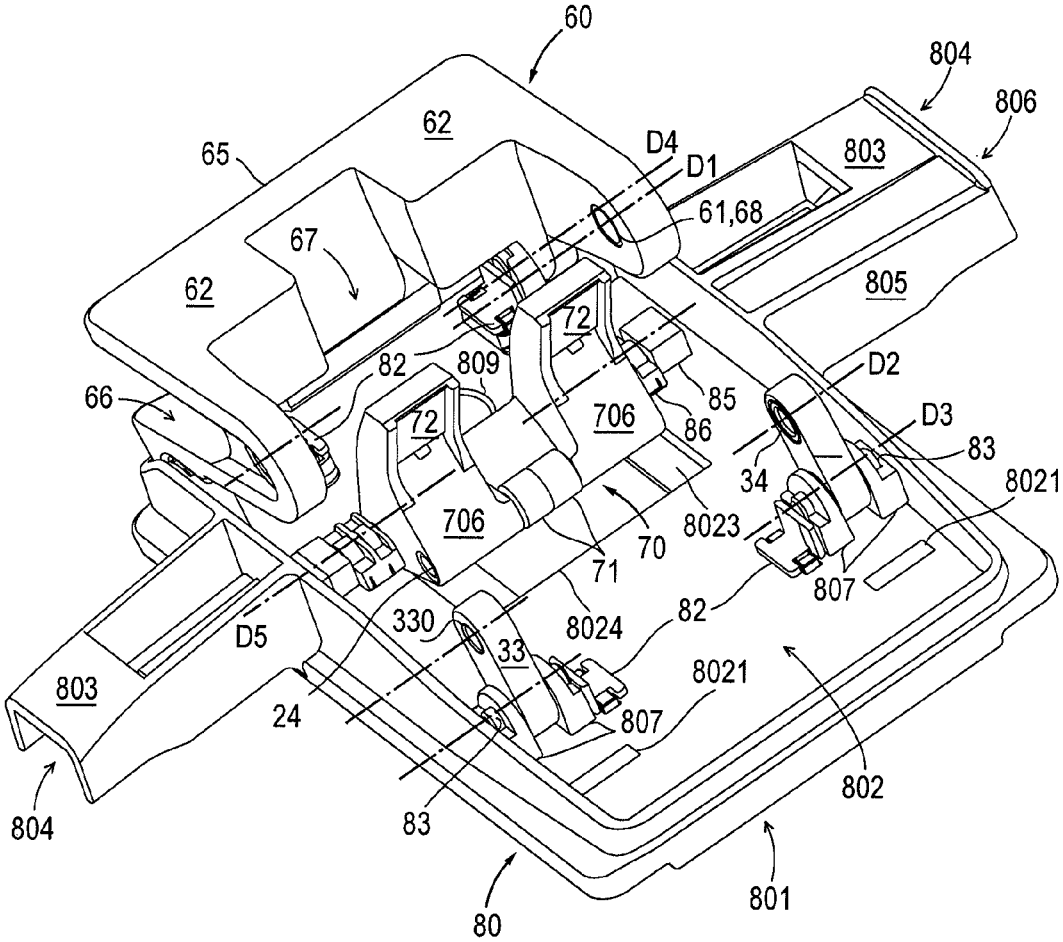
Figure 19A:
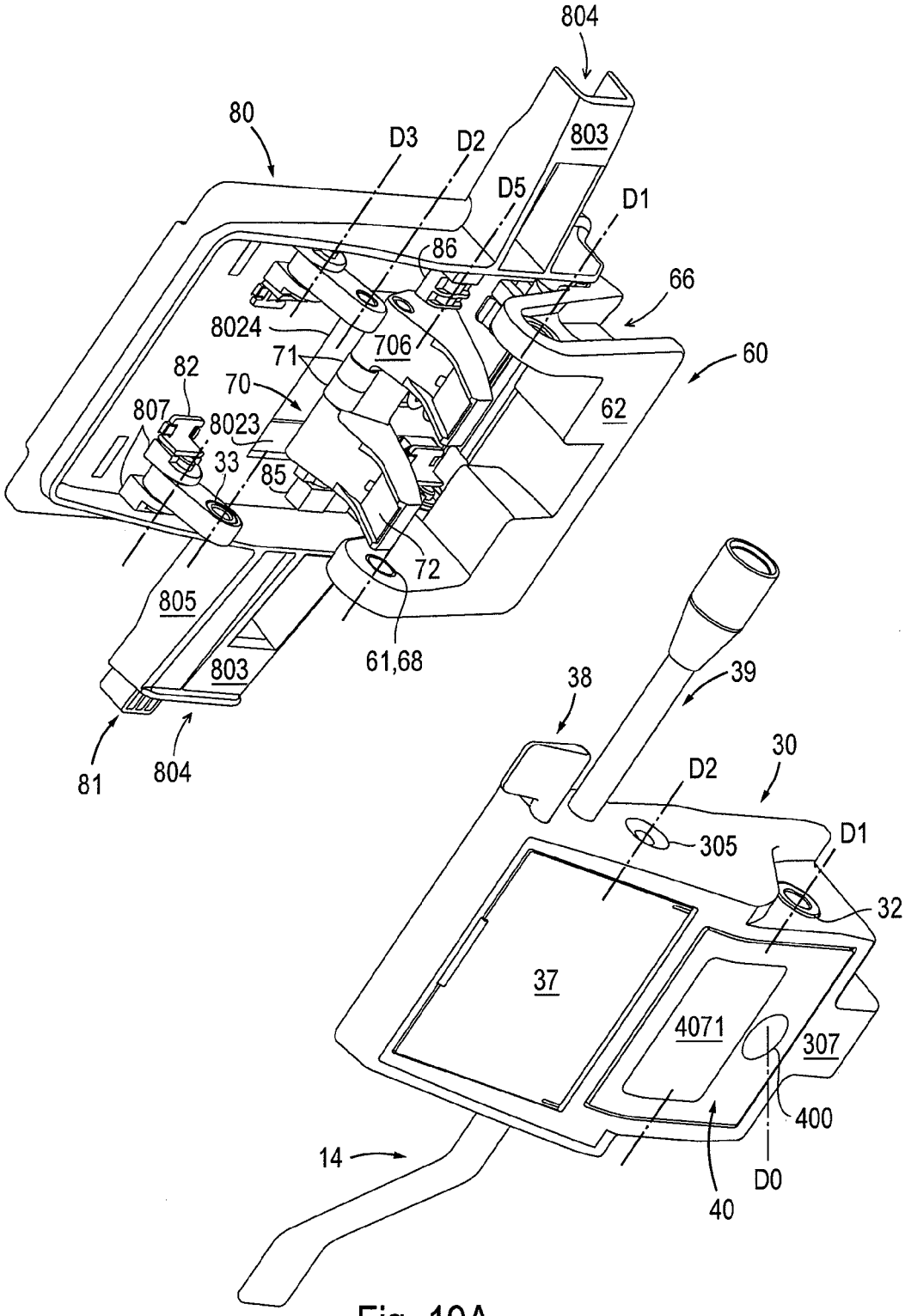
Figure 19B:
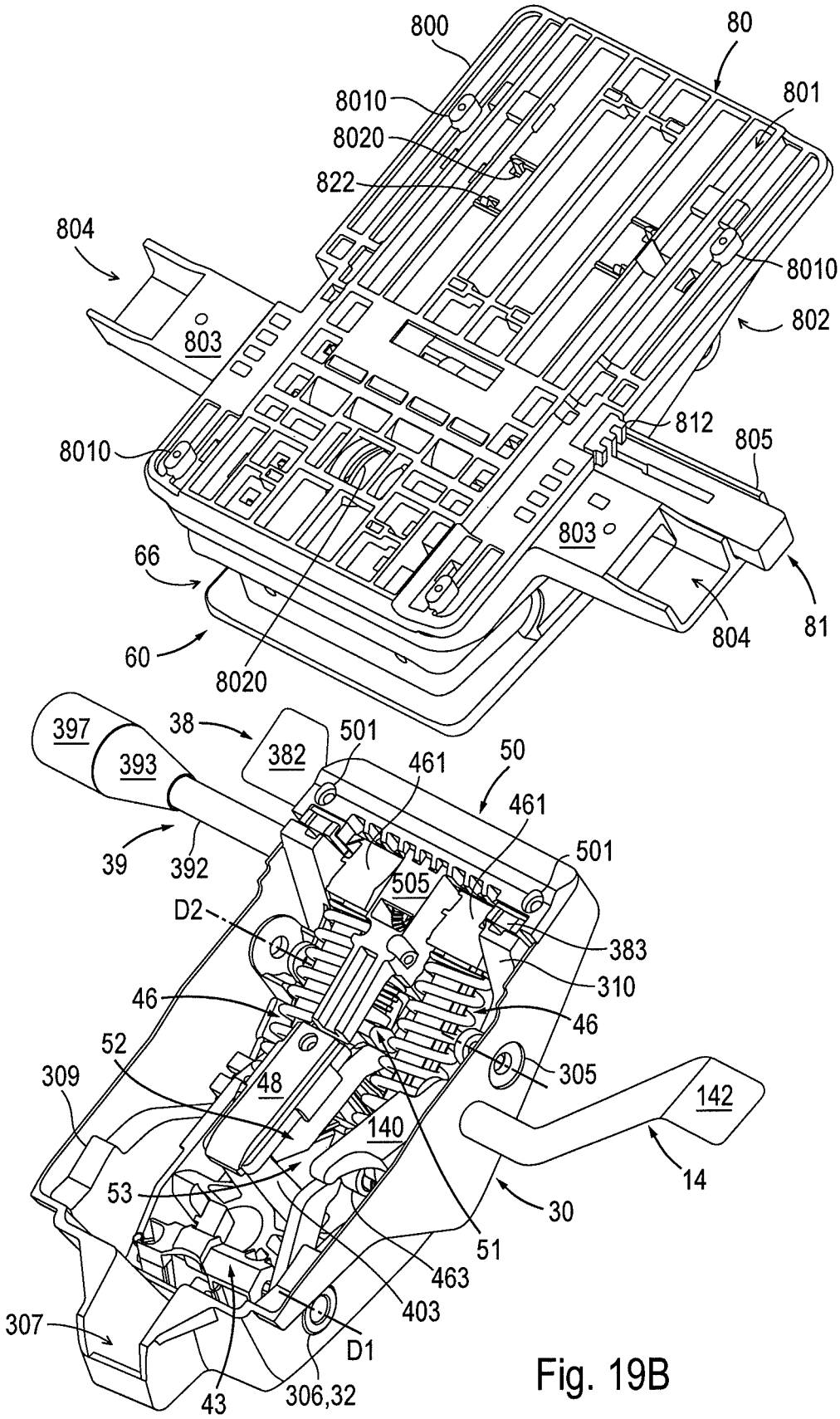
Figure 19C:
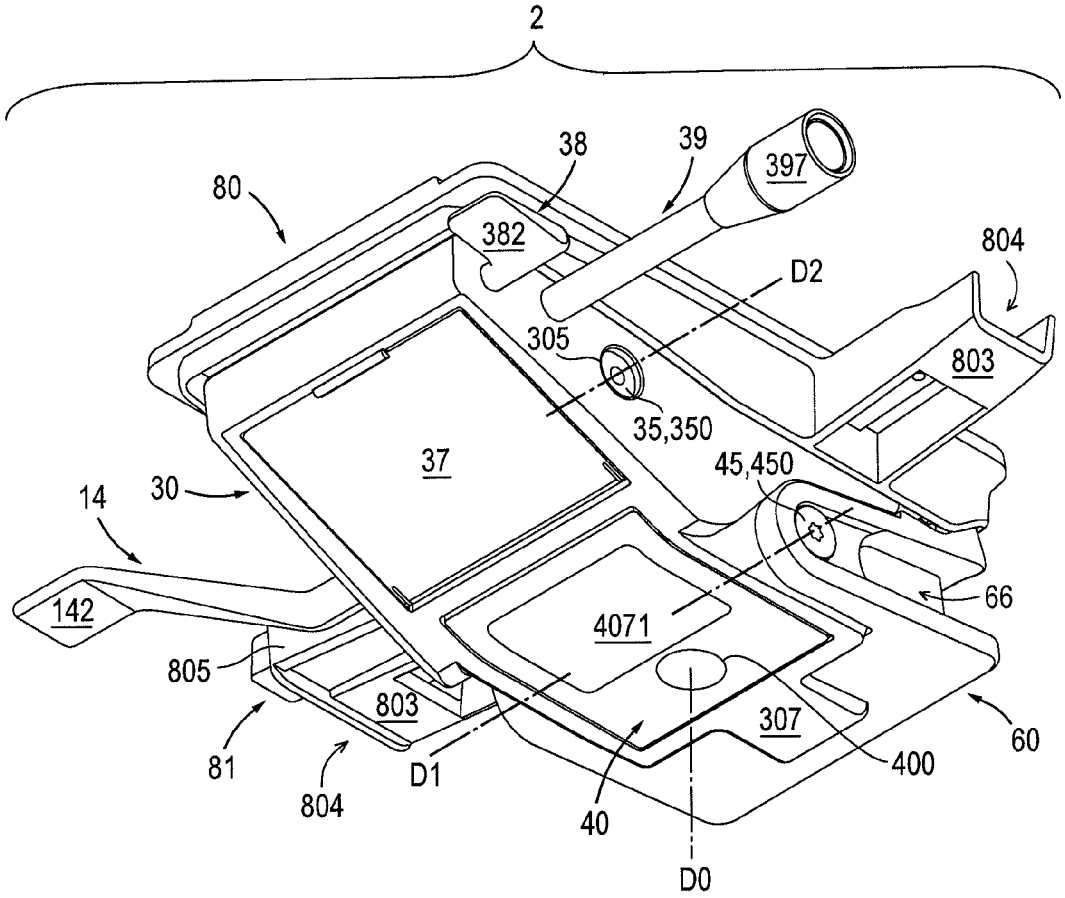
Figure 20C:
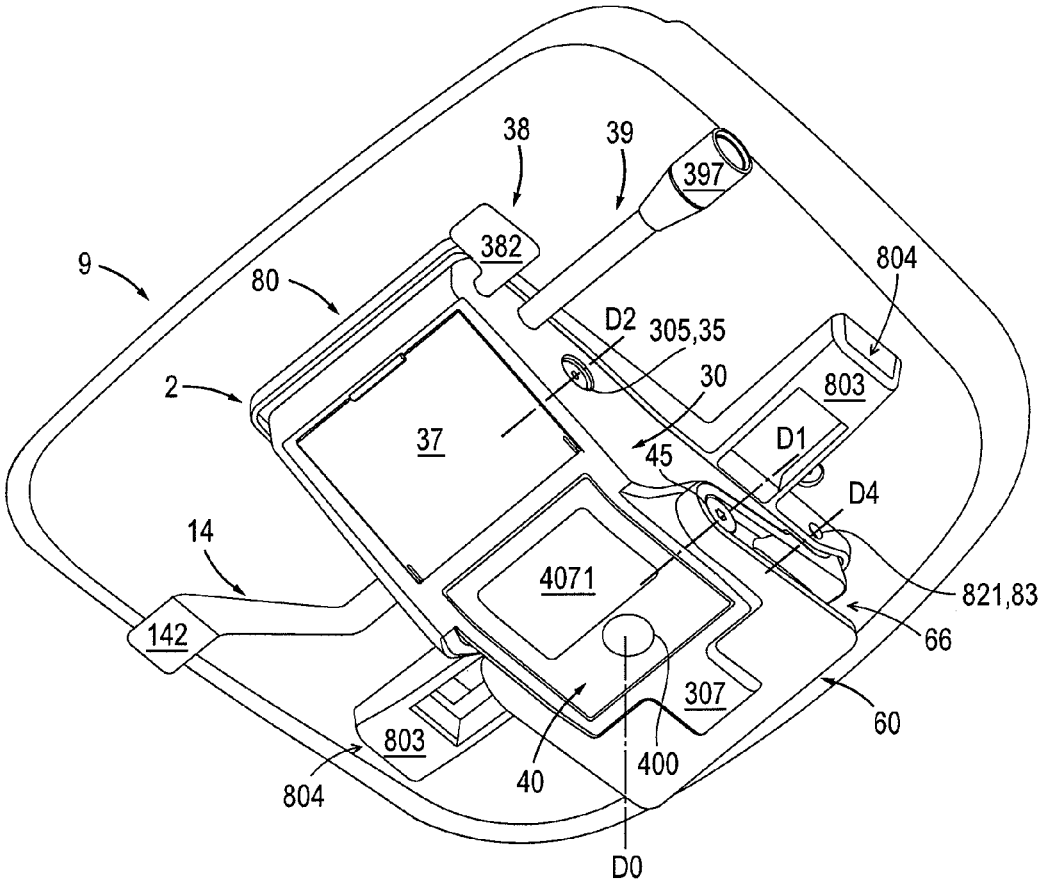
Figure 21A:
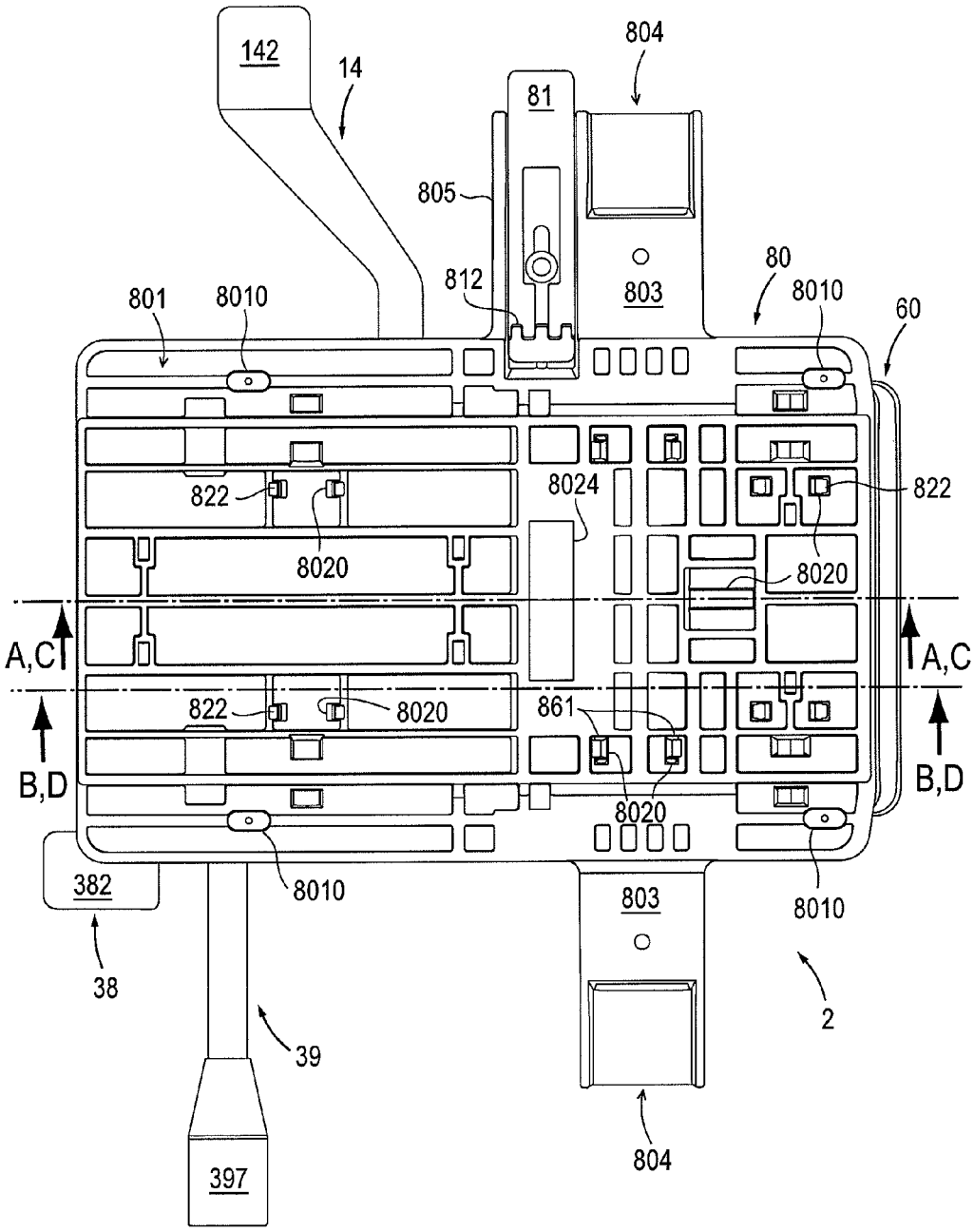
Figure 21B:
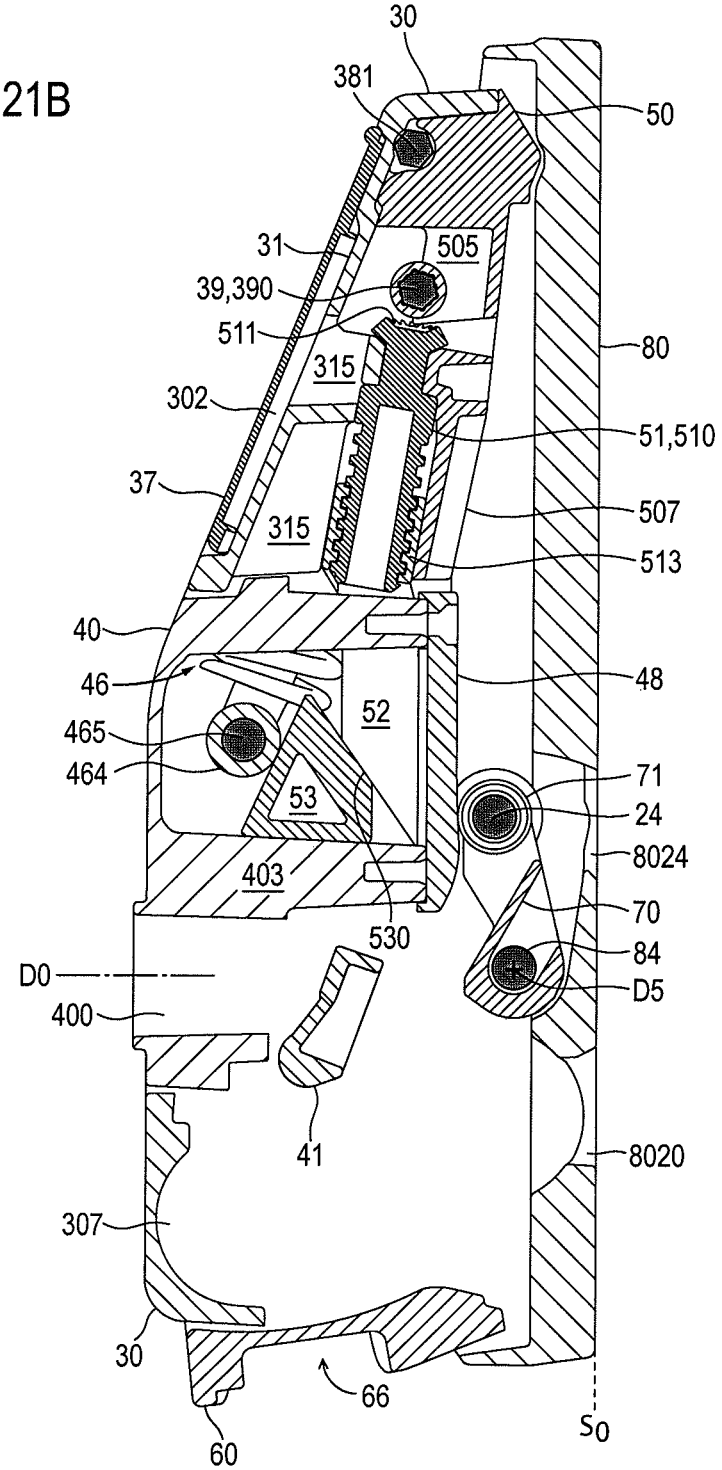
Figure 21C:
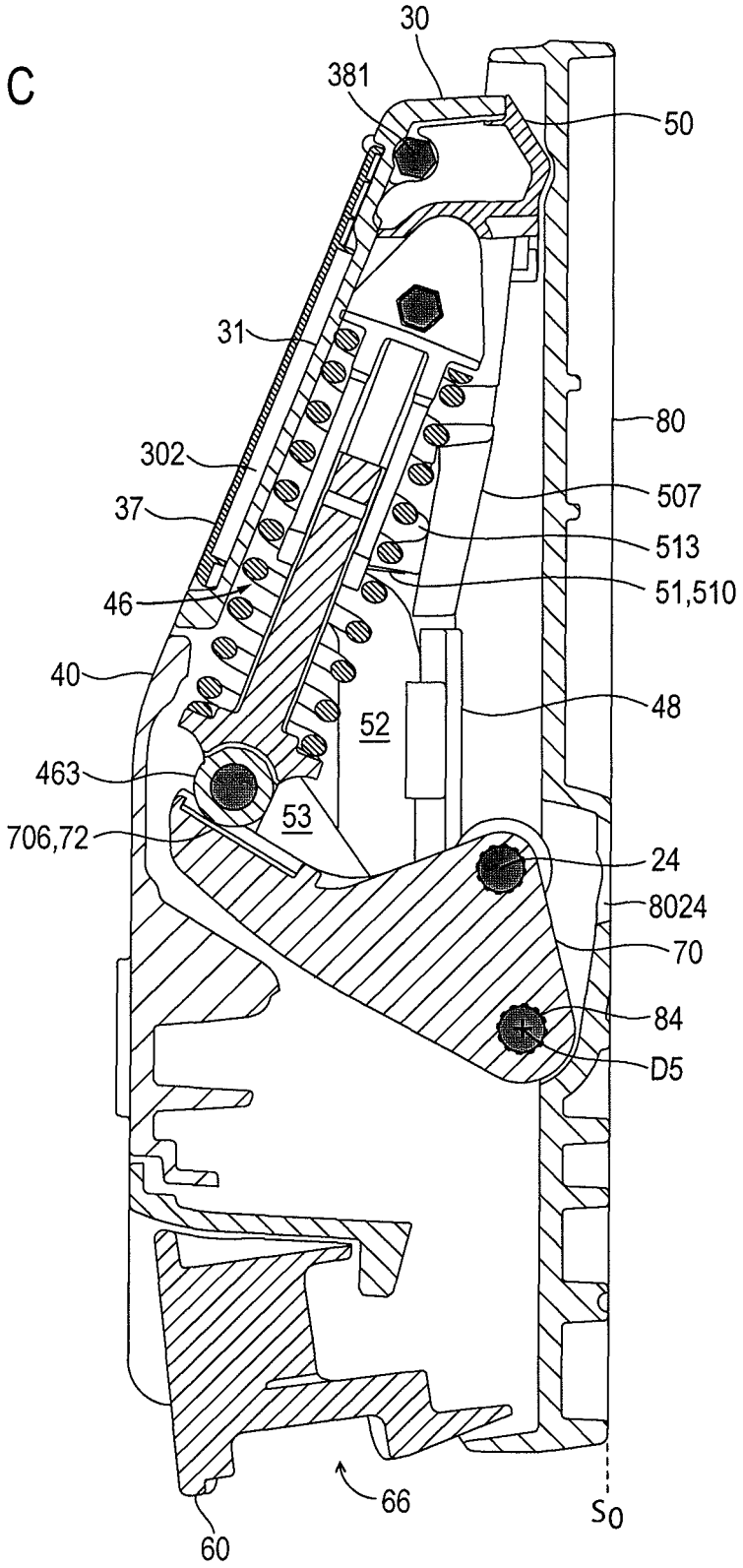
Figure 21D:
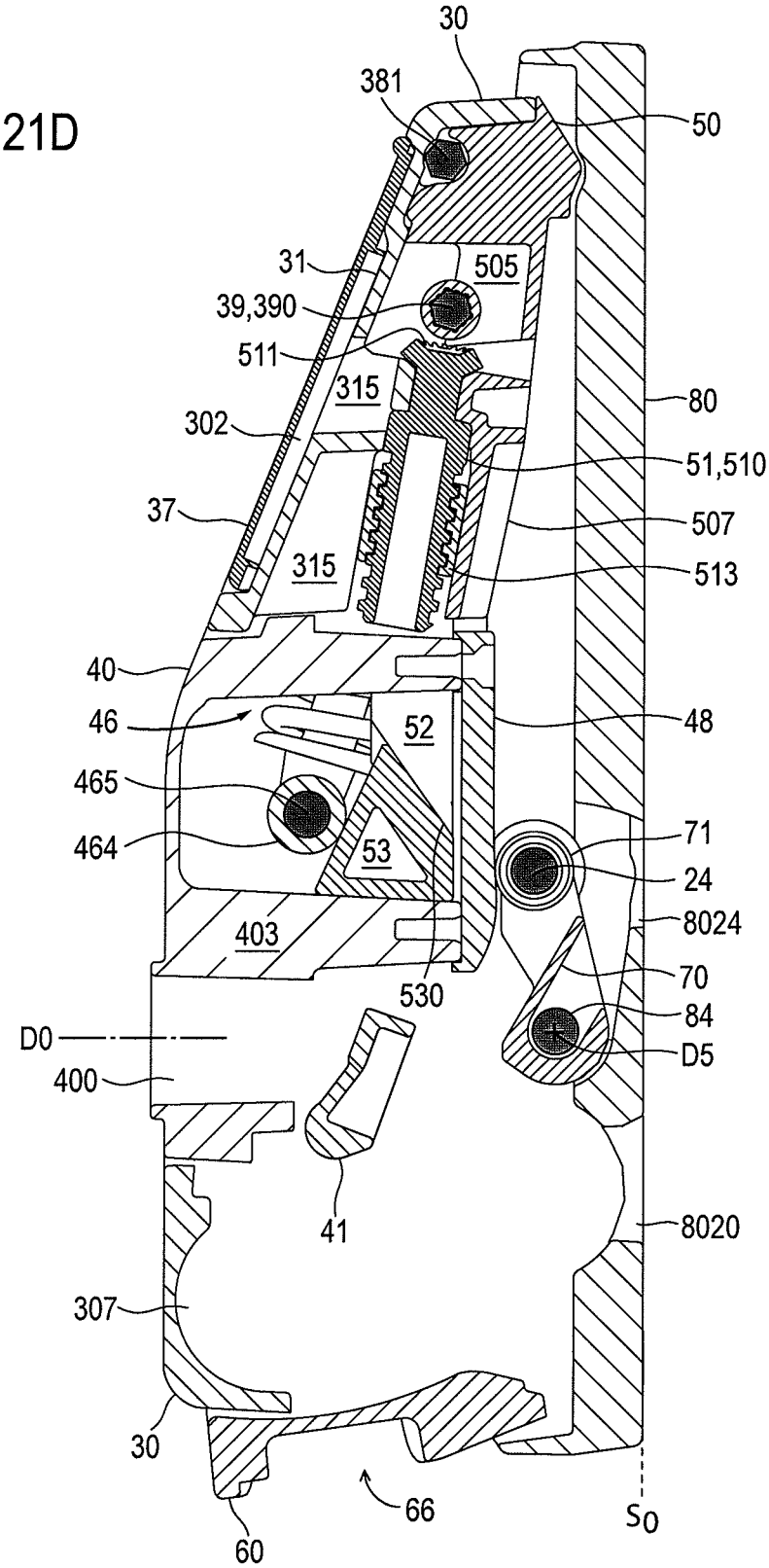
Figure 21E:
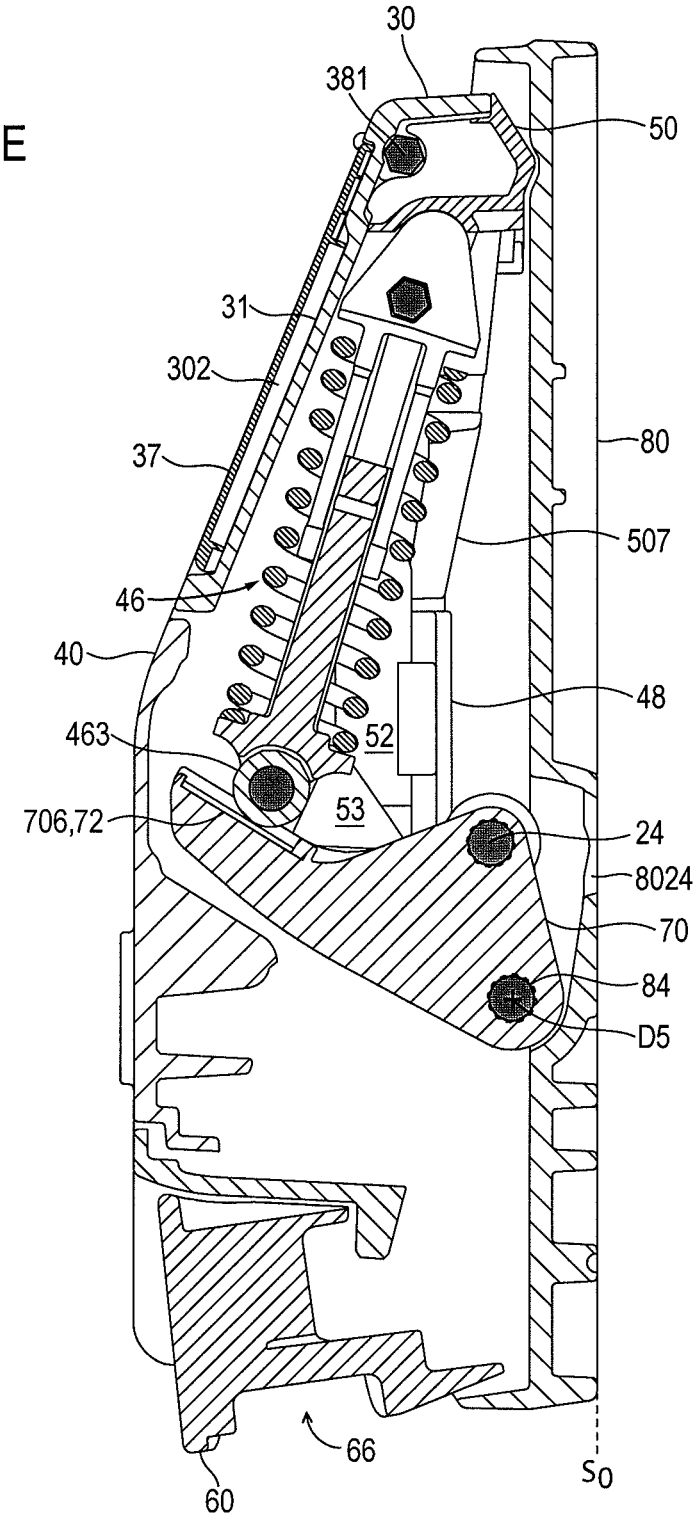
Figure 22A:
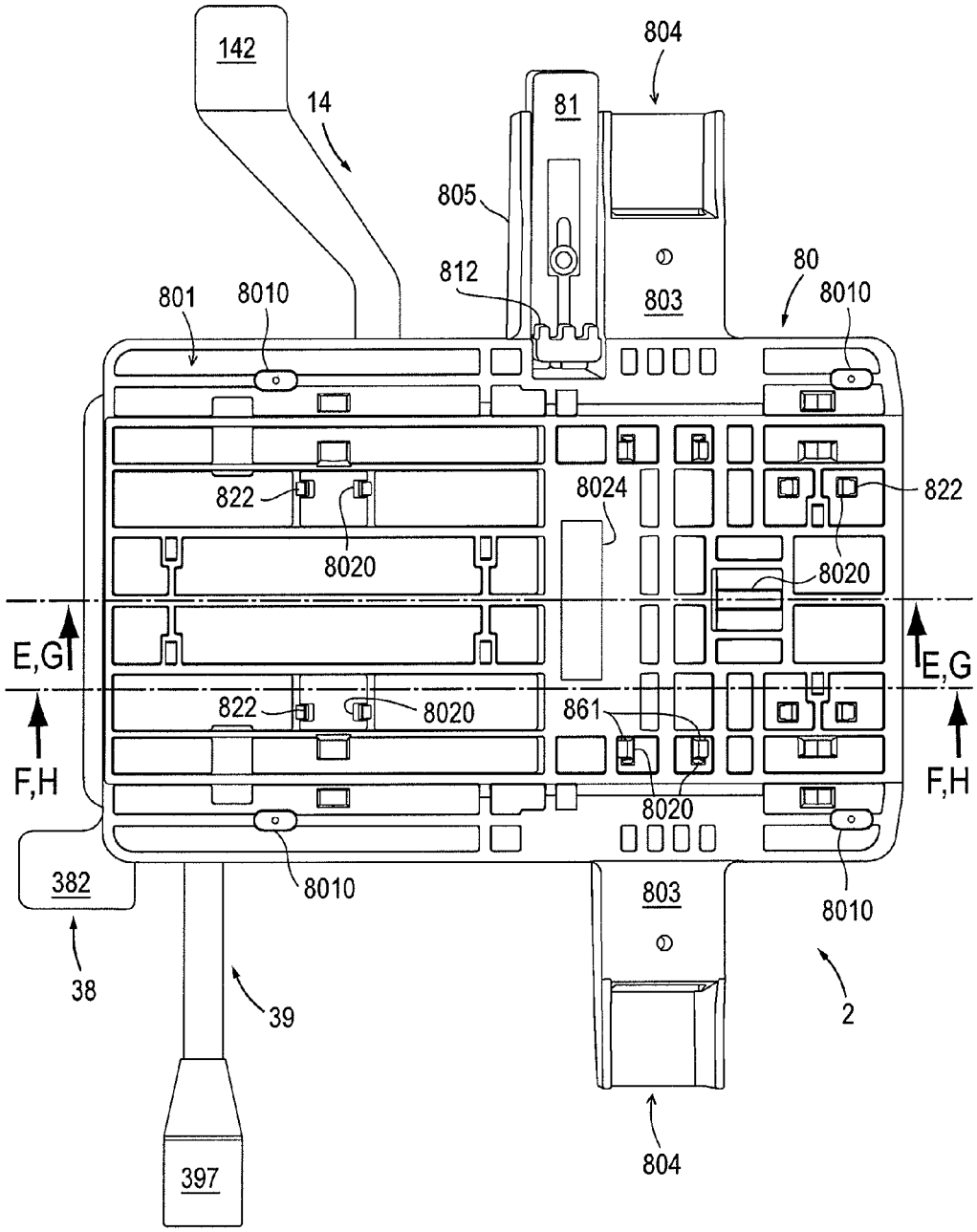
Figure 22B:
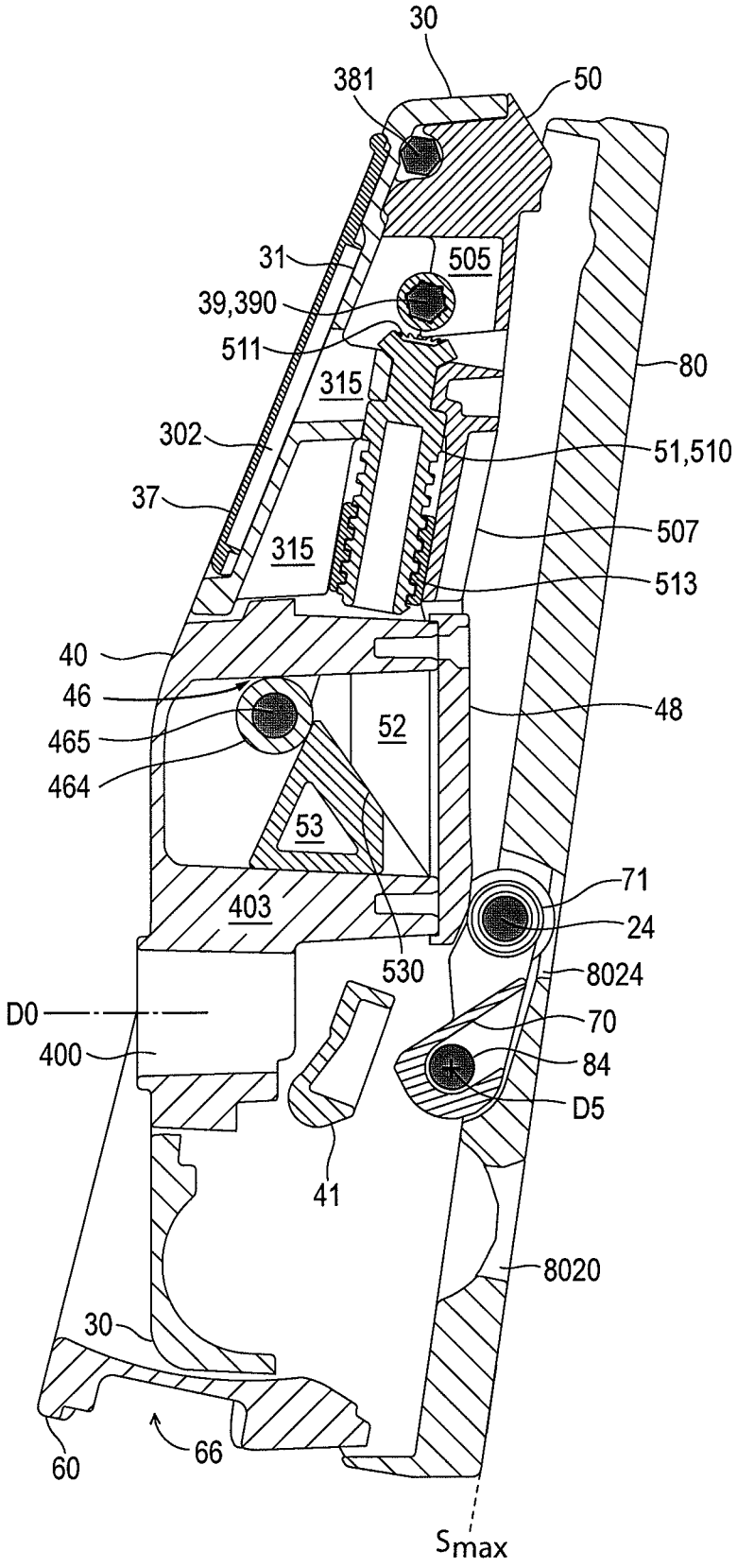
Figure 22C:
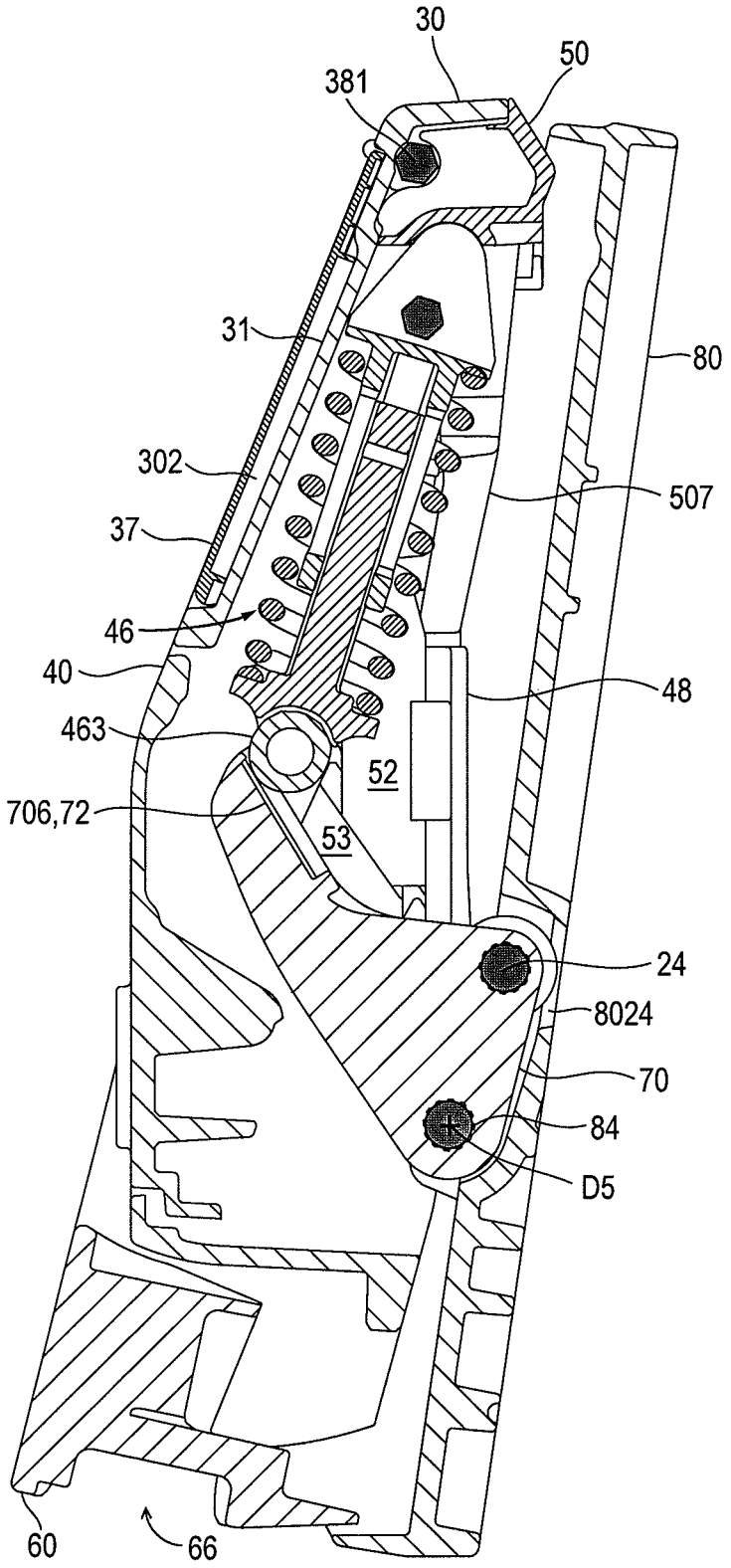
Figure 22D:
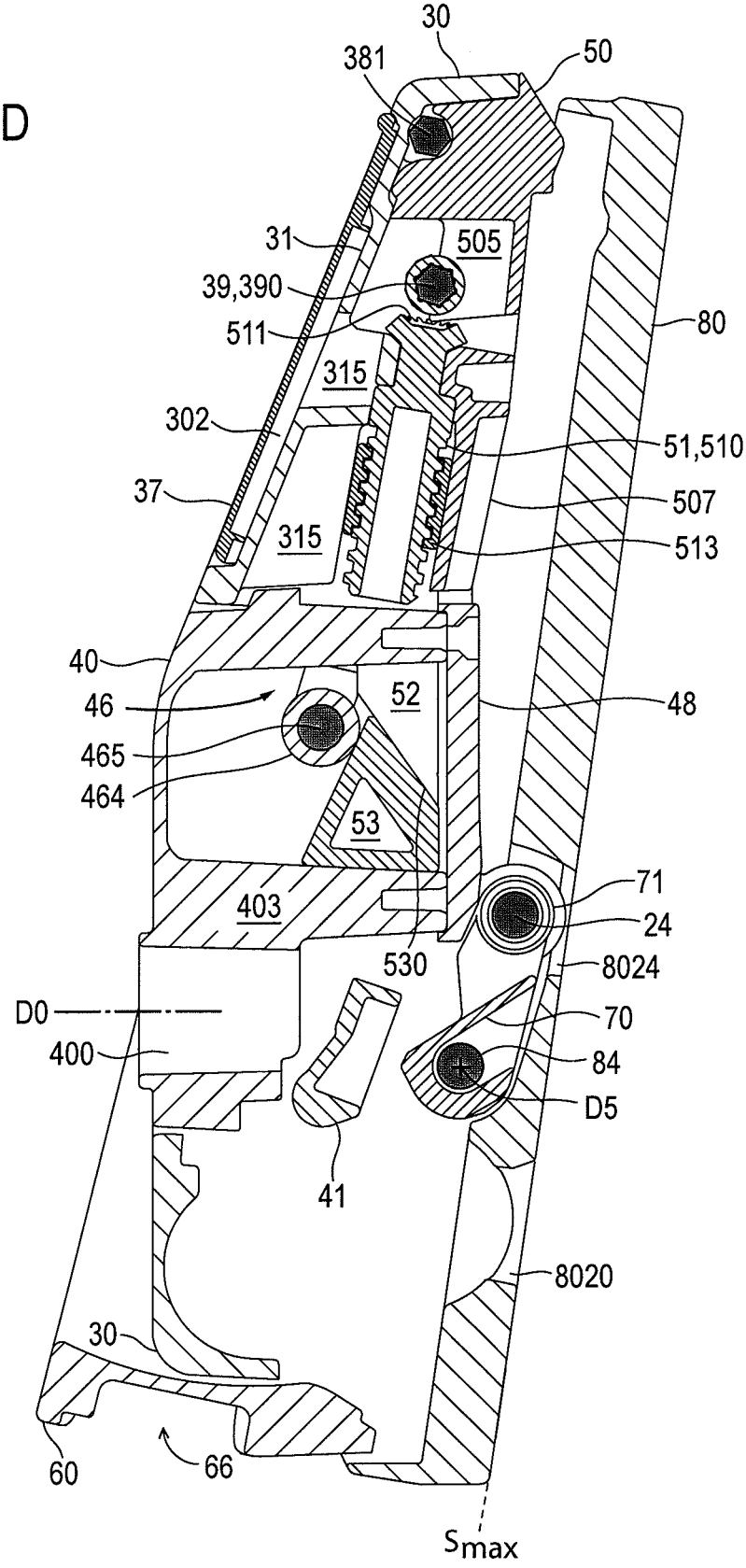
Figure 22E:
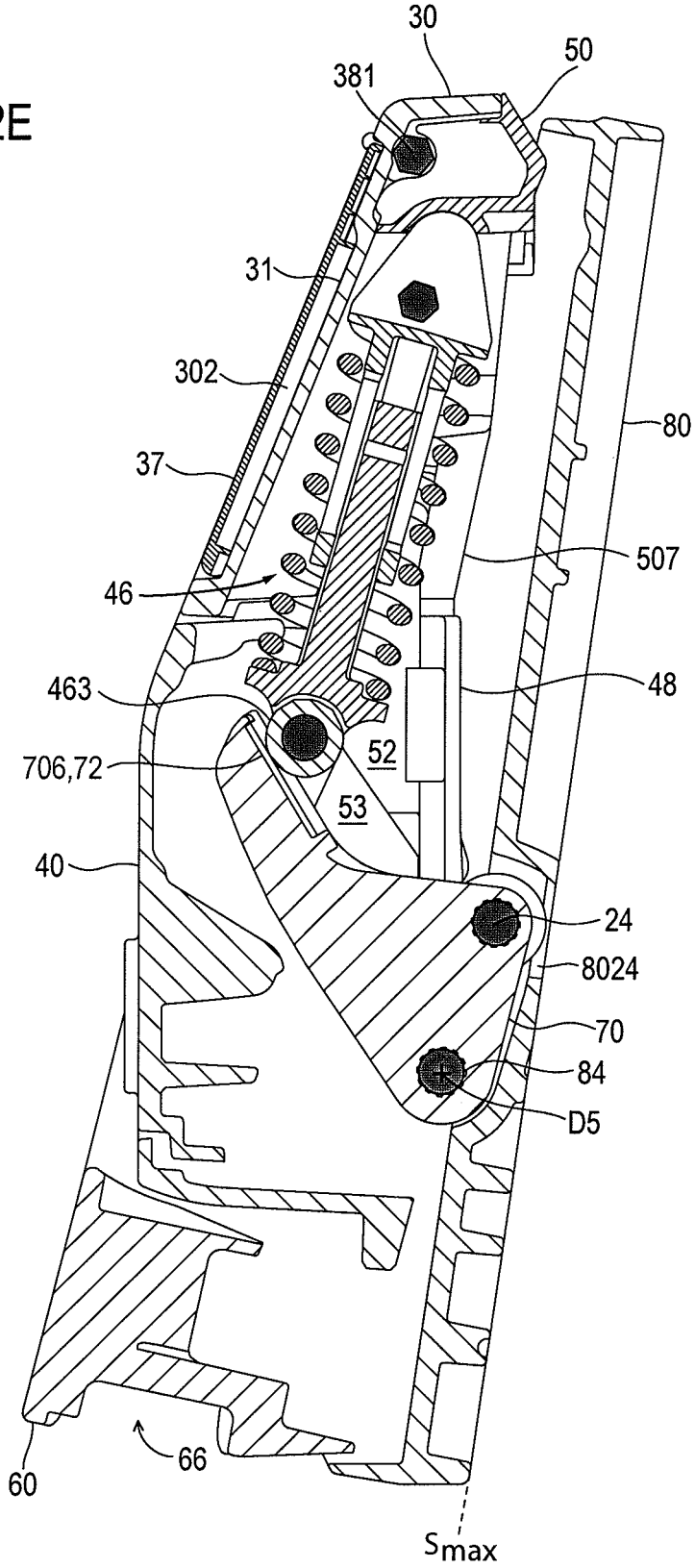
Figure 23A:
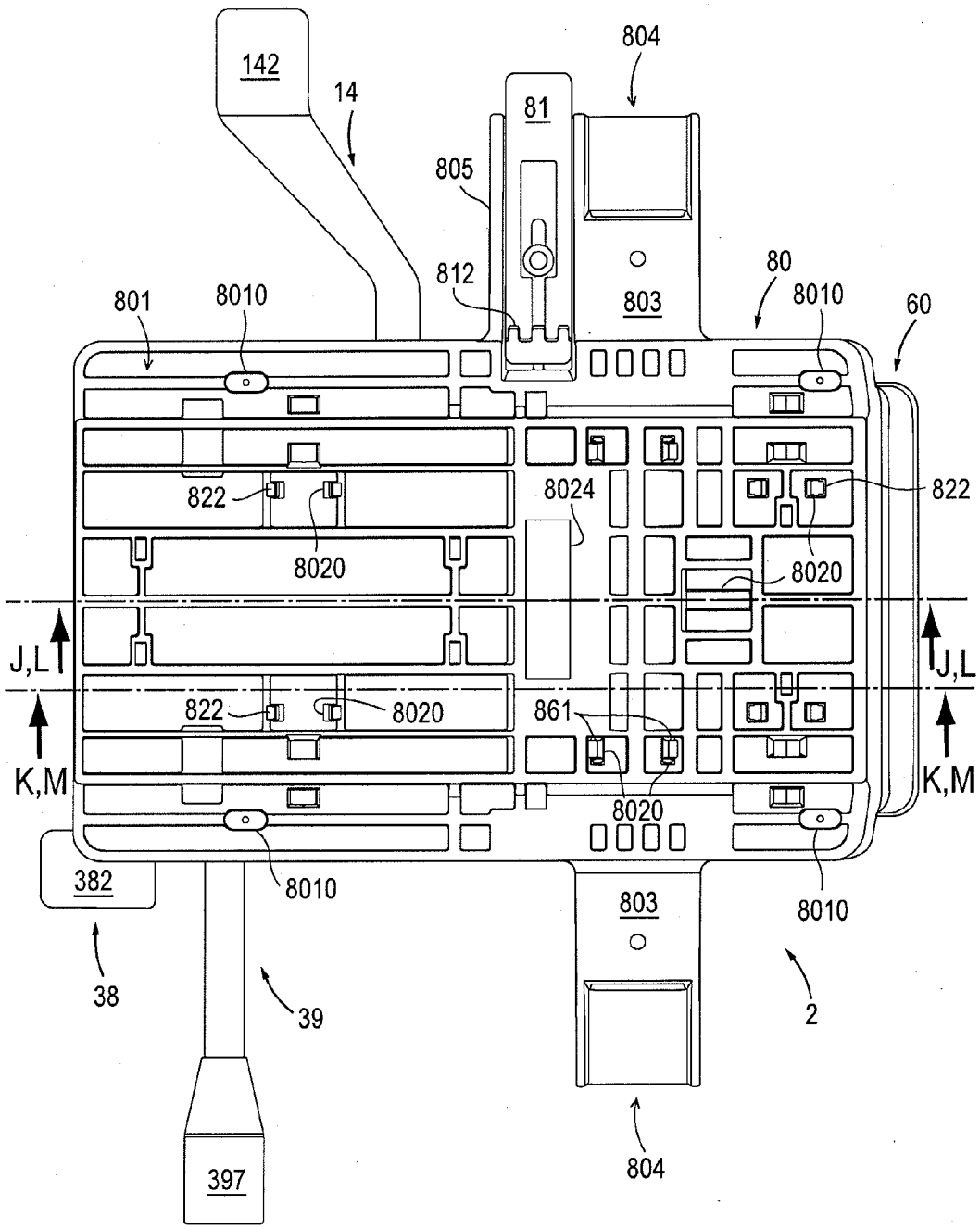
Figure 23B:
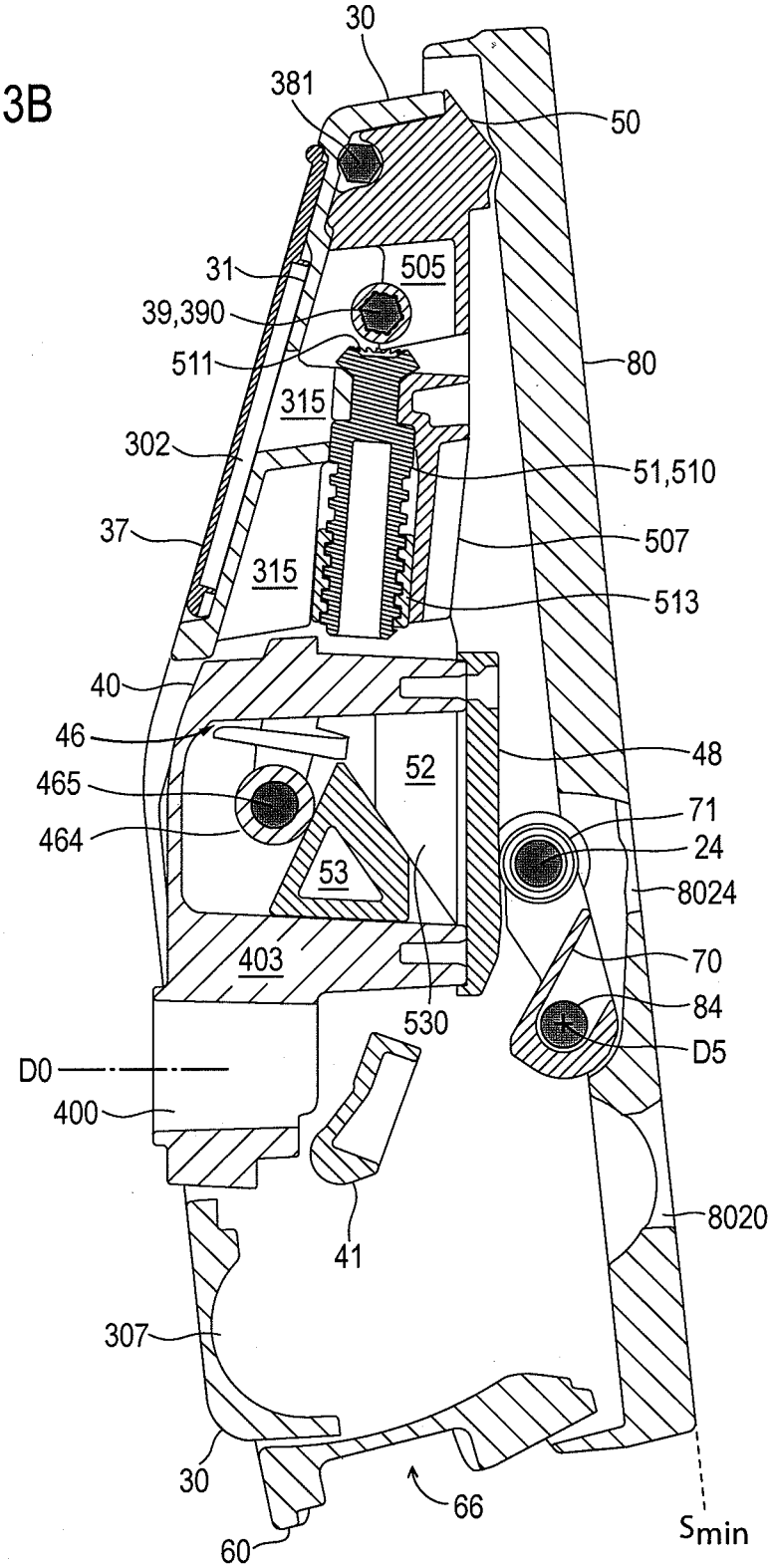
Figure 23C:
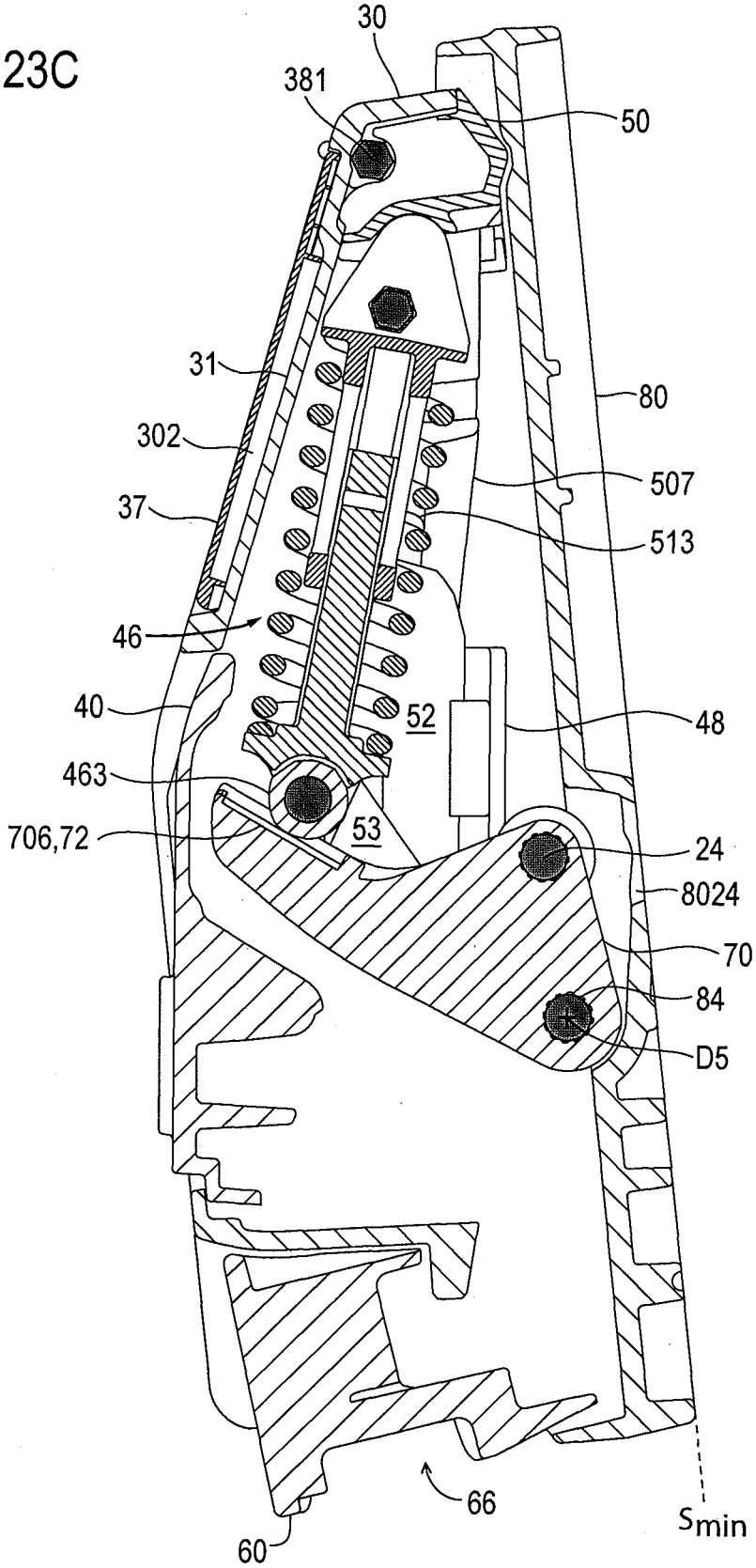
Figure 23D:
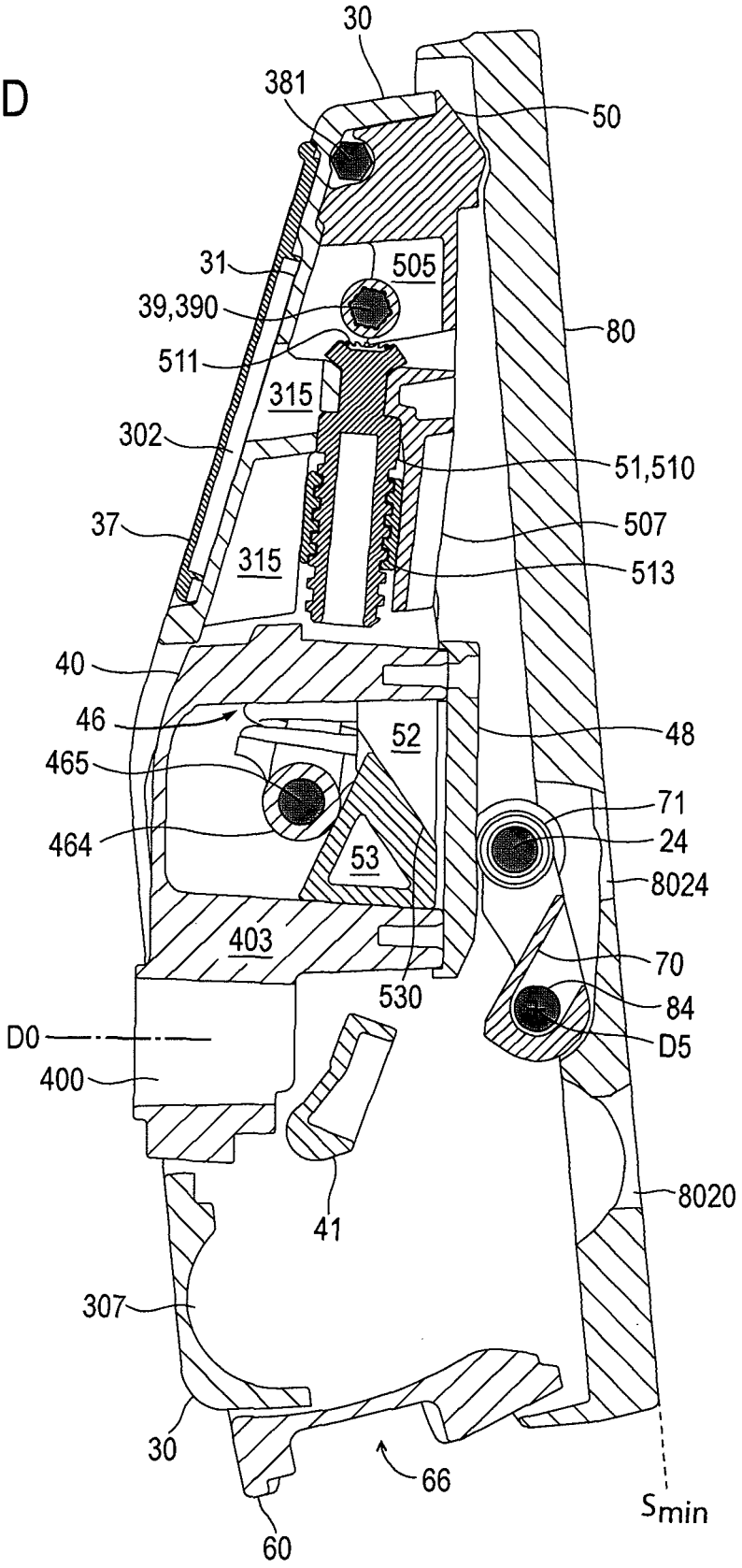
Figure 23E:
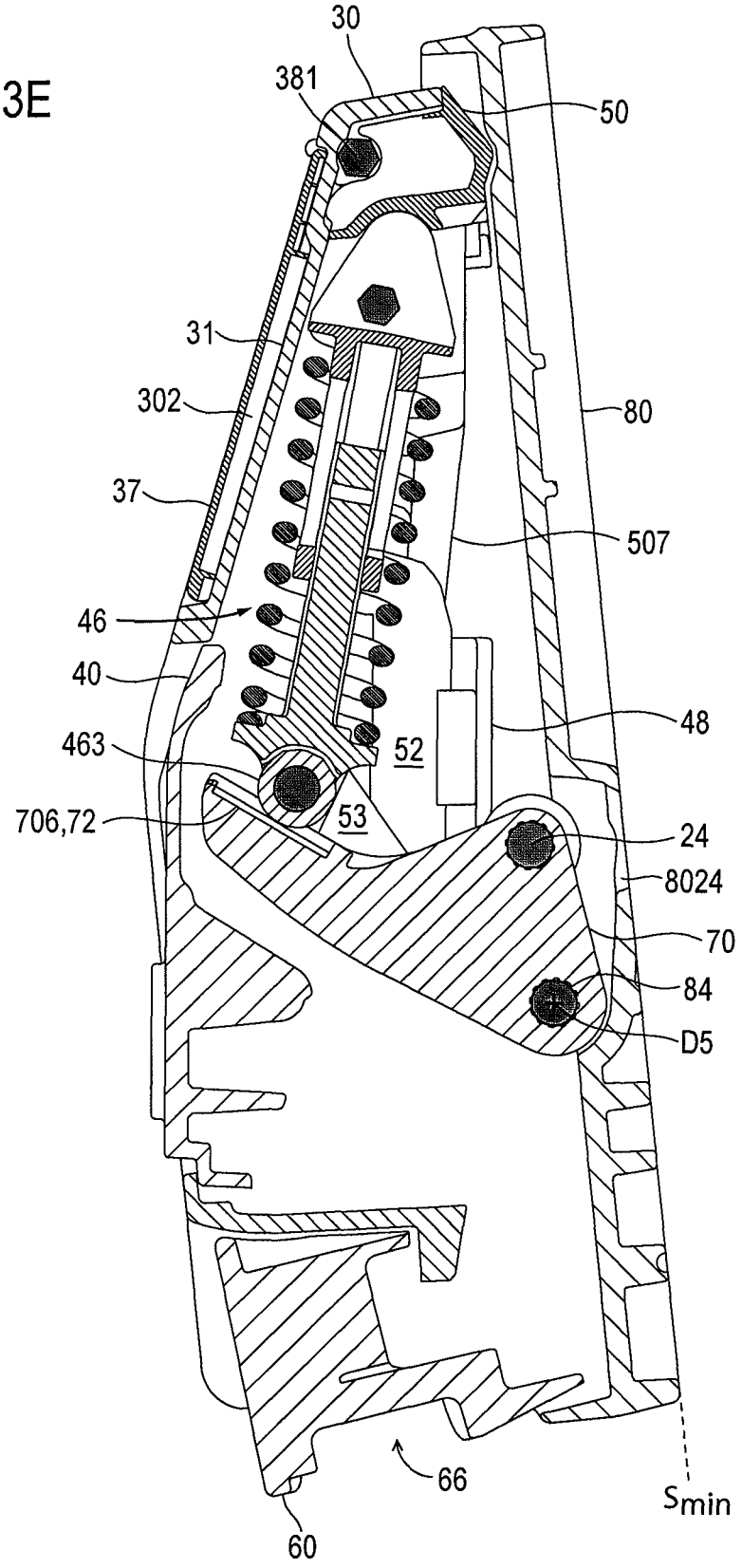

In which:

FIG. 1A—shows a perspective view from above of a chair having the mechanism as claimed in the invention, in the rest position;

FIG. 1B—shows a front view of the chair according to FIG. 1A;

FIG. 1C—shows a perspective view from below of the chair according to FIG. 1A;

FIG. 1D—shows a side view of the chair according to FIG. 1A, in the rest position;

FIG. 1E—shows a side view of the chair according to FIG. 1A, in the relaxation position;

FIG. 1F—shows a side view of the chair according to FIG. 1A, in the negative position;

FIG. 2A—shows an exploded view from above of the assemblies of the mechanism;

FIG. 2B—shows an exploded view from below of the components according to FIG. 2A;

FIG. 3A—shows a perspective view from above of the shell from FIG. 2A;

FIG. 3B—shows a perspective view from below of the shell according to FIG. 3A;

FIG. 3C—shows a different perspective view from above of the shell according to FIG. 3A;

FIG. 4A—shows a perspective view from above of the backrest carrier from FIG. 2A;

FIG. 4B—shows a perspective view from below of the backrest carrier according to FIG. 4A;

FIG. 4C—shows a different perspective view from above of the backrest carrier according to FIG. 4A;

FIG. 5A—shows a perspective view from above of the base from FIG. 2A;

FIG. 5B—shows a perspective view from below of the base according to FIG. 5A;

FIG. 5C—shows a different perspective view from above of the base according to FIG. 5A;

FIG. 6A—shows a perspective view from above of the guide means from FIG. 2A;

FIG. 6B—shows a perspective view from below of the guide means according to FIG. 6A;

FIG. 6C—shows a different perspective view of the guide means from FIG. 6A;

FIG. 7A—shows a perspective view from above of the bearing block from FIG. 2A;

FIG. 7B—shows a perspective view from below of the bearing block according to FIG. 7A;

FIG. 7C—shows a different perspective view from above of the bearing block according to FIG. 7A;

FIG. 8A—shows a perspective view from above of the seat carrier from FIG. 2A;

FIG. 8B—shows a perspective view from below of the seat carrier according to FIG. 8A;

FIG. 8C—shows a different perspective view from above of the seat carrier according to FIG. 8A;

FIG. 9A—shows an exploded view from above of the base according to FIG. 5A with some installed parts;

FIG. 9B—shows an exploded view from below of the assembling of the components according to FIG. 9A;

FIG. 9C—shows a perspective view from above of the principle assignment of the components according to FIG. 9A, without the base;

FIG. 9D—shows a different perspective of the assembly according to FIG. 9C;

FIG. 9E—shows a perspective view from above of the base according to FIG. 5A with an installed trip device;

FIG. 9F—shows the assembly according to FIG. 9E with shielding;

FIG. 9G—shows the assembly according to FIG. 9F with control cam;

FIG. 9H—shows a different perspective of the assembly according to FIG. 9G with primary wedge and intermediate wedge;

FIG. 9J—shows a different perspective of the assembly according to FIG. 9H, without primary wedge;

FIG. 9K—shows a different perspective of the assembly according to FIG. 9J with primary wedge and first buffer;

FIG. 9L—shows a different perspective of the assembly according to FIG. 9K with bearing journals;

FIG. 9M—shows a different perspective of the assembly according to FIG. 9L with a spring system;

FIG. 10A—shows an exploded view from above of the shell according to FIG. 3A with the components of height adjuster, stop adjuster and force adjuster as well as some further installed parts;

FIG. 10B—shows a perspective view from above of the principle assignment of the components of height adjuster, stop adjuster and force adjuster with shell cover and transfer part;

FIG. 10C—shows a perspective side view of the assembly according to FIG. 10B;

FIG. 10D—shows a different perspective of the assembly according to FIG. 10C;

FIG. 10E—shows a perspective view from above of the shell according to FIG. 3A with installed stop adjuster;

FIG. 10F—shows the assembly according to FIG. 10E with bearing block;

FIG. 10G—shows a different perspective of the assembly according to FIG. 10F;

FIG. 10H—shows the assembly according to FIG. 10G with transfer part;

FIG. 10J—shows a different perspective view of the assembly according to FIG. 10H with height adjuster and force adjuster;

FIG. 10K—shows a different perspective of the assembly according to FIG. 10J;

FIG. 10L—shows the assembly according to FIG. 10K, as a bottom view;

FIG. 11A—shows an exploded view from above of the backrest carrier according to FIG. 4A with bearing bushes and axle pins;

FIG. 11B—shows the assembly according to FIG. 11A, assembled;

FIG. 12—shows a perspective view from above and below of the pusher from FIG. 2A;

FIG. 13—shows various perspective views of the retaining element from FIG. 2A;

FIG. 14A—shows a perspective view from above and below of the second buffer from FIG. 2A;

FIG. 14B—shows various perspective views of the connector socket from FIG. 2A;

FIG. 14C—shows various perspective views of the second buffer according to FIG. 14A with the connector socket according to FIG. 14B, assembled;

FIG. 15A—shows a perspective view from below of the seat carrier according to FIG. 8A, assembled with the pusher according to FIG. 12, retaining elements according to FIG. 13, second buffer according to FIG. 14A and connector sockets according to FIG. 14B;

FIG. 15B—shows a perspective view from above of the assembly according to FIG. 15A;

FIG. 16A—shows an exploded view of the guide means according to FIG. 6A with bearing bushes, axle rods, rollers and inserts;

FIG. 16B—shows the assembly according to FIG. 16A, assembled;

FIG. 17A—shows a perspective view from above of the shell with the spring system and the base with control cam, in each case from FIG. 2A, assembled;

FIG. 17B—shows the assembly according to FIG. 17A with the assembly according to 11B, assembled;

FIG. 17C—shows the assembly according to FIG. 17B, supplemented by the bearing block according to FIG. 7A;

FIG. 17D—shows the assembly according to FIG. 17C, supplemented by the transfer part from FIG. 10B;

FIG. 17E—shows the assembly according to FIG. 17D, supplemented by the primary wedge and intermediate wedge from FIG. 9A, without axle pins;

FIG. 17F—shows the assembly according to FIG. 17E, supplemented by the force adjuster and height adjuster from FIG. 10B;

FIG. 17G—shows the assembly according to FIG. 17F, supplemented by the assembly according to FIG. 16B and the stop adjuster from FIG. 10B;

FIG. 18A—shows a perspective view from below of the assembly according to FIG. 15A, supplemented by the assembly according to FIG. 16B, plates and axle pins from FIG. 2A and backrest carrier according to FIG. 4A;

FIG. 18B—shows a different perspective of the assembly according to FIG. 18A;

FIG. 19A—shows a perspective view from below of the assembly according to FIG. 18A, supplemented by the pusher from FIG. 2A as well as below this the assembly according to FIG. 17F with the shell cover, without the backrest carrier;

FIG. 19B—shows a perspective view from above of the assembly according to FIG. 19A, with blocking elements from FIG. 10B inserted;

FIG. 19C—shows a perspective view from below of the assembly according to FIG. 19A, assembled;

FIG. 20A—shows a perspective view from below of a seat carrier incorporated into the seat;

FIG. 20B—shows a perspective view from below of the seat carrier according to FIG. 20A, assembled with plates from FIG. 2A, the assembly according to FIG. 16B and the backrest carrier according to FIG. 4A;

FIG. 20C—shows a perspective view from below of the assembly according to FIG. 20B, assembled with the assembly according to FIG. 19B, bearing journals inserted on the first axis of rotation;

FIG. 21A—shows a top view of the assembly according to FIG. 19C, in the rest position;

FIG. 21B—shows a vertical section in FIG. 21A along the line A-A, in the rest position, with a high force setting;

FIG. 21C—shows a vertical section in FIG. 21A along the line B-B, in the rest position, with a high force setting;

FIG. 21D—shows a vertical section in FIG. 21A along the line C-C, in the rest position, with a low force setting;

FIG. 21E—shows a vertical section in FIG. 21A along the line D-D, in the rest position, with a low force setting;

FIG. 22A—shows a top view of the assembly according to FIG. 19C, in the relaxation position;

FIG. 22B—shows a vertical section in FIG. 22A along the line E-E, in the relaxation position, with a high force setting;

FIG. 22C—shows a vertical section in FIG. 22A along the line F-F, in the relaxation position, with a high force setting;

FIG. 22D—shows a vertical section in FIG. 22A along the line G-G, in the relaxation position, with a low force setting;

FIG. 22E—shows a vertical section in FIG. 22A along the line H-H, in the relaxation position, with a low force setting;

FIG. 23A—shows a top view of the assembly according to FIG. 19C, in the negative position;

FIG. 23B—shows a vertical section in FIG. 23A along the line J-J, in the negative position, with a high force setting;

FIG. 23C—shows a vertical section in FIG. 23A along the line K-K, in the negative position, with a high force setting;

FIG. 23D—shows a vertical section in FIG. 23A along the line L-L, in the negative position, with a low force setting;

FIG. 23E—shows a vertical section in FIG. 23A along the line M-M, in the negative position, with a low force setting;

FIG. 24—shows a perspective view of a backrest from FIG. 1A with no covering; and FIG. 25—shows an armrest for attachment to the mechanism according to FIG. 1C.

EXEMPLARY EMBODIMENT

The detailed description of an exemplary embodiment for the mechanism as claimed in the invention with the movement sequences is given below by way of the accompanying drawings.

The following stipulation applies to all the rest of the description. If, for the purpose of avoiding ambiguity in the drawings, reference numerals are included in a figure but are not explained in the directly associated text of the description, reference is made to their mention in preceding descriptions of the figures. In the interests of clarity, there is no repeated identification of components in following figures in the majority of cases if it can be clearly seen in the drawings that the components are "recurring".

FIGS. 1A to 1F

The mechanism 2 as claimed in the invention is placed on a height-adjustment pneumatic spring 12, which is inserted by way of its upright tube 11 in a stand 10, which is provided typically with floor-going elements 13—in particular in the form of rollers. The stand 10, which in this case is star-shaped, forms an underframe 1 along with the upright tube 11, the height-adjustment pneumatic spring 12 and the floor-going elements 13. A seat 9 is arranged on the mechanism 2, to which a connection 97 is attached, which merges into a backrest 96, which extends quasi at a right angle—upward—in relation to the seat 9. In the rest position according to FIGS. 1A to 1D, the seat 9 is situated in the quasi horizontal seat inclination $S_0$, and the backrest 96 has the associated almost vertical backrest inclination $R_0$. In the relaxation position according to FIG. 1E, the seat 9 has moved into the maximum seat inclination $S_{max}$ and the backrest 96, in a synchronous manner thereto, has assumed the maximum backrest inclination $R_{max}$. In the negative position according to FIG. 1F, the seat 9 has moved into a forwardly pointing seat inclination $S_{min}$ and the backrest 96, in a simultaneous manner thereto, into a minimum backrest inclination $R_{min}$. The inclination of the seat 9 is consequently changeable by means of the seat angle $\alpha$ within the range of $-\alpha$ to $+\alpha$, whilst the inclination of the backrest 96 varies by means of the backrest angle $\beta$ within the range of $-\beta$ to $+\beta$. The axis of rotation D0 lies in the direction of extension of the upright tube 11 and of the pneumatic spring 12.

FIGS. 2A and 2B

The mechanism 2 is made up essentially from the following assemblies:

- a shell unit 3, having:
  - a shell 30, a pair each of second bearing bushes 32, plates 33, bearing journals 35 and two pairs of first bearing bushes 34;
- a base unit 4, having:
  - a base 40, a trip device 41, a spring 42, a shield 43, a first buffer 44, a pair of bearing journals 45, a control cam 48 and a pair of stoppers 49;
- a prestressing unit 5, having:
  - a bearing block 50, a transfer part 51, a primary wedge 52 and a secondary wedge 53;
- a backrest carrier unit 6, having:
  - a backrest carrier 60 and one pair each of first bearing bushes 68 and second bearing bushes 69;
- a guide unit 7, having:
  - a guide means 70, one pair each of rollers 71 and inserts 72 and an axle rod 73;
- a seat carrier unit 8, having:
  - a seat carrier 80, a pusher 81, a primary axle rod 84, one pair each of second buffers 85 and connector sockets 86 as well as two pairs each of retaining elements 82, axle pins 83 and one pair of sliding rails 87;
- a height adjuster 14, having:
  - a lever 140, a multi-edge rod 141 and a handle 142;
- a shell cover 37;
- a stop adjuster 38, having:
  - a lever 380, a multi-edge rod 381, a handle 382 and one pair each of blocking elements 383 and entrainment means 384;
- a force adjuster 39, having:
  - a toothed wheel 390, a multi-edge rod 391, a guide tube 392, an intermediate piece 393, a helical spring 394, a spring guide 395, a screw 396, a sleeve 398 and a handle 397; and
- a spring system 46, having:
  - one pair each of helical springs 460, upper parts 461, lower parts 462 and outer rollers 463 as well as a center roller 464 and a shaft 465.

FIGS. 3A to 3C

The shell 30 has a bottom 31 as bottom surface in the front region and in the rear region a large-area first recess 301 which is followed by a spring seat 307. Side walls, a front wall and a rear wall rise from the bottom surface which, in principle, is rectangular. A ledge-shaped stop 314 is situated at the transition between the first recess 301 and the spring seat 307. At the front end of the bottom 31 a corner journal 313 rises in each corner region and at a spacing thereto a post 310. Each post 310 is followed by a first bearing element 311, consisting of two eye-shaped webs which are parallel to each other and through which axle holes lying on the second axis of rotation D2 extend, which axle holes emerge as second axle holes 305 in both side walls. A third axle hole 303 opens out in a side wall close to the front wall. A fourth axle hole 304 opens out at the identical side wall between the third axle hole 303 and the second axle hole 305. Adjacent to the opposite side wall, the first bearing element 311 is followed by a second bearing element 312, which, once again, consists of two eye-shaped webs which are parallel to each other and through which fifth axle holes 316 extend, which emerge at the associated side wall. One first axle hole 306 each also opens out in the two side walls, through which holes the first axis of rotation D1, lying in the rear region of the shell, 30 extends. The axes of rotation D1,D2 lie parallel to each other. The shell 30 is tapered as far as the rear end in the region of the first axle holes 306, as a result of which an inclined ledge 308 is created internally at each side wall, on each of which an elevation 309 is arranged. A bed 315 rises from the bottom 31, whilst underneath the bottom 31 there is a shallow cavity 302. The outer apertures of the first and second axle holes 306,305 have countersinkings. Two slots 317 are present in the bottom 31 in the region of the cavity 302. The shell 30 preferably consists of aluminum and is produced as a cast part.

FIGS. 4A to 4C

The backrest carrier 60, which, in principle, is U-shaped, has two arms which are parallel to each other, through which, in the vicinity of their free ends, in each case a first axle hole 61 extends, said holes lying on the first axis of rotation D1. The two arms are bridged by a cross portion 65, a cheek section 62 lying in each corner region between cross portion 65 and arm and a space 67 remaining centrally between the two cheek sections 62. A second axle hole 64, through which the fourth axis of rotation D4 extends, is situated in each case above the plane of the first axle holes 61 and of the first axis of rotation D1 in the vicinity of the transition from each arm to the cross portion 65. The axes of rotation D1,D4 lie parallel to each other. A recess 63 is provided in each case in the cross portion 65 adjacent to each cheek section 62 and each second axle hole 64. A groove-shaped reception 66, which extends in each case as far as into the outer flanks of the two arms, is arranged on the outer surface of the cross portion 65. Through holes 660 are present inside the reception 66.

FIGS. 5A to 5C

The bottom 407 of the base 40 is approximately square, side walls and structures rising up from said bottom. The cone opening 400 which passes vertically through the base 40 and through which the axis of rotation D0 extends, opens out on the bottom 407, in the rear region of the base 40. One axle hole 401 with outward countersinking emerges in each case in two opposite side walls. The first axis of rotation D1 extends through said axle holes 401. A bed structure 402, which is composed of several vertical ribs spaced apart from each other with upwardly open, semi-circular notches, all notches being aligned with one another, is provided between the cone opening 400 and the rear end of the base 40. Bores 408 are situated in the vicinity of the bed structure 402. A molded groove 4070 is provided on the rear edge of the base 40. One post 403 rises adjacent to the cone opening 400 and opposite said post a further post 403 rises between the two cutouts 406. Two spheroid cutouts 406 are present in the front wall. The base 40 preferably consists of aluminum and is produced as a cast part.

FIGS. 6A to 6C

In principle, the guide means 70 is U-shaped in form with a cross portion 700, from which extend, leaving an intermediate space 705, two arms 706 which are parallel to each other. The rear end of the guide means 70 is penetrated by a first axle hole 704, through which the fifth axis of rotation D5 extends. In the vicinity of the transition from the arms 706 to the cross portion 700, however already in the region of the intermediate space 705, each arm 706 is penetrated by a second axle hole 703, said axle holes 703 being aligned with each other. On the top surface, each arm 706 has a recess 707 which is defined towards the cross portion 700 by a stop 708. The guide means 70 preferably consists of plastics material.

FIGS. 7A to 7C

In principle, the bearing block 50 is T-shaped in form with a cross strut 500, from the middle of which a housing 505 extends. The outer ends of the cross strut 500 each have a screw seat 501 and a cavity 502 which is open towards the side of the housing 505. The reception 504, which emerges at the cross strut 500, extends longitudinally through the housing 505. A semicircular cutout 506 extends transversely through the housing 505. A support 507 is attached to the housing 505 below the aperture of the reception 504. A bed structure 503, which is composed of several vertical ribs spaced apart from each other with downwardly open, semi-circular notches, all notches being aligned with one another, is provided on the bottom surface of the bearing block 50. In addition, a cam 509 is located on the bottom surface of the bearing block 50. The bearing block 50 preferably consists of plastics material.

FIGS. 8A to 8C

The seat carrier 80 consists of a plate 800 with the upper surface 801 and the bottom surface 802, on which the plate 800 is surrounded by an edge-shaped wall. An outwardly projecting connecting piece 803 juts out in each case in the rear region of the plate 800, said connecting pieces being aligned with one another and in each case having a guide 804. A secondary connecting piece 805 with the guide 806 connects to one of the connecting pieces 803 and is guided in parallel. Journals 8010, which rise towards the top surface 801, are arranged in the vicinity of the corner regions of the plate 800. The top surface 801 has a plurality of emerging locking holes 8020 distributed over the plate 800. In the vicinity of the rear end and in the front region of the plate 800, from the bottom surface 802 thereof, extend two pairs each of first bearing elements 807, which are in the form of vertically standing eyes with holes that run through transversely. The first bearing elements 807 in the vicinity of the rear end define the fourth axis of rotation D4, whilst the first bearing elements 807 on the front region form the third axis of rotation D3. Approximately at the level of the projecting connecting piece 803, two second bearing elements 808 which are open in the shape of a semimonocoque, rise from the bottom surface 802. Approximately centrally between the rear first bearing elements 807 and the second bearing elements 808 there is a dome-shaped indentation 809 on the bottom surface 802. The inner first bearing elements 807, the second bearing elements 808 and the indentation 809 have associated therewith locking holes 8020, which project through the plate 800. There is a blind hole 8021 on the bottom surface 802 between each pair of first bearing elements 807 in the front region of the plate 800 and its front edge. A rectangular break-through 8024, which is surrounded by an indentation 8023 on the bottom surface 802, emerges in the middle of the plate top surface 801 between the two connecting pieces 803.

FIGS. 9A and 9B

The trip device 41 is composed of the axle pin 410 and the arm-like spar 411 arranged fixedly on the one end thereof as well as the lever-shaped pressure part 412 which is fixedly attached in the vicinity of the other end of the axle pin 410. The pressure part 412 has an outwardly projecting hook 413. The shield 43 has a cover section 430 with a fixing section 431 at each end. Each fixing section 431 has a hole 432 for the passage of a screw 439. In cross section, the first buffer 44 has the shape of a double T. A bearing journal 45 has the head 450, from which extends the axle section 451, which ends freely with a threaded section 452. The control cam 48 is created as a plate with a rectangular bottom surface, the top surface being developed as a cam plate. A stopper 49 can be placed onto each side of the base 40, said stoppers serving for damping in the event of sudden movement of the mechanism 2 from the negative position into the rest position. At one end the primary wedge 52 has a coupling part 520, which is completed with an inclination 522. The other end of the primary wedge 52 has two fork prongs 521 which surround a space 523. At the front end, the intermediate wedge 53 has an ascending inclined surface 530, on the two sides in each case a groove 532 running parallel thereto and an inclined back surface 531.

FIGS. 9C to 9M

This sequence of figures illustrates the principle assignment of components—substantially in conjunction with the base 40—in successive assembly without taking the actual assembly sequence into consideration.

FIGS. 9C and 9D

The axle pin 410 of the trip device 41 is covered by the shield 43, from the middle of which projects the pressure part 412. The spar 411 projects out of one end of the shield 43. One end of the spring 42 placed on the axle pin 410 is held under the hook 413. In principle, the parts 411,412 project in the same direction. Claws (not visible) from the inclination 522 engage in the two grooves 532 of the intermediate wedge 53, and its back surface 531 faces the shield 43. The control cam 48 is arranged above the primary wedge 52.

FIGS. 9E to 9G

The axle pin 410 of the trip device 41 rests on the bed structure 402 of the base 40, and the pressure part 412 projects into the cone opening 400. The second end of the spring 42 is supported on the rear end of the base 40 such that the trip device 41 has to be actuated against the action of the spring 42. The shield 43 boxes-in the axle pin 410 and the spring 42 resting thereon. The control cam 48 is placed on the two posts 403 so as to bridge the same.

FIGS. 9H to 9L

The back surface 531 of the intermediate wedge 53 lying below the control cam 48 is facing the inner post 403, whilst the grooves 532 close to the inclined surface 530 are in sliding engagement with the primary wedge 52. The fork prongs 521 end in the region of the two cutouts 406 of the base 40. The buffer 44 is inserted in the molded groove 4070. The upper region of the outer post 403 comes to rest in the space 523 of the primary wedge 52. The bearing journals 45 serve for the subsequent connection between the backrest carrier 60, the shell 30 and the base 40 along the first axis of rotation D1.

FIG. 9M

The spring system 46 is suspended on a shaft 465 which is provided in the middle with a center roller 464 (not visible here). On both sides of the center roller 464 one rotatable outer roller 463 is placed on each shaft 465, which in each case projects through a lower part 462 by way of its ends. Each lower part 462 engages in a telescopic manner in an associated upper part 461, a helical spring 460 being accommodated axially between said upper and lower part 462, 461. Consequently, the spring system 46 has two springs 460 which act parallel to each other. The bottom surface of the intermediate part 53 is supported on the center roller 464. The description of the support of the outer rollers 463 can be found below. The spring system 46 projects into the base 40 by way of the lower parts 462 and the adjacent regions of the helical springs 460. The further part of the spring system 46 projects out of the base 40 through the two cutouts 406 in said base.

FIGS. 10A to 10L

This sequence of figures illustrates the principle assignment of components—substantially in conjunction with the shell 30—in successive assembly without taking the actual assembly sequence into consideration.

FIGS. 10A to 10D

Just as the bearing journal 45, the bearing journal 35 also has a head 350, from which extends the axle portion 351, which ends freely with a threaded portion 352. The oval-shaped plate 33 has one through hole 330 in each case in the vicinity of its two outer ends.

The height adjuster 14, which is present to actuate the trip device 41, consists of a handle 142, the multi-edge rod 141 fixedly inserted therein and the lever 140 fixedly mounted on said multi-edge rod. In the mounted state, the stop adjuster 38, which consists of a handle 382, a multi-edge rod 381 fixedly inserted therein and a lever 380 fixedly arranged thereon, comes to rest above the front edge of the shell cover 37. The lever 380 has a locking contour 385 which is composed of two adjoining notches. An entrainment means 384 is connected in each case to the multi-edge rod 381 in the vicinity of the handle 382 and outside, behind the lever 380. Each entrainment means 384 extends to a plate-shaped blocking element 383 such that when the stop adjuster 38 is rotated, the blocking element 383 is raised. The stop adjuster 38 can be moved into two self-locking positions, the cam 509 of the bearing block 50 coming to rest in one of the two depressions in the locking contour 385. The multi-edge rod 381 is secured at the free end with a nut 389 for retaining the lever 380. The force adjuster 39, which ends at the outside with the handle 397, is positioned above the shell cover 37, in front of the blocking elements 383. The coupling piece 393 has a tubular spring guide 395 internally for receiving the helical spring 394, the spring guide 395 being secured by way of an axially introduced screw 396. A guide tube 392, from which a multi-edge rod 391 emerges, on the free end of which a toothed wheel 390 is secured, projects out of the coupling piece 393. A toothing 511, which is situated on the facing end of the rod section 510 of a transfer part 51, engages the toothed wheel 390. The other end of the rod section 510 is provided with an external thread, on which an entrainment means 513 runs so as to be longitudinally adjustable along the external thread when the force adjuster 39 is rotated and the rotational movement is transferred to the rod section 510. The entrainment means 513 has two wing attachments which project outward.

FIGS. 10E to 10H

The complete stop adjuster 38 is inserted transversely in the front region of the shell 30, the blocking elements 383 leaning against the posts 310 and the handle 382 projecting out of the third axle hole 303 and consequently being reachable to the user. The bearing block 50 is inserted into the front region of the shell 30 onto the stop adjuster 38 and is screwed through the screw seat 501 to the corner journal 313. A bed 315, which consists, in principle, of two vertical webs which are parallel to each other at a spacing and depressions which are present therein, rises up from the bottom 31. The housing 505 of the bearing block 50 rests on the bed 315. The cutout 506 in the housing 505 forms, together with a complementary cutout in the bed 315, a round opening for receiving the toothed wheel 390 which rests on the multi-edge rod 391. The toothing 511 lies internally of the joining of the bed 315 and the housing 505 screw-connected thereto, and the remaining section of the transfer part 51 is situated between the runners of the bed 315 and the support 507 continuing from the housing 505. The blocking elements 383 are consequently encompassed by the cavities 502 in the bearing block 50.

FIGS. 10J to 10L

The complete force adjuster 39 is inserted, the toothed wheel 390 being inserted in the expanded cutout 506 and internally engaging the toothing 511 of the transfer part 51. The free pin end of the toothed wheel 390 rests in the emerging expanded cutout 506. The multi-edge rod 391 penetrates the adjacent post 310 and emerges with the guide tube 392 out of the fourth axle hole 304 such that the user is able to grip the handle 397. The complete height adjuster 14 is also inserted, the lever 140, which is placed non-rotatably on the multi-edge rod 141, resting between the two second bearing elements 312 and the free pin end of the multi-edge rod 141 being inserted rotatably in the inner bearing element 312. The transition from the multi-edge rod 141 to the handle 142 projects through the fifth axle hole 316 to the outside such that the handle 142 can be reached by the user. The free end of the lever 140 points to the rear region of the shell 30. Bearing journals 35, which come to rest by way of their heads 350 in the axle holes 305 which emerge with countersinking on both sides of the shell 30, serve for the subsequent fastening of plates 33. The axle sections 351 extend along the second axis of rotation D2 in each case between the relevant pair of first bearing elements 311, the respective threaded section 352 engaging in the associated inner first bearing element 311. The cavity 302 below the bottom 31 of the shell 30 can be closed by way of the shell cover 37. The cavity 302 can be used, for example, for inserting operating and maintenance instructions.

FIGS. 11A and 11B

First bearing bushes 68, through which the first axis of rotation D1 is aligned, are provided for the mounting of the backrest carrier 60 and are to be inserted into the two first axle holes 61 in said carrier. Second bearing bushes 69 are to be inserted into the second axle holes 64, through which the fourth axis of rotation D4 extends, in order to receive axle pins 83 therein.

FIGS. 12 to 14C

The pusher 81, in principle cuboid-shaped, has a longitudinal part 810 which merges at one end into an elevated head 811. A locking contour 812 pointing to the longitudinal part 810 is situated on the head 811. A spring 814 is inserted into the pusher 81.

The retaining element 82 has a plate 820, in principle rectangular, from which a plate-formed attachment 821, which is approximately of equal size, extends at a right angle. Outwardly pointing arm-like locking members 822 project from the two narrow sides of the plate 820.

The second buffer 85 consists essentially of a U-shaped segment 850. A nose 851 is attached on each of the free ends of the side flanks of the U-shaped segment 850, both noses 851 being in alignment with each other.

The connector socket 86 is an irregularly formed body with an axially arranged blind hole 860 and a hook 862 which extends axially with respect to the blind hole 860. The connector socket 86 has an outwardly pointing arm-like locking member 861 on each of the outer flanks. When the connector socket 86 is locked together with the second buffer 85, the U-shaped segment 850 encompasses the hook 862, the noses 851 engaging behind the hook 862.

FIGS. 15A and 15B

This pair of figures illustrates the principle assignment of the components 81, 82,85,86,87 in conjunction with the seat carrier 80 without taking the actual assembly sequence into consideration. The pusher 81 is inserted by way of its bottom surface and with its head 811 first into the secondary connecting piece 805. The pusher 81 can be displaced in opposition to the spring 814 in the longitudinal extension of the secondary connecting piece 805. In each case a retaining element 82 is positioned on the inner flank of each inner first bearing element 807. In this case, the plate 820 sits on the bottom surface 802 of the seat carrier 80, the attachment 821 abuts against the first bearing element 807 and the locking members 822 engage through the locking holes 8020 in the plate 800. The attachments 821 project in part in front of the axial holes present in the first bearing elements 807. In each case, a connection socket 86 with the second buffer 85 locked thereon is placed onto the second bearing elements 808. In this case, the second buffers 85 lie adjacent to the side wall of the seat carrier 80 and the locking members 861 engage through the locking holes 8020 associated with the second bearing elements 808. The accesses of the blind holes 860 of the connection sockets 86 lie along the fifth axis of rotation D5 and point to each other. For placing onto the two outer flanks of the top surface 801 of the seat carrier 80, in each case there is provided a sliding rail 87 which hangs from the journals 810 projecting through the sliding rail 87, which rise up from the top surface 801.

FIGS. 16A and 16B

For the mounting of the guide means 70, a primary axle rod 84, which projects out of the side of the guide means 70 in the inserted state, is provided to be inserted in the first axle hole 704 of said guide means, through which the fifth axis of rotation D5 is aligned. The two rollers 71 are intended to be placed onto the secondary axle rod 24, which is to be inserted into the second axle holes 703. The rollers 71, in this case, come to rest in the space 705. In each case a plate-shaped insert 72 is inserted into the recesses 707 of the two arms 706 of the guide means 70, the positioning of the inserts 72 being secured by the stops 708. The guide means 70 preferably consists of plastics material, whilst the inserts 72 have greater abrasion resistance and are, for example, produced from sheet metal.

FIGS. 17A to 17G

This sequence of figures illustrates the principle assignment of components—in conjunction with the shell 30 and the base 40 inserted therein—in successive assembly without taking the actual assembly sequence into consideration.

FIGS. 17A to 17C

The lower parts 462, outer rollers 463, center roller 464 and shaft 465 of the spring system 46 lie in the region of the two posts 403. The helical springs 460 with the upper parts 461 placed thereon project to the front region of the shell 30. Encompassing the rear part of the shell 30, the backrest carrier 60 with the first bearing bushes 68 inserted into the first axle holes 61 is positioned along the first axis of rotation D1. The first axle holes 306,61 of shell 30 and backrest carrier 60 are in alignment with each other. The second bearing bushes 69, which receive the axle pins 83 and form the fourth axis of rotation D4, are inserted into the second axle holes 64 of the backrest carrier 60. With the bearing block 50 inserted into the front region of the shell 30, the upper parts 461 of the spring system 46 are supported against the cross strut 500. The housing 505 with the support 507 comes to rest between the two upper parts 461. Up to now the cavities 502 between the posts 310 of the shell 30 and the bearing block 50 are unoccupied.

FIGS. 17D and 17E

The rod section 510 of the transfer part 51 is inserted in the reception 504 of the housing 505. The entrainment means 513 of the transfer part 51 strikes against the primary wedge 52, which is docked on the intermediate wedge 53. The intermediate wedge 53, which is carried by the center roller 464, sits under the primary wedge 52.

FIG. 17F

The complete height adjuster 14 and the associated trip device 41 are inserted. In this case, the lever 140 of the height adjuster 14, which is actuatable at the outer handle 142, sits on the spar 411 of the trip device 41. The pressure part 412 can be depressed against the action of the spring 42 when the height adjuster 14 is actuated such that the height-adjustment pneumatic spring 12 is released for adjustment.

FIG. 17G

The complete stop adjuster 38 is installed. The blocking elements 383 are now inserted in the cavities 502 which up to now have been unoccupied. The positioning of the guide means 70 is indicated, said guide means being fastened on the seat carrier 80 along the fifth axis of rotation D5 in the mounted state. The two rollers 71 of the guide means 70 sit on the control cam 48. The two outer rollers 463 of the spring system 46 sit on the inserts 72, which are provided for the guide means 70.

FIGS. 18A and 18B

A plate 33 is mounted in each case into the two front first bearing elements 807 on the seat carrier 80. A first bearing bush 34 is inserted into the two through holes 330 of the plate 33. An axle pin 83 projects through the axle holes of the two first bearing elements 807 and the plate 33 with the first bearing bush 34 sitting in the relevant through hole 330. The axle pin 83 is held in the axial position at the one end by the lateral wall of the seat carrier 80 and at the other end by the locked retaining element 82. Consequently, the plates 33 are connected in an articulated manner at the one end in the third axis of rotation D3. The second axis of rotation D2 extends through the other through holes 330 of the plates 33, which up to now have only been provided with the first bearing bushes 34.

The backrest carrier 60 is connected in an articulated manner on the seat carrier 80 along the fourth axis of rotation D4 in an identical manner. In this case, second bearing bushes 69 sit in the second axle holes 64 and axle pins 83 are inserted in said bearing bushes 69. The axle pins 83 project, once again, through the axle holes in the first bearing elements 807, which, between them, accommodate the respective surrounding region of the second axle holes 64 of the backrest carrier 60. The lateral walls of the seat carrier 80 and retaining elements 82 locked thereon once again bring about the axial positioning of the axle pins 83.

The guide means 70 is arranged on the seat carrier 80 along the fifth axis of rotation D5. In this case, one connector socket 86 is placed on each of the two ends of the primary axle rod 84 projecting out of the first axle hole 704 and accommodates the relevant axle end in its blind hole 860. The connector sockets 86 are locked onto the second bearing elements 808. A second buffer 85, which is connected to the associated connector socket 86, sits between the lateral walls of the seat carrier 80 and each of the two adjacent connector sockets 86. The breakthrough 8024 and the indentation 8023 on the bottom surface 802 of the seat carrier 80 provide space for the pivoting guide means 70.

FIGS. 19A to 19C

With the mechanism 2 in the completely mounted state, the ends of the plates 33, which up to now have been free, hang between the pairs of first bearing elements 311 such that the relevant axle holes are all in alignment with each other and the bearing journals 35 are inserted, the heads 350 of said bearing journals 35 resting in the second axle holes 305, the axle sections 351 projecting through the up to now unoccupied first bearing bushes 34 and the threaded sections 352 engaging in the inner first bearing elements 311. The connection on the second axis of rotation D2 is thereby produced. Of the remaining bearing journals 45, the heads 450 sit from the outside on the first axle holes 61 of the backrest carrier 60, the axle sections 451 project through the first bearing bushes 68 sitting in the first axle holes 61 of the backrest carrier 60 as well as the second bearing bushes 32 sitting in the first axle holes 306 of the shell 30. Finally, the threaded sections 452 of the bearing journals 45 engage in the axle holes 401 of the base 40, said axle holes being provided with internal thread. The connection between the backrest carrier 60, the shell 30 and the base 40 is thereby produced along the first axis of rotation D1. The two rollers 71 of the guide means 70 sit on the control cam 48 and the outer rollers 463 of the spring system 46 are supported on the inserts 72 which are inserted into the guide means 70.

The depth of the seat 9 arranged on the mechanism 2 can be adjusted using the pusher 81 which is inserted in the secondary connecting piece 805 of the seat carrier 80. In this case, when the pusher 81 is pushed forward, its locking contour 812 disengages from a complementary contour on the seat 9.

When the relaxation position is reached, i.e. the position of the seat 9 is $S_{max}$ and the position of the backrest 96 is $R_{max}$, the second buffers 85 in the seat carrier 80 contact the elevations 309 in the shell 30. When the negative position is reached, the position of the seat 9 is $S_{min}$ and the position of the backrest 96 is $R_{min}$, the top surface of the stop 314 in the shell 30 strikes below against the first buffer 44 which sits in the molded groove 4070 in the base 40.

FIGS. 20A to 20C

In the case of this simplified seat carrier 80, the facility for adjusting the depth of the seat 9 has been omitted, as a result the secondary connection piece 805 has been left out. The seat carrier 80 is an integrated part of the seat 9 and is preferably developed as the bottom surface of the cushion plate. In place of the paired arrangement of first bearing elements 807, only one such element is provided here in each case. The locking holes 9020 are omitted. First bearing elements 807 are present along the fifth axis of rotation D5 instead of the second bearing elements 808. The side walls of the seat carrier 80 have openings 8022 along the third axis of rotation D3 and the fourth axis of rotation D4 in order to accommodate the ends of associated axles therein. Once again on this seat carrier 80, the two plates 33 are arranged along the third axis of rotation D3, the backrest carrier 60 is arranged along the fourth axis of rotation D4 and the guide means 70 is arranged along the fifth axis of rotation D5. In addition, the plates 33 along the second axis of rotation D2 are connected unchanged to the first bearing elements 311 in the shell 30. Finally, the backrest carrier 60, the shell 30 and the base 40 arranged therein are linked together along the first axis of rotation D1 by means of the bearing journals 45 resulting in a modified mechanism 2.

FIGS. 21A to 23E

This sequence of figures shows the movement sequences of the mechanism 2, proceeding from the rest position $S_0/R_0$ towards the relaxation position $S_{max}/R_{max}$ and towards the negative position $S_{min}/R_{min}$, in each case with a high and a low force setting. In each case a top view of the mechanism 2 with a centric and an eccentric vertical section is used.

FIGS. 21A to 21C

The mechanism 2 is situated in the rest position, i.e. the position of the seat 9 is $S_0$ and the position of the backrest 96 is $R_0$. The force adjuster 39 is situated in the position of a high force setting such that the mechanism 2 is adjusted for heavy persons who lean with their heavy weight against the backrest 96 and correspondingly high resistance against the deflection thereof is necessary.

The entrainment means 513, which is extended in a maximum manner in the direction of the posts 403 on the rod section 510 of the transfer part 51, has displaced the primary wedge 52 in the identical direction and at the same time has depressed the intermediate wedge 53. The deep position of the intermediate wedge 53, which sits on the center roller 464, which is arranged on the shaft 465, which extends through the prestressed spring system 46, causes the spring system 46, which is suspended on the shaft 465, to be lowered deeply. The two outer rollers 463 of the spring system 46 are supported on the respective inclined insert 72 on the guide means 70. The roller 71 on the guide means 70 sits on the control cam 48. As a result of the longer lever arm formed between the fifth axis of rotation D5 and the shaft 465, an increased force—by the user being supported against the backrest 96—is necessary to move the mechanism 2 into the relaxation position. The lower parts 462 are moved closer towards the upper parts 461 and the helical springs 460 are thereby more stressed. As a result, a user has to exert a greater force to move the backrest 96 in the direction of the relaxation position $R_{max}$, i.e. on the other hand persons of heavier weight are supported more strongly by the backrest 96. The seat carrier 80 and the backrest carrier 60 are situated in the non-deflected position.

FIGS. 21A, 21D and 21E

The mechanism 2 continues to be in the rest position, i.e. the position of the seat 9 is $S_0$ and the position of the backrest 96 is $R_0$. The force adjuster 39 is situated in the position of a low force setting such that the mechanism 2 is adjusted for light persons who lean with their lesser weight against the backrest 96 and correspondingly less resistance against the deflection thereof is necessary.

The entrainment means 513, which is extended in a minimum manner in the direction of the posts 403 on the rod section 510 of the transfer part 51, allows the primary wedge 52 to be advanced in the direction of the cross strut 500 and at the same time the intermediate wedge 53 to be raised. The high position of the intermediate wedge 53 means that the spring system 46, which is suspended on the shaft 465, is lowered less deeply. In principle, the roller 71 on the guide means 70 sits unchanged on the control cam 48. As a result of the shorter lever arm formed between the fifth axis of rotation D5 and the shaft 465, a reduced force—by the user being supported against the backrest 96—is necessary to move the mechanism 2 into the relaxation position. The lower parts 462 are further from the upper parts 461 and the helical springs 460 are thereby less stressed. A user, therefore, has to use less force to move the backrest 96 in the direction of the relaxation position $R_{max}$, i.e. persons of lesser weight are supported less strongly by the backrest 96. The seat carrier 80 and the backrest carrier 60 are still situated in the non-deflected position.

FIGS. 22A to 22C

The mechanism 2 is situated in the relaxation position, i.e. the position of the seat 9 is $S_{max}$ and the position of the backrest 96 is $R_{max}$. The force adjuster 39 is situated in the position of a high force setting. When the backrest 96 is inclined, the seat carrier 80 has been moved synchronously into the maximum seat inclination $S_{max}$ as a result of the articulated connection in the fourth axis of rotation D4 between the seat carrier 80 and the backrest carrier 60, which is pivotable about the first axis of rotation D1. At the same time, the plates 33 which are suspended in the axes of rotation D2,D3 were moved and the guide means 70 which is held in the fifth axis of rotation D5 was pivoted in the direction of the spring system 46 such that the helical springs 460 are under a larger amount of stress. This is brought about by the outer rollers 463 pressing against the guide means 70 and the center roller 464, which presses against the intermediate wedge 53 and now stands quasi at the tip of the intermediate wedge 53 facing the cross strut 500. In addition, the roller 71 of the guide means 70 has moved on the control cam 48 towards the edge thereof. The guide means 70, which presses against the outer rollers 463, does not allow the spring system 46 to be relaxed. A user is supported the strongest by the backrest 96 prior to achieving the complete relaxation position and the most intensively when setting it in the upright position.

FIGS. 22A, 22D and 22E

The mechanism 2 is once again situated in the relaxation position. The force adjuster 39 is now at a low force setting. The primary wedge 52 has been displaced back in the direction of the cross strut 500 and the intermediate wedge 53 has, consequently, been able to move upward to the control cam 48. The synchronous movement between backrest 96 and seat carrier 80 occurs as for FIGS. 22B and 22C. Consequently, the guide means 70, which is held in the fifth axis of rotation D5, has been pivoted again in the direction of the spring system 46 such that the helical springs 460 have been compressed. This, once again, is brought about by the outer rollers 463 which press on the guide means 70 and the center roller 464 which presses against the intermediate wedge 53 and is now close to the tip of the intermediate wedge 53 facing the cross strut 500. In addition, the roller 71 of the guide means 70 has moved on the control cam 48 towards the edge thereof again.

FIGS. 23A to 23C

The mechanism 2 is situated in the negative position, i.e. the position of the seat 9 is $S_{min}$ and the position of the backrest 96 is $R_{min}$. The connection between shell 30 and seat carrier 80 has been lowered about the first axis of rotation D1 at the front edge of the seat, whilst the base 40 remains immobile. The force adjuster 39 is set at a high force setting, as in FIGS. 21B and 21C. The roller 71 of the guide means 70 sits quasi centrically on the control cam 48. The primary wedge 52 has been displaced in a maximum manner in the direction of the post 403, which is adjacent to the cone opening 400, and the intermediate wedge 53, which is supported thereon, is displaced downward. The center roller 464 rests in a slightly eccentric manner on the facing sliding surface on the intermediate wedge 53, similarly as in FIG. 21B.

FIGS. 23A, 23D and 23E

The mechanism 2 continues to be in the negative position, that is to say the connection between shell 30 and seat carrier 80 has been lowered about the first axis of rotation D1 at the front edge of the seat. The force adjuster 39 is now set to a low force setting. The rollers 71 of the guide means 70 rest on the control cam 48 as for FIGS. 23B and 23C. The positions of the primary wedge 52 and the intermediate wedge 53 correspond to FIGS. 21D and 21E. The center roller 464 rests in an almost centric manner on the facing sliding surface on the intermediate wedge 53.

FIGS. 24 and 25

The backrest 96 has a frame 973 which merges into a cross strut 971 at the bottom. Holes 970, for connection—preferably screw connection—to the holes 660 which are present in the backrest carrier 60, are situated in the cross strut 971. Two flank struts 972, which are situated with respect to each other in a U-shaped manner and each have a fitting block 976, project from the cross strut 971. The fitting blocks 976 are developed in a complementary manner for docking on the reception 66 of the backrest carrier 60.

Uppermost the armrest 98 has a cushion part 981, from which a support 980 extends downward, said support merging into a curved intermediate part 983. A molded part 984 connects to the intermediate part 983. The molded parts 984 are developed in a complementary manner for insertion into the guides 804 of the supports 803 of the seat carrier 80.

The following alternative to the base 40, which up to now is inserted into the shell 30 as a separate component, can also be specifically mentioned, as a result of which the mechanism 2 is able to move into a negative inclination. If the negative inclination is not required, shell 30 and base 40 are realized in one piece, i.e. the functional structure on the base 40 for the synchronous movement between backrest 96 and seat carrier 80 is completely contained in the shell 30.

The invention claimed is:

1. A mechanism (2) for a chair, in particular for a rotatable office chair having a pneumatic spring (12) which is arranged vertically in the underframe (1) and has a telescopically extensible piston rod for the adjustability of the height of a seat (9), wherein:

a) the inclining adjustment of the seat (9) between the rest position ($S_0$) and the relaxation position ($S_{max}$) is synchronous with an adjustment of a backrest (96) between a rest position ($R_0$) and a rearwardly inclined relaxation position ($R_{max}$);

b) the mechanism (2) has a shell (30), through which a fixed first axis of rotation (D1) extends and on which an inclinable seat carrier (80) is mounted;

c) a front connecting means (33) is arranged between the seat carrier (80) and the shell (30), said front connecting means being connected in an articulated manner on the shell (30) in a second axis of rotation (D2) and on the seat carrier (80) in a third axis of rotation (D3);

d) a rear connecting means (60) is connected in an articulated manner in the first axis of rotation (D1) and in a fourth axis of rotation (D4) which extends through the seat carrier (80);

e) a spring system (46) acts between the shell (30) and the seat carrier (80);

f) the mechanism (2) has a force adjuster (39) which is actuatable from the outside and for modifying the prestressing of the spring system (46) by means of a gearing arrangement (390,51,52,53), wherein g) the gearing arrangement (390,51,52,53) includes movably positionable means (52,53) with inclined surfaces present thereon, on which a rear bearing arrangement (462,464,465) of the spring system (46) is supported;

wherein by combining the shell (30) with a base (40), which is arranged in said shell and is realized as a separate part, the seat (9), when loaded at the front, is able to be adjusted between the rest position ($S_0$) and a negative position ($S_{min}$) with a front edge of the seat (9) lowered;

h) the gearing arrangement (390,51,52,53) includes:

a toothed wheel (390) which can be rotated by means of a rotational movement at the force adjuster (39);

a longitudinally movable transfer part (51) with a toothing (511) which engages with the toothed wheel (390);

a primary wedge (52) which is longitudinally displaceable by the transfer part (51); and an intermediate wedge (53) attached to the primary wedge (52), wherein primary wedge (52) and intermediate wedge (53) are displaceable towards each other;

i) the spring system (46) includes two arrangements which are parallel to each other, each consisting of one upper part (461) which is telescopically connected to a lower part (462), wherein a helical spring (460) is accommodated between upper part (461) and lower part (462); and j) the rear bearing arrangement (462,464,465) of the spring system (46) includes the two lower parts (462), a shaft (465) which projects through both lower parts (462) and a center roller (464) which is placed on the shaft (465) between the lower parts (462).

2. The mechanism (2) as claimed in claim 1, wherein the transfer part (51) has a rod section (510) with an external thread arranged thereon, on which an entrainment means (513), which strikes against the primary wedge (52), is displaceably guided.

3. The mechanism (2) as claimed in claim 1, wherein a) the intermediate wedge (53) is arranged below the primary wedge (52), is supported from below by the center roller (464) and at the front end leans against a post (403) which rises out of the base (40); and b) the upper parts (461) are associated with a front bearing arrangement (461,50) of the spring system (46).

4. The mechanism (2) as claimed in claim 1, wherein a) a guide means (70) is connected in an articulated manner on the seat carrier (80) in a fifth axis of rotation (D5);

b) the fifth axis of rotation (D5) on the guide means (70) runs through a cross portion (700);

c) two arms (706) which are parallel to each other extend from the cross portion (700);

d) an outside roller (463) which is placed on the shaft (465) is arranged in each of the lower parts (462); and e) in each case one of the outside rollers (463) is guided on one of the arms (706) of the guide means (70).

5. The mechanism (2) as claimed in claim 2, wherein a roller (71), which is supported on a control cam (48), which is positioned on the base (40), is arranged on the guide means (70).

6. The mechanism (2) as claimed in claim 3, wherein a) at a spacing from the one post (403), against which the intermediate wedge (53) leans and which is adjacent to a cone opening (400) for the reception of a height-adjustment pneumatic spring (12), a further post (403) rises out of the base (40); and b) the control cam (48) is arranged so as to bridge the two posts (403).

7. The mechanism (2) as claimed in claim 3, wherein a) the control cam (48) is provided with a curved contour which has an influence on the movement characteristic of the mechanism (2); and b) the curved contour of the control cam (48) is selectable according to whether the mechanism (2) is provided for a chair for users of taller than average height or heavier than average weight or users of smaller than average height or lighter than average weight or to the development of the backrest (96) to be attached.

8. The mechanism (2) as claimed in claim 1, wherein a) the front bearing arrangement (461,50) of the spring system (46) is formed by the upper parts (461) and a bearing block (50) in which the upper parts (461) are supported;

b) the bearing block (50) is mounted in the front region of the shell (30) and has a housing (505) in which the toothed wheel (390) of the force adjuster (39) is mounted; and c) a stop adjuster (38), which is actuatable from the outside and blocks the mobility of the seat carrier (80) out of the rest position ($S_0$) into the relaxation position ($R_{max}$) and the backrest (96), is arranged below the bearing block (50).

9. The mechanism (2) as claimed in claim 1, wherein a) the rear connecting means (60) has a reception (66) for the docking of a connection (97) of the backrest (96); and b) the reception (66) circles the connecting means (60) in a U-shaped manner such that the connection (97) with a cross strut (971) and the two flank struts (972) projecting therefrom are able to be pushed onto the reception (66) from the back.

10. The mechanism (2) as claimed in claim 1, wherein a) one connecting piece (803) with a guide (804) extends from the seat carrier (80) on each of the two sides in order to accommodate a complementary molded part (984) of an armrest (98) therein; and b) the seat carrier (80) is a separate component or an integral component part of the base plate of the seat (9).

11. The mechanism (2) as claimed in claim 1, wherein an additional spring system is supported from above in the rear region of the shell (30) by way of a lower part and from below in the rear region of the seat carrier (80) by way of an upper part.

* * * * *